US009984631B2

(12) United States Patent
Park

(10) Patent No.: US 9,984,631 B2
(45) Date of Patent: May 29, 2018

(54) ORGANIC LIGHT EMITTING DISPLAY DEVICE

(71) Applicant: SAMSUNG DISPLAY CO., LTD., Yongin, Gyeonggi-Do (KR)

(72) Inventor: Kyong-Tae Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 340 days.

(21) Appl. No.: 14/731,364

(22) Filed: Jun. 4, 2015

(65) Prior Publication Data

US 2016/0104430 A1 Apr. 14, 2016

(30) Foreign Application Priority Data

Oct. 10, 2014 (KR) ..... 10-2014-0136617

(51) Int. Cl.
*G09G 3/30* (2006.01)
*G09G 3/3291* (2016.01)
(Continued)

(52) U.S. Cl.
CPC ..... *G09G 3/3291* (2013.01); *G09G 3/006* (2013.01); *G09G 3/3233* (2013.01);
(Continued)

(58) Field of Classification Search
CPC ..... G09G 3/32; G09G 3/20; G09G 2330/08
(Continued)

(56) References Cited

U.S. PATENT DOCUMENTS

2008/0121901 A1 5/2008 Kim et al.
2014/0292827 A1* 10/2014 Kang ..... G09G 3/20 345/690
2015/0364116 A1* 12/2015 Kong ..... G09G 3/3291 345/205

FOREIGN PATENT DOCUMENTS

EP 2 955 710 A2 12/2015
EP 2998953 A2 3/2016
(Continued)

OTHER PUBLICATIONS

EPO Search Report dated Feb. 10, 2016, for corresponding European Patent application 15186880.9, (7 pages).
(Continued)

*Primary Examiner* — Calvin C Ma
(74) *Attorney, Agent, or Firm* — Lewis Roca Rothgerber Christie LLP

(57) ABSTRACT

An organic light emitting display device includes: data lines and auxiliary data lines, scan lines and light emission control lines crossing the data lines and the auxiliary data lines, a display area including display pixels formed at crossing regions of the data lines, the scan lines, and the light emission control lines, a non-display area including auxiliary pixels formed at crossing regions of the auxiliary data lines, the scan lines, and the light emission control lines, and auxiliary lines connected to the auxiliary pixels. Each of the auxiliary pixels may include: an auxiliary pixel driver configured to supply a driving current to a corresponding one of the auxiliary lines, and an auxiliary transistor connected to the corresponding one of the auxiliary lines and to a first power voltage line, configured to transmit a first power voltage from the first power voltage line, in response to a control signal.

20 Claims, 18 Drawing Sheets

(51) Int. Cl.
*G09G 3/00* (2006.01)
*G09G 3/3233* (2016.01)
*G09G 3/3266* (2016.01)

(52) U.S. Cl.
CPC ... *G09G 3/3266* (2013.01); *G09G 2300/0413* (2013.01); *G09G 2300/0819* (2013.01); *G09G 2300/0842* (2013.01); *G09G 2300/0861* (2013.01); *G09G 2300/0876* (2013.01); *G09G 2310/0251* (2013.01); *G09G 2310/0256* (2013.01); *G09G 2310/0278* (2013.01); *G09G 2310/0291* (2013.01); *G09G 2320/0209* (2013.01); *G09G 2330/08* (2013.01); *G09G 2330/10* (2013.01); *G09G 2360/16* (2013.01)

(58) Field of Classification Search
USPC ..... 345/76, 77, 690
See application file for complete search history.

(56) References Cited

FOREIGN PATENT DOCUMENTS

| | | | |
|---|---|---|---|
| KR | 10-0666639 | B1 | 1/2007 |
| KR | 10-2008-0048895 | A | 6/2008 |

OTHER PUBLICATIONS

EPO Office Action dated Nov. 30, 2016, for corresponding European Patent Application No. 15186880.9 (5 pages).

* cited by examiner

ORGANIC LIGHT EMITTING DISPLAY DEVICE

CROSS-REFERENCE TO RELATED APPLICATION

This application claims priority to and the benefit of Korean Patent Application No. 10-2014-0136617, filed on Oct. 10, 2014, in the Korean Intellectual Property Office, the content of which is incorporated herein by reference in its entirety.

BACKGROUND

1. Field

Embodiments of the present invention relate to an organic light emitting display device.

2. Description of the Related Art

With the development of information technology, a demand for various forms of display devices which display images has been increasing. Recently, various types of flat panel displays such as liquid crystal displays, plasma display panels, or organic light emitting display devices, have been in use.

An organic light emitting display device, among these flat panel displays, includes a display panel, a data driver and a scan driver. The display panel includes data lines, scan lines and a plurality of pixels arranged in a matrix format at crossing regions between the data lines and the scan lines. The data driver supplies data voltages to the data lines. The scan driver supplies scan signals to the scan lines. In addition, the display panel may further include a power supply providing a plurality of power voltages. Each of the pixels emits light with predetermined brightness by using a plurality of transistors according to the amount of current flowing from a first power voltage, among the plurality of power voltages, to an organic light emitting diode in response to a data voltage supplied through the data line when the scan signal is provided.

However, a defect may occur in the transistors of the pixels during a manufacturing process of the organic light emitting display device. This defect may cause a decrease in yield of organic light emitting display devices. To avoid the decrease in yield, Korean Patent Registration No. 10-0666639 discloses a repair method of repairing a defective pixel by forming auxiliary pixels in an organic light emitting display device and connecting the defective pixel to one of the auxiliary pixels.

According to the above-described repair method, transistors of the defective pixel are disconnected from the organic light emitting display device, and transistors of the auxiliary pixel are connected to an anode electrode of the organic light emitting diode of the defective pixel by using an auxiliary line. As a result, the organic light emitting diode of the defective pixel may emit light by driving the transistors of the auxiliary pixel.

However, parasitic capacitances may be formed between the auxiliary line and anode electrodes of organic light emitting diodes, and fringe capacitance may be formed between the auxiliary line and a neighboring scan line. Therefore, a voltage of the auxiliary line may be changed due to the parasitic capacitances and the fringe capacitance. As a result, an organic light emitting diode of the repaired pixel may emit light in error.

SUMMARY

Aspects of one or more embodiments of the present invention are directed toward an organic light emitting display device capable of preventing (or protecting) an organic light emitting diode of a repaired pixel from emitting light in error.

An exemplary embodiment of the present invention provides an organic light emitting display device, including: data lines and auxiliary data lines, scan lines and light emission control lines crossing the data lines and the auxiliary data lines, a display area including display pixels formed at crossing regions of the data lines, the scan lines, and the light emission control lines, a non-display area including auxiliary pixels formed at crossing regions of the auxiliary data lines, the scan lines, and the light emission control lines, and auxiliary lines connected to the auxiliary pixels; each of the auxiliary pixels may include: an auxiliary pixel driver configured to supply a driving current to a corresponding one of the auxiliary lines, and an A transistor (or auxiliary transistor) connected to the corresponding one of the auxiliary lines and a first power voltage line, the auxiliary transistor being configured to transmit a first power voltage from the first power voltage line, in response to a control signal.

The corresponding one of the auxiliary lines may be connected to an auxiliary pixel from among the auxiliary pixels in a $p^{th}$ row and cross display pixels in the $p^{th}$ row from among the display pixels, where p is a positive integer.

The corresponding one of the auxiliary lines may be connected to one of the display pixels in the $p^{th}$ row.

The auxiliary pixel in the $p^{th}$ row and the display pixels in the $p^{th}$ row may be connected to a $k-1^{th}$ scan line and a $k^{th}$ scan line from among the scan lines, and a $k^{th}$ light emission control line from among the light emission control lines, where k is a positive integer of 2 or more.

A control electrode of the auxiliary transistor may be connected to a pull-down control node of a light emission stage connected to a $k+\alpha^{th}$ light emission control line from among the light emission control lines, where $\alpha$ is a positive integer.

The auxiliary pixel in the $p^{th}$ row further may include an inverter connected to a $k+\alpha^{th}$ light emission control line from among the light emission control lines and a control electrode of the auxiliary transistor, configured to invert a light emission control signal supplied to the $k+\alpha^{th}$ light emission control line, and to supply an inverted light emission control signal to the control electrode of the auxiliary transistor.

The auxiliary pixel in the $p^{th}$ row may include: a B transistor (an auxiliary control transistor) connected to a control electrode of the auxiliary transistor and a gate-off voltage line connected to a gate-off voltage supply, and a resistor connected to the control electrode of the auxiliary transistor and a gate-on voltage line connected to a gate-on voltage is supply, and a control electrode of the auxiliary control transistor is connected to a $k+\alpha^{th}$ light emission control line from among the light emission control lines.

The organic light emitting display device may further include: a scan driver configured to supply scan signals to the scan lines, a light emission driver configured to supply light emission control signals to the light emission control lines, a first data driver configured to supply data voltages to the data lines, and a second data driver configured to supply auxiliary data voltages to the auxiliary data lines, wherein the second data driver is configured to supply one of the auxiliary data voltages to the auxiliary pixel in the $p^{th}$ row in synchronization with data voltages supplied to the display pixels in the $p^{th}$ row.

The second data driver may include: an auxiliary data calculation unit configured to calculate digital video data corresponding to a coordinate value of a repaired pixel, from among the display pixels, as auxiliary data, a memory configured to store the auxiliary data and configured to update the stored auxiliary data with initialization data at each predetermined period, and an auxiliary data voltage conversion unit configured to: receive the auxiliary data or the initialization data from the memory, convert the auxiliary data or the initialization data into auxiliary data voltages, and output the auxiliary data voltages.

The auxiliary pixel driver of an auxiliary pixel from among the auxiliary pixels may include: a first transistor configured to control the driving current of the auxiliary pixel driver in response to a voltage of a control electrode thereof, a second transistor connected to one of the auxiliary data lines and a first electrode of the first transistor, a third transistor connected to the control electrode of the first transistor and a second electrode of the first transistor, a fourth transistor connected to the control electrode of the first transistor and a second power voltage line connected to a second power voltage supply, a fifth transistor connected to the first electrode of the first transistor and a third power voltage line connected to a third power voltage supply, a sixth transistor connected to the second electrode of the first transistor and the corresponding one of the auxiliary lines, a seventh transistor connected to the corresponding one of the auxiliary lines and the third power voltage line, and a storage capacitor connected to the control electrode of the first transistor and to the third power voltage line, wherein control electrodes of the second and third transistors are connected to the $k^{th}$ scan line, control electrodes of the fourth and seventh transistors are connected to the $k-1^{th}$ scan line, and control electrodes of the fifth and sixth transistors are connected to the $k^{th}$ light emission control line.

The corresponding one of the auxiliary lines may be connected to an auxiliary pixel in a $p+\beta^{th}$ row from among the auxiliary pixels and cross display pixels in a $p^{th}$ row from among the display pixels, wherein p and β are positive integers.

The corresponding one of the auxiliary lines may be connected to a display pixel from among the display pixels in the $p^{th}$ row.

The display pixels in the $p^{th}$ row may be connected to a $k-1^{th}$ scan line from among the scan lines, a $k^{th}$ scan line from among the scan lines, and a $k^{th}$ light emission control line from among the light emission control lines, where k is a positive integer of 2 or more, and the auxiliary pixel in the $p+\beta^{th}$ row may be connected to a $k+\beta-1^{th}$ scan line from among the scan lines, a $k+\beta^{th}$ scan line from among the scan lines, and a $k+\beta^{th}$ light emission control line from among the light emission control lines.

A control electrode of the auxiliary transistor may be connected to a $k+\beta^{th}$ scan line from among the scan lines.

The organic light emitting display device may further include: a scan driver configured to supply scan signals to the scan lines, a light emission driver configured to supply light emission control signals to the light emission control lines, a first data driver configured to supply data voltages to the data lines, and a second data driver configured to supply auxiliary data voltages to the auxiliary data lines, wherein the second data driver is configured to supply the auxiliary data voltages to the auxiliary pixel in a $k^{th}$ row from among the auxiliary pixels in synchronization with the data voltages supplied to display pixels in a $k+\beta^{th}$ row from among the display pixels.

The second data driver may include: an auxiliary data calculation unit configured to calculate digital video data corresponding to a coordinate value of a repaired pixel, from among the display pixels, as auxiliary data, a memory configured to store the auxiliary data and configured to update the stored auxiliary data with initialization data at each predetermined period, and an auxiliary data voltage conversion unit configured to: receive the auxiliary data or the initialization data from the memory, convert the auxiliary data or the initialization data into an auxiliary data voltage, and output the auxiliary data voltage by delaying the auxiliary data voltage by β times a horizontal period.

The auxiliary pixel driver may include: a first transistor configured to control the driving current of the auxiliary pixel driver in response to a voltage of a control electrode thereof, a second transistor connected to one of the auxiliary data lines and to a first electrode of the first transistor, a third transistor connected to the control electrode of the first transistor and to a second electrode of the first transistor, a fourth transistor connected to the control electrode of the first transistor and to a second power voltage line connected to a second power voltage supply, a fifth transistor connected to the first electrode of the first transistor and a third power voltage line connected to a third power voltage supply, a sixth transistor connected to the second electrode of the first transistor and to the corresponding one of the auxiliary lines, a seventh transistor connected to the corresponding one of the auxiliary lines and the second power voltage line, and a storage capacitor connected to the control electrode of the first transistor and to the third power voltage line, wherein control electrodes of the second and third transistors are connected to the $k+\beta^{th}$ scan line from among the scan lines, control electrodes of the fourth and seventh transistors are connected to the $k+\beta-1^{th}$ scan line from among the scan lines, and control electrodes of the fifth and sixth transistors are connected to the $k+\beta^{th}$ light emission control line from among the light emission control lines.

The auxiliary pixel driver may include: a first transistor configured to control the driving current of the auxiliary pixel driver in response to a voltage of a control electrode thereof, a second transistor connected to one of the auxiliary data lines and to a first electrode of the first transistor, a third transistor connected to the control electrode of the first transistor and to a second electrode of the first transistor, a fourth transistor connected to the control electrode of the first transistor and to the first power voltage line, a fifth transistor connected to the first electrode of the first transistor and to a third power voltage line connected to a third power voltage supply, a sixth transistor connected to the second electrode of the first transistor and to the corresponding one of the auxiliary lines, and a storage capacitor connected to the control electrode of the first transistor and to the third power voltage line, wherein control electrodes of the second and third transistors are connected to the $k+\beta^{th}$ scan line from among the scan lines, a control electrode of the fourth transistor is connected to the $k+\beta-1^{th}$ scan line from among the scan lines, and control electrodes of the fifth and sixth transistors are connected to the $k+\beta^{th}$ light emission control line from among the light emission control lines.

Each of the display pixels may include: an organic light emitting diode, and a display pixel driver including a plurality of transistors and configured to supply a display pixel driving current to the organic light emitting diode, wherein the display pixel driver may include: a first transistor controlling the display pixel driving current in response to a voltage of a control electrode thereof, a second transistor connected to one of the data lines and to a first electrode of the first transistor; a third transistor connected to the control electrode of the first transistor and to a second electrode of the first transistor, a fourth transistor connected to the control electrode of the first transistor and a second power voltage line connected to a second power voltage supply, a fifth transistor connected to the first electrode of the first transistor and to a third power voltage line connected to a third power voltage supply, a sixth transistor connected to the second electrode of the first transistor and to an anode electrode of the organic light emitting diode, a seventh transistor connected to the anode electrode of the organic light emitting diode and to the second power voltage line, and a storage capacitor connected to the control electrode of the first transistor and to the third power voltage line.

The organic light emitting display device may be configured to supply the first power voltage as a voltage with a triangle wave for one frame period.

BRIEF DESCRIPTION OF THE DRAWINGS

Example embodiments will now be described more fully hereinafter as illustrated in the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. It will be understood that when an element is referred to as being "on", "connected to", "coupled to", or "adjacent to" another element, it may be directly on, connected to, coupled to, or adjacent to the other element, or one or more intervening elements may be present. When an element is referred to as being "directly on", "directly connected to", "directly coupled to", or "immediately adjacent to" another element, there are no intervening elements present. Like reference numerals refer to like elements throughout.

DETAILED DESCRIPTION

Figure 1:
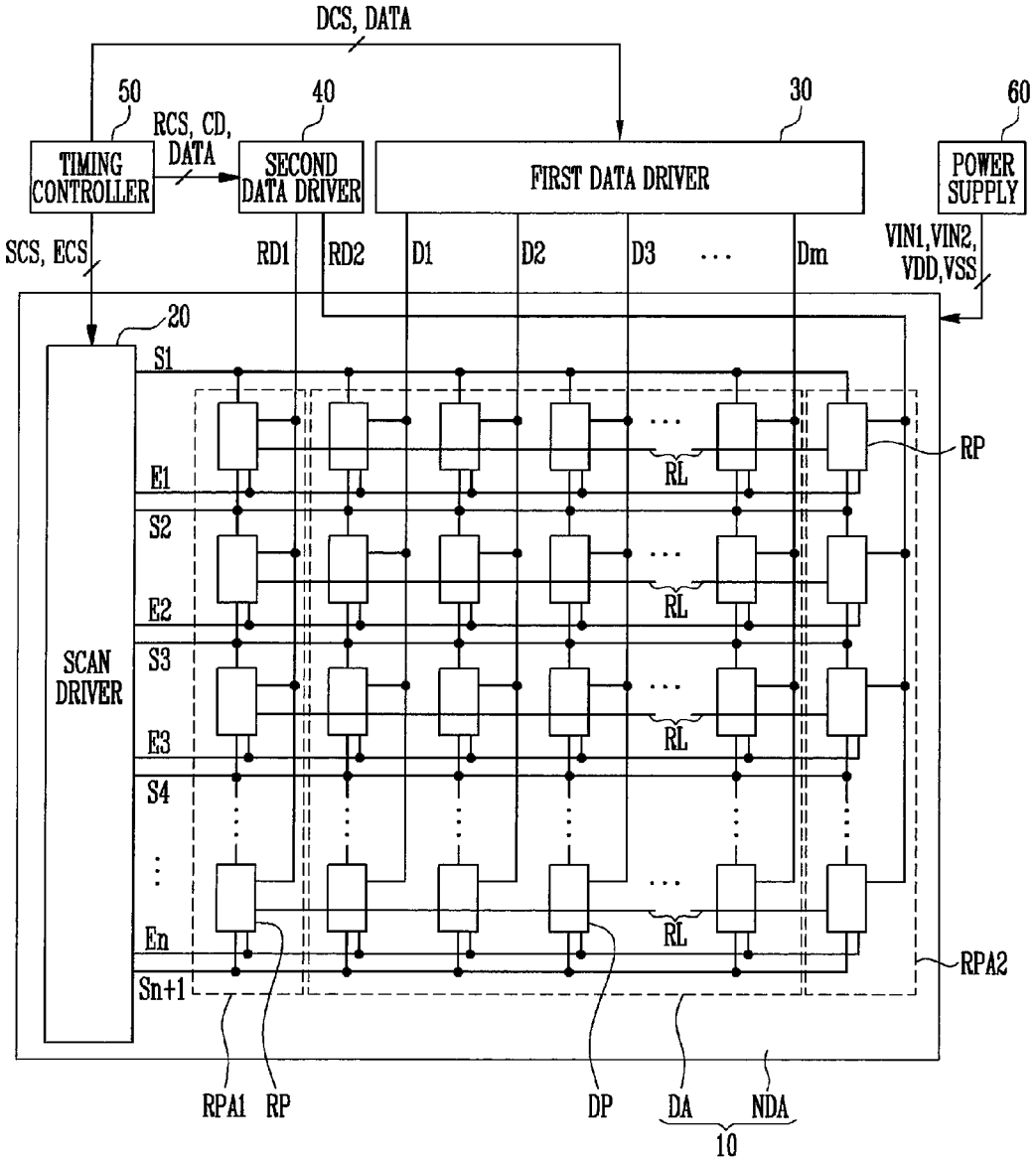
FIG. 1 is a diagram illustrating an organic light emitting display device according to an exemplary embodiment of the present invention.

Example embodiments will now be described more fully hereinafter with reference to the accompanying drawings. Like reference numerals refer to like elements throughout. In the following description, when the detailed description of the relevant known function or configuration is determined to unnecessarily obscure the important point of embodiments of the present invention, the detailed description is not provided. It is to be noted that names of constituent elements used in the following description are simply selected by considering the ease of writing this specification, but may be different from those of components of actual products. As used herein, the terms "use", "using", and "used" may be considered synonymous with the terms "utilize", "utilizing", and "utilized", respectively. Further, the use of "may" when describing embodiments of the inventive concept refers to "one or more embodiments of the present invention". Also, the term "exemplary" is intended to refer to an example or illustration.

FIG. 1 is a block diagram illustrating an organic light emitting display device according to an exemplary embodiment of the present invention. Referring to FIG. 1, an organic light emitting display device according to an exemplary embodiment of the present invention includes a display panel 10, a scan driver 20, a first data driver 30, a second data driver 40, a timing controller 50 and a power supply 60.

Figure 2:
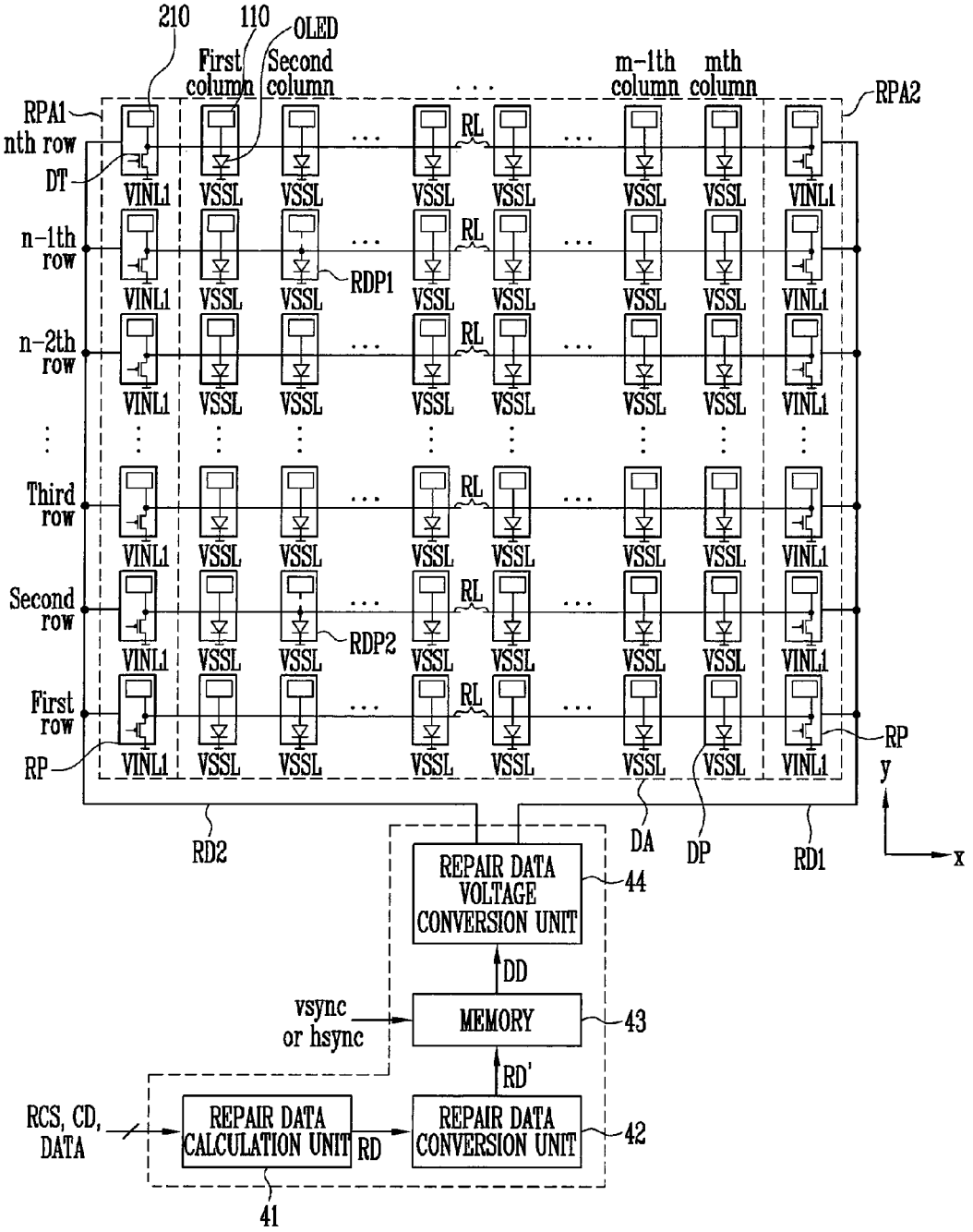
FIG. 2 is a detailed block diagram illustrating display pixels, auxiliary pixels, auxiliary lines, auxiliary data lines, and a second data driver according to an exemplary embodiment of the present invention.

Data lines D1 to Dm, where m is a positive integer of 2 or more, auxiliary data lines RD1 and RD2, scan lines S1 to Sn+1, where n is a positive integer of 2 or more, and light emission control lines E1 to En are formed in the display panel 10. The data lines D1 to Dm and the auxiliary data lines RD1 and RD2 may be formed in parallel with each other. The auxiliary data lines RD1 and RD2 may be formed at both sides outside of the data lines D1 to Dm. For example, as shown in FIG. 2, the first auxiliary data line RD1 may be formed at one side outside of the data lines D1 to Dm, and the second auxiliary data line RD2 may be formed at the other side outside of the data lines D1 to Dm. The data lines D1 to Dm and the scan lines S1 to Sn+1 may cross each other. The auxiliary data lines RD1 and RD2 and the scan lines S1 to Sn+1 may cross each other. The scan lines S1 to Sn+1 and the light emission control lines E1 to En may be formed in parallel with one another.

The display panel 10 includes a display area DA and a non-display area NDA. Display pixels DP for displaying an image are formed in the display area DA. The non-display area NDA refers to the entire area of the display panel 10, except the display area DA. The non-display area NDA may include first and second auxiliary pixel regions RPA1 and RPA2 in which auxiliary pixels RP are formed to repair the display pixels DP. The auxiliary pixels RP which are connected to a first auxiliary data line RD1 may be formed in the first auxiliary pixel area RPA1. The auxiliary pixels RP which are connected to a second auxiliary data line RD2 may be formed in the second auxiliary pixel area RPA2.

In the display area DA, the display pixels DP may be arranged in a matrix format at crossing regions between the data lines D1 to Dm and the scan lines S1 to Sn+1. Each of the display pixels DP may be connected to one of the data lines, two of the scan lines, and one of the light emission control lines.

The auxiliary pixels RP may be arranged at crossing regions between the auxiliary data lines RD1 and RD2 and the scan lines S1 to Sn+1 in the auxiliary pixel regions RPA1 and RPA2, respectively. The auxiliary pixels RP are formed to repair the display pixels DP in which defects occur during the manufacturing process of the display panel 10. Each of the auxiliary pixels RP may be connected to one of the auxiliary data lines, two of the scan lines, one of the light emission control lines, and one of the auxiliary lines RL. The auxiliary line RL is connected to the auxiliary pixel RP and extends from the auxiliary pixel RP to the display area DA to cross the display pixels DP.

When a defect occurs in the display pixel DP, the display pixel DP is connected to the auxiliary line RL through a laser short-circuit process. Therefore, the auxiliary pixel RP is connected to the display pixel DP, in which the defect occurs, through the auxiliary line RL, so that the display pixel DP may be repaired by using the auxiliary pixel RP. Hereinafter, for convenience of description, the display pixel DP which is repaired for defects is referred to as a repaired pixel.

The display pixels DP and the auxiliary pixels RP of the display panel 10 according to an exemplary embodiment of the present invention are described below in connection with FIG. 2.

In addition, a plurality of power voltage lines may be formed in the display panel 10 to supply a plurality of power voltages to the display pixels DP and the auxiliary pixels RP. In FIG. 1, the plurality of power voltage lines are not illustrated for convenience of explanation.

The scan driver 20 may include a scan signal output unit and a light emission control signal output unit. The scan signal output unit outputs scan signals to the scan lines S1 to Sn+1. The light emission control signal output unit outputs light emission control signals to the light emission control lines E1 to En. The scan signal output unit receives a scan timing control signal SCS from the timing controller 50 and outputs the scan signals to the scan lines S1 to Sn+1 in response to the scan timing control signal SCS. The light emission control signal output unit receives a light emission timing control signal ECS from the timing controller 50 and outputs the light emission control signals to the light emission control lines E1 to En in response to the light emission timing control signal ECS.

The scan signal output unit and the light emission control signal output unit may be formed in the non-display area NDA of the display panel 10 by an amorphous silicon gate in a pixel (ASG) scheme or in a (GIP) scheme. Each of the scan signal output unit and the light emission control signal output unit may include scan stages connected in cascade. The scan stages may sequentially output the scan signals to the scan lines S1 to Sn+1, and light emission stages may sequentially output the light emission control signals to the light emission control lines E1 to En. The light emission stages are described below in detail with reference to FIG. 6.

The first data driver 30 may include at least one source drive IC. The source drive IC receives digital video data DATA and the source timing control signal DCS from the timing controller 50. The source drive IC converts the digital video data DATA into data voltages in response to the source timing control signal DCS. The source drive IC is synchronized with the scan signals and supplies the data voltages to the data lines D1 to Dm. Therefore, the data voltages are supplied to the display pixels DP to which the scan signal is supplied.

The second data driver 40 receives a repair control signal RCS, the digital video data DATA, and coordinate data CD of the repaired pixel from the timing controller 50. The second data driver 40 generates auxiliary data voltages by using the repair control signal RCS, the digital video data DATA, and the coordinate data CD of the repaired pixel. The second data driver 40 is synchronized with the scan signals and supplies the auxiliary data voltages to the auxiliary data lines RD1 and RD2. Therefore, the auxiliary data voltages are supplied to the auxiliary pixels RP to which the scan signal is supplied.

In order to repair the defective pixel to form a repaired pixel, the second data driver 40 supplies the same auxiliary data voltage as the data voltage, which is to be supplied to the repaired pixel, to the auxiliary pixel connected to the repaired pixel. The second data driver 40 which supplies the auxiliary data voltage is described below in connection with FIGS. 2, 3, 4A and 4B.

The timing controller 50 receives the digital video data DATA and timing signals (not shown) from an external device. The timing controller 50 generates timing control signals to control the scan driver 20 and the first data driver 30 on the basis of the timing signals (not shown). The timing control signals include the scan timing control signal SCS to control the operation and timing of the scan signal output unit of the scan driver 20, the light emission timing control signal ECS to control the operation and timing of the light emission control signal output unit of the scan driver 20, and the data timing control signal DCS to control the operation and timing of the first data driver 30. The timing controller 50 outputs the scan timing control signal SCS and the light emission timing control signal ECS to the scan driver 20, and outputs the data timing control signal DCS and the digital video data DATA to the first data driver 30.

In addition, the timing controller 50 generates the repair control signal RCS and the coordinate data CD of the repaired pixel. The repair control signal RCS indicates whether or not a repaired pixel exists. For example, the repair control signal RCS may be generated as a first logic level voltage when the repaired pixel exists, and otherwise, the repair control signal RCS may be generated as a second logic level voltage. The coordinate data CD of the repaired pixel refers to a coordinate value of the repaired pixel. The coordinate data CD of the repaired pixel may be stored in a memory of the timing controller 50. The timing controller 50 outputs the repair control signal RCS, the coordinate data CD of the repaired pixel, and the digital video data DATA to the second data driver 40.

The power supply 60 may supply a plurality of power voltages to the plurality of power voltage lines. As illustrated in FIG. 1, the power supply 60 may supply first, second, third and fourth power voltages VIN1, VIN2, VDD and VSS to first to fourth power voltage lines (not shown), respectively. In FIG. 1, for convenience of explanation, the first to fourth power voltage lines are not illustrated. However, the first to fourth power voltage lines are described below in detail with reference to FIGS. 2 and 5. In addition, the power supply 60 may provide a gate-off voltage to a gate-off voltage line and a gate-on voltage to a gate-on voltage line. The gate-off voltage and the gate-on voltage are described below in detail with reference to FIG. 7.

FIG. 2 is a detailed block diagram illustrating display pixels, auxiliary pixels, auxiliary lines, auxiliary data lines, and a second data driver according to an exemplary embodiment of the present invention. In FIG. 2, for convenience of explanation, the display pixels DP, the auxiliary pixels RP, the auxiliary lines RL, the auxiliary data lines RD1 and RD2, and the second data driver 40 of the display panel 10 are illustrated.

Referring to FIG. 2, each of the display pixels DP includes a display pixel driver 110 and an organic light emitting diode OLED. The organic light emitting diode OLED emits light with predetermined brightness according to a driving current of the display pixel driver 110. An anode electrode of the organic light emitting diode OLED may be connected to the display pixel driver 110, and a cathode electrode thereof may be coupled to the fourth power voltage line VSSL to which the fourth power voltage is provided. The fourth power voltage may be a low-potential power voltage. As with other power voltages and power voltage lines described herein, the fourth power voltage may be provided to the fourth power voltage line as a result of the fourth power voltage line being connected to a corresponding power voltage supply, e.g., a fourth power voltage supply. The display pixel driver 110 is described below in detail with reference to FIG. 5.

Each of the auxiliary pixels RP includes an auxiliary pixel driver 210 and an A transistor (or auxiliary transistor) DT. The auxiliary pixel driver 210 and the A transistor DT are connected to the auxiliary line RL. The auxiliary pixel driver 210 supplies a driving current to the auxiliary line RL. The A transistor DT discharges the auxiliary line RL to the first power voltage. The A transistor DT may be connected to the auxiliary line RL and a first power voltage line VINL1 to which the first power voltage is supplied. A control electrode of the A transistor DT may be connected to various signal lines, which is described below with reference to FIGS. 5, 8, 10, 13 and 15.

The auxiliary line RL is connected to the auxiliary pixel RP and extends from the auxiliary pixel RP to the display area DA to cross the display pixels DP. For example, as illustrated in FIG. 2, the auxiliary line RL may be connected to the auxiliary pixel RP in a $p^{th}$ row (where p is a positive integer satisfying $1 \leq p \leq n$) and cross the display pixels DP in the $p^{th}$ row. In addition, as illustrated in FIG. 2, the auxiliary line RL may cross anode electrodes of the organic light emitting diodes OLED of the display pixels DP.

The auxiliary line RL may be connected to one of the display pixels DP in the display area DA. The display pixel DP connected to the auxiliary line RL corresponds to a defective pixel to be repaired. In FIG. 2, the display pixel DP connected to the auxiliary line RL is defined as a repaired pixel RDP1/RDP2. More specifically, the auxiliary line RL may be connected to an anode electrode of the organic light emitting diode OLED of the repaired pixel RDP1/RDP2. The display pixel driver 110 and the organic light emitting diode OLED of the repaired pixel RDP1/RDP2 are disconnected from each other.

The auxiliary pixels RP in a first auxiliary pixel area RP are connected to the first auxiliary data line RD1. The auxiliary pixels RP in a second auxiliary pixel area RP2 are connected to the second auxiliary data line RD2. The display pixels DP in the display area DA are connected to the data lines D1 to Dm. However, in FIG. 2, for convenience of explanation, the data lines D1 to Dm are not illustrated.

The second data driver 40 includes an auxiliary data output unit (or repair data calculation unit) 41, an auxiliary data conversion unit (or repair data conversion unit) 42, a memory 43 and an auxiliary data voltage conversion unit (or repair data voltage conversion unit) 44. A driving method of the second data driver 40 is described with reference to FIGS. 2 and 3.

Figure 3:
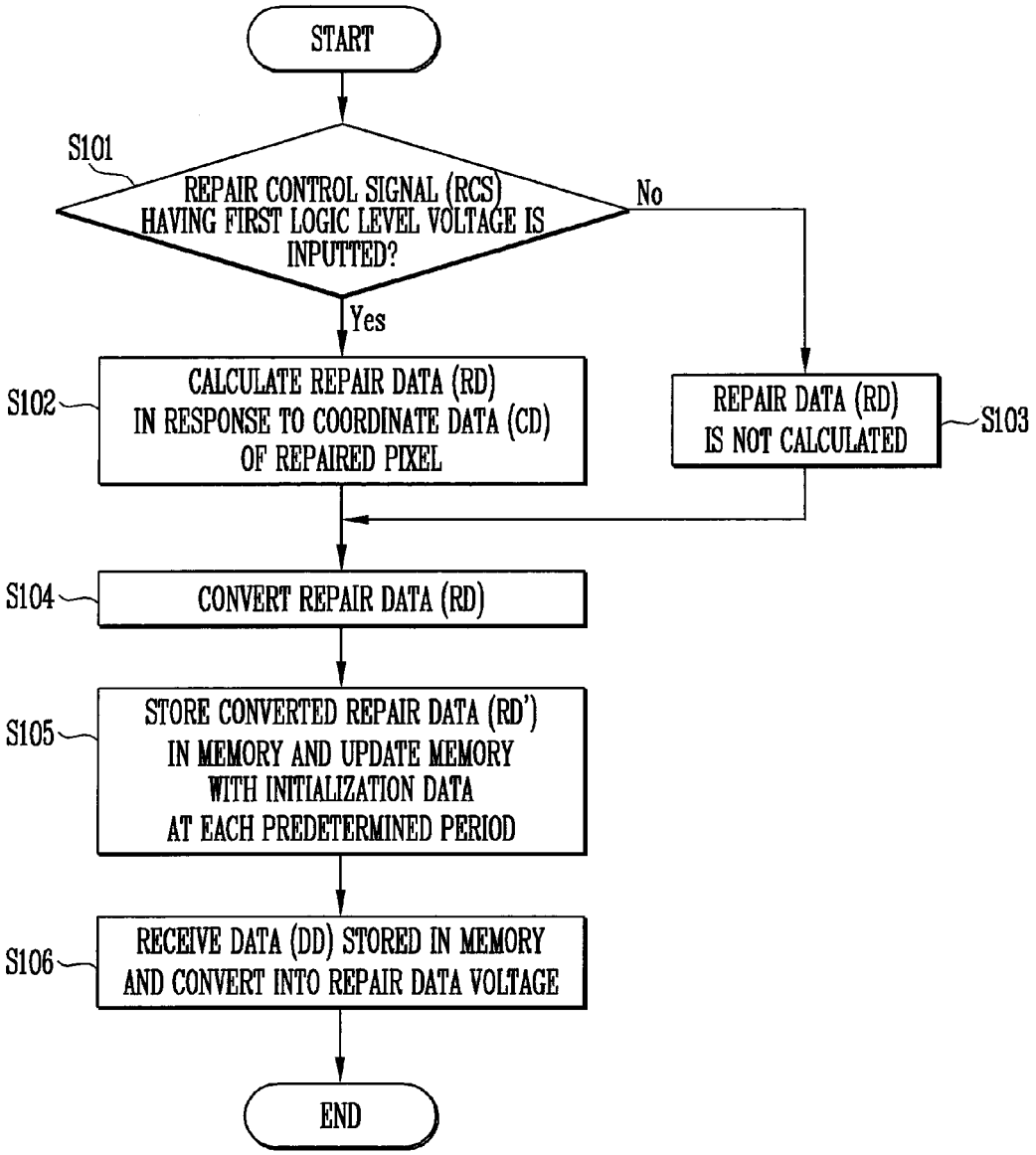
FIG. 3 is a flowchart illustrating a driving method of the second data driver of FIG. 2.

FIG. 3 is a flowchart illustrating the driving method of the second data driver of FIG. 2. Referring to FIG. 3, the driving method of the second data driver includes steps S101 to S106.

First, the auxiliary data output unit 41 receives the repair control signal RCS, the digital video data DATA, and the coordinate data CD of the repaired pixel RDP1/RDP2 from the timing controller 50. The auxiliary data output unit 41 calculates auxiliary data RD when the repair control signal RCS having the first logic level voltage is input and does not calculate the auxiliary data RD when the repair control signal RCS having the second logic level voltage is input. In other words, the auxiliary data output unit 41 calculates the auxiliary data RD from the digital video data DATA in response to the coordinate data CD of the repaired pixel when the repair control signal RCS having the first logic level voltage is input.

The auxiliary data output unit 41 may calculate the digital video data corresponding to the coordinate value of the repaired pixel RDP1/RDP2 as the auxiliary data RD. For example, when the first repaired pixel RDP1 is in the second row and second column as illustrated in FIG. 2, the first repaired pixel RDP1 may have a coordinate value of (2,2). However, in FIG. 2, only rows and columns of the display area DA are illustrated. In addition, when n display pixels DP are arranged in a column direction (y-axis direction), the second repaired pixel RDP2 is located in an $n-1^{th}$ row and the second column. Therefore, the second repaired pixel RDP2 has a coordinate value of (n−1,2).

The auxiliary data output unit 41 may calculate the digital video data corresponding to the coordinate value (2,2) as the auxiliary data RD to be supplied to the auxiliary pixel RP connected to the first repaired pixel RDP1, and calculate the digital video data corresponding to the coordinate value (n−1,2) as the auxiliary data RD provided to the auxiliary pixel RP connected to the second repaired pixel RDP2. The auxiliary data output unit 41 outputs the auxiliary data RD to the auxiliary data conversion unit 42. (Steps S101, S102, and S103)

Second, the auxiliary data conversion unit 42 receives the auxiliary data RD from the auxiliary data output unit 41. The repaired pixel RDP1/RDP2 receives the auxiliary data voltage from the auxiliary pixel RP through the auxiliary line RL. Therefore, the auxiliary data conversion unit 42 may convert the auxiliary data RD by adding predetermined data to the auxiliary data RD in consideration of wiring resistance of the auxiliary line RL and parasitic capacitance of the auxiliary line RL. The auxiliary data conversion unit 42 outputs converted auxiliary data RD' to the memory 43.

The auxiliary data conversion unit 42 may be removed. In this example, the auxiliary data output unit 41 outputs the auxiliary data RD to the memory 43. (Step S104)

Third, the memory 43 receives and stores the converted auxiliary data RD' from the auxiliary data conversion unit 42. The memory 43 receives and stores the auxiliary data RD from the auxiliary data output unit 41 when the auxiliary data conversion unit 42 is removed.

The memory 43 may be set to be updated with initialization data at each predetermined period. More specifically, the memory 43 may receive a signal indicating a predetermined period from the timing controller 50. The signal indicating the predetermined period may be a vertical synchronization signal vsync in which a pulse is generated for every one frame period, or a horizontal synchronization signal hsync in which a pulse is generated for every one horizontal period. The one frame period refers to a period for which the data voltages are supplied to all display pixels DP. The horizontal period refers to a period for which the data voltages are supplied to the display pixels DP in one of the rows. When the signal indicating the predetermined time is the vertical synchronization signal vsync, the memory 43 may be updated with the initialization data at each one frame period. When the signal indicating the predetermined period is the horizontal synchronization signal hsync, the memory 43 may be updated with the initialization data at each one horizontal period. The memory 43 may be embodied as a register. The memory 43 outputs data DD to the auxiliary data voltage conversion unit 44. (Step S105)

Fourth, the auxiliary data voltage conversion unit 44 receives the data DD stored in the memory 43 and converts the data DD into the auxiliary data voltages. The auxiliary data voltage conversion unit 44 is synchronized with the scan signals and supplies the auxiliary data voltages to the auxiliary data lines RD1 and RD2. Therefore, the auxiliary data voltages supplied to the auxiliary data lines RD1 and RD2 are supplied in synchronization with the data voltages supplied to the data lines D1 to Dm. In other words, the auxiliary data voltage supplied to the auxiliary pixel RP in the $p^{th}$ row is supplied in synchronization with the data voltages supplied to the display pixels DP in the $p^{th}$ row. (Step S106)

As described above, according to an exemplary embodiment of the present invention, the digital video data DATA corresponding to the coordinate value of the repaired pixel RDP1/RDP2 is calculated as the auxiliary data RD. As a result, according to an exemplary embodiment of the present invention, the same auxiliary data voltage as the data voltage to be supplied to the repaired pixel RDP1/RDP2 may be supplied to the auxiliary pixel RP connected to the repaired pixel RDP1/RDP2.

Figure 4A:
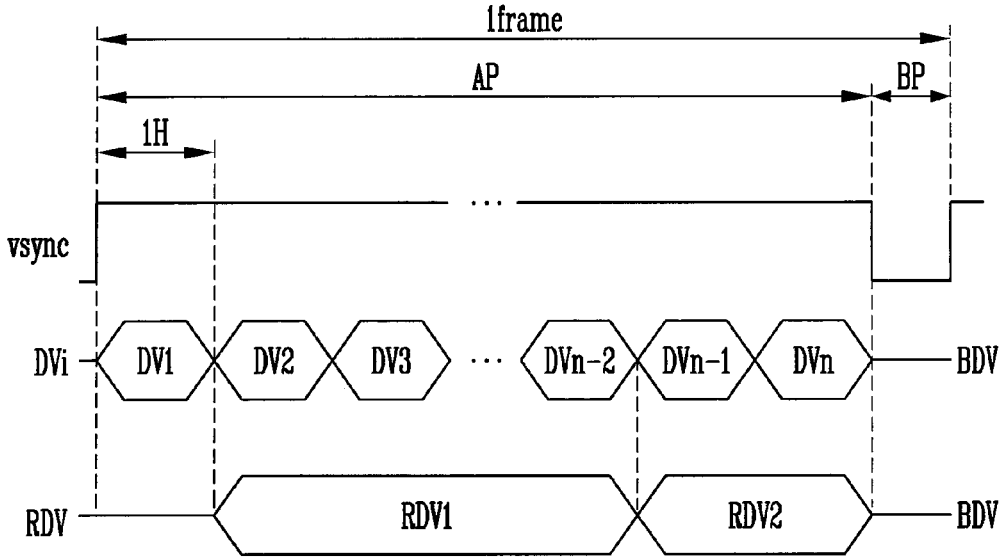
FIGS. 4A and 4B are diagrams illustrating data voltages output from a first data driver of FIG. 2 and auxiliary data voltages output from an auxiliary data voltage conversion unit of a second data driver of FIG. 2.

FIG. 4A is an exemplary diagram illustrating data voltages output from the first data driver of FIG. 2 and auxiliary data voltages output from the auxiliary data voltage conversion unit of the second data driver. FIG. 4A illustrates the vertical synchronization signal vsync, data voltages DVi supplied to an $i^{th}$ data line Di (where i is a positive integer satisfying $1 \le i \le m$), and auxiliary data voltages RDV output from the auxiliary data voltage conversion unit 44.

Referring to FIG. 4A, one frame period (1 frame) includes an active period AP and a blank period BR The data voltages are supplied to the display pixels DP for the active period AP. The blank period BP is a pause period. The vertical synchronization signal vsync generates a pulse at each frame period. The data voltages DVi output to the $i^{th}$ data line Di may include first to $n^{th}$ data voltages DV1 to DVn. As illustrated in FIG. 2, the auxiliary data voltage supplied to the auxiliary pixel RP may be supplied in synchronization with the data voltages supplied to the display pixels DP in the $p^{th}$ row.

As illustrated in FIG. 2, the first repaired pixel RDP1 may be in the second row, and the second repaired pixel RDP2 may be in the $n-1^{th}$ row. As illustrated in FIG. 4A, according to data in the memory 43, a first auxiliary data voltage RDV1 may be supplied to the auxiliary data line RD1/RD2 in synchronization with a period for which a data voltage DV2 is supplied to the $i^{th}$ data line Di connected to the display pixel in the second row. In addition, as illustrated in FIG. 4A, according to data in the memory 43, a second auxiliary data voltage RDV2 may be supplied to the auxiliary data line RD1/RD2 in synchronization with a period for which a data voltage DVn−1 is supplied to the $i^{th}$ data line Di connected to the display pixel in the $n-1^{th}$ row.

When the signal indicating the predetermined period is the vertical synchronization signal vsync, the memory 43 is updated with the initialization data BD at each one frame period. Therefore, as illustrated in FIG. 4A, the auxiliary data voltage conversion unit 44 may receive the first auxiliary data RD1 from the memory 43 for a period from when the data voltage DV2 is supplied to the display pixel in the second row to when the data voltage DVn−2 is supplied to the display pixel in the $n-2^{th}$ row. Subsequently, the auxiliary data voltage conversion unit 44 may convert the input first auxiliary data RD1 into the first auxiliary data voltage RDV1 and output the first auxiliary data voltage RDV1 to the auxiliary data line RD1/RD2.

In addition, as shown in FIG. 4A, the auxiliary data voltage conversion unit 44 may receive the second auxiliary data RD2 from the memory 43 for a period from when the data voltage DVn−1 is supplied to the display pixel in the $n-1^{th}$ row to when the data voltage DVn is supplied to the display pixel in the $n^{th}$ row, convert the second auxiliary data RD2 into the second auxiliary data voltage RDV2, and output the second auxiliary data voltage RDV2 to the auxiliary data line RD1/RD2. Further, as illustrated in FIG. 4A, the auxiliary data voltage conversion unit 44 may receive the initialization data BD from the memory 43 for a period when the data voltage DV1 is supplied to the display pixel in the first row, convert the input initialization data BD into an initialization data voltage BDV, and output the initialization data voltage BDV to the auxiliary data line RD1/RD2.

As a result, as described above in connection with FIG. 4A, each of the auxiliary data voltages supplied to the auxiliary data lines RD1 and RD2 may be supplied in synchronization with the data voltages supplied to the data lines D1 to Dm.

Figure 4B:
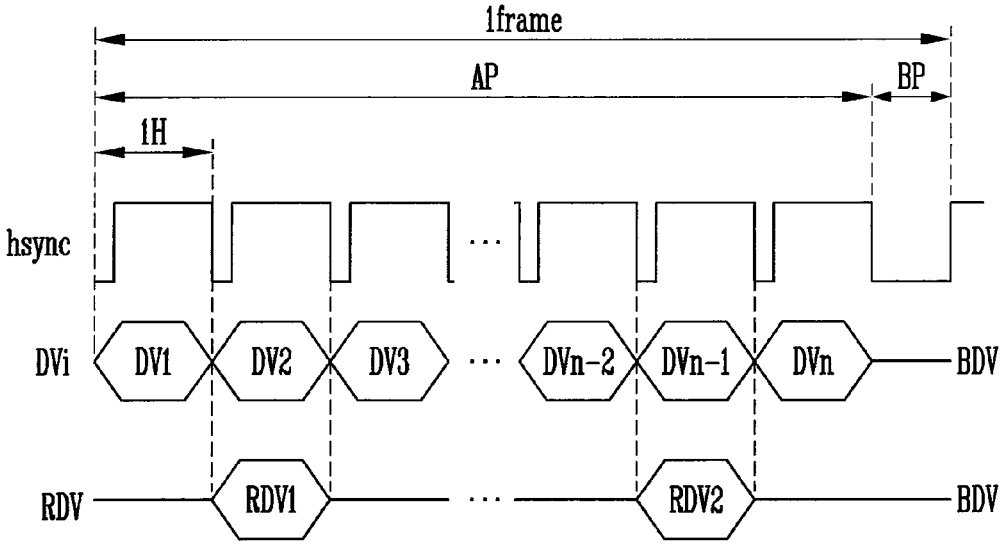

FIG. 4B is an exemplary diagram illustrating data voltages output from the first data driver of FIG. 2 and auxiliary data voltages output from the auxiliary data voltage conversion unit of the second data driver. FIG. 4B illustrates the horizontal synchronization signal hsync, the data voltages DVi output to the $i^{th}$ data line Di, and the auxiliary data voltages RDV output from the auxiliary data voltage conversion unit 44.

Referring to FIG. 4B, the one frame period (1 frame) includes the active period AP for which the data voltages are supplied and the blank period BP which is a pause period. The horizontal synchronization signal hsync generates a pulse at each one horizontal period 1H. The data voltages DVi output to the $i^{th}$ data line Di may include first to $n^{th}$ data voltages DV1 to DVn. As illustrated in FIG. 2, the auxiliary data voltage supplied to the auxiliary pixel RP in the $p^{th}$ row may be supplied in synchronization with the data voltages supplied to the display pixels DP in the $p^{th}$ row.

As illustrated in FIG. 2, the first repaired pixel RDP1 may be in the second row, and the second repaired pixel RDP2 may be in the $n-1^{th}$ row. In this example, as illustrated in FIG. 4B, according to data in the memory 43, the first auxiliary data voltage RDV1 may be supplied to the auxiliary data line RD1/RD2 in synchronization with a period for which the data voltage DV2 is supplied to the $i^{th}$ data line Di connected to the display pixel in the second row. In addition, as illustrated in FIG. 4B, according to data in the memory 43, the second auxiliary data voltage RDV2 may be supplied to the auxiliary data line RD1/RD2 in synchronization with a period for which the data voltage DVn−1 is supplied to the $i^{th}$ data line Di connected to the display pixel in the $n-1^{th}$ row.

When the signal indicating the predetermined period is the horizontal synchronization signal hsync, the memory 43 is updated with the initialization data BD at each one horizontal period 1H. Therefore, as illustrated in FIG. 4B, the auxiliary data voltage conversion unit 44 may receive the first auxiliary data RD1 from the memory 43 for a period in which the data voltage DV2 is supplied to the display pixel in the second row, convert the input first auxiliary data RD1 into the first auxiliary data voltage RDV1, and output the first auxiliary data voltage RDV1 to the auxiliary data line RD1/RD2.

In addition, as illustrated in FIG. 4B, the auxiliary data voltage conversion unit 44 receives the second auxiliary data RD2 from the memory 43 for a period in which the data voltage DVn−1 is supplied to the display pixel in the $n-1^{th}$ row, converts the second auxiliary data RD2 into the second auxiliary data voltage RDV2, and outputs the second auxiliary data voltage RDV2 to the auxiliary data line RD1/RD2. Further, as illustrated in FIG. 4B, the auxiliary data voltage conversion unit 44 may receive the initialization data BD from the memory 43 for periods except the period for which the data voltage DV2 is supplied to the display pixel in the second row and the period for which the data voltage DVn−1 is supplied to the display pixel in the $n-1^{th}$ row, convert the input initialization data BD into the initialization data voltage BDV, and output the initialization data voltage BDV to the auxiliary data line RD1/RD2.

As a result, as illustrated in FIG. 4B, each of the auxiliary data voltages supplied to the auxiliary data lines RD1 and RD2 may be supplied in synchronization with the data voltages supplied to the data lines D1 to Dm.

In addition, as described in connection with FIG. 4B, the initialization data voltage BDV may be supplied to auxiliary pixels which are not connected to the repaired pixels RDP1 and RDP2. As a result, according to an exemplary embodiment of the present invention, the display pixels DP in the display area may be prevented (or protected) from being affected by voltage variations of the auxiliary lines connected to the auxiliary pixels which are not connected to the repaired pixels RDP1 and RDP2. In other words, the voltage of the auxiliary line RL may be prevented (or protected) from being changed by the driving current which may be supplied to the auxiliary line RL when the auxiliary data voltage is supplied to the auxiliary pixel RP.

Figure 5:
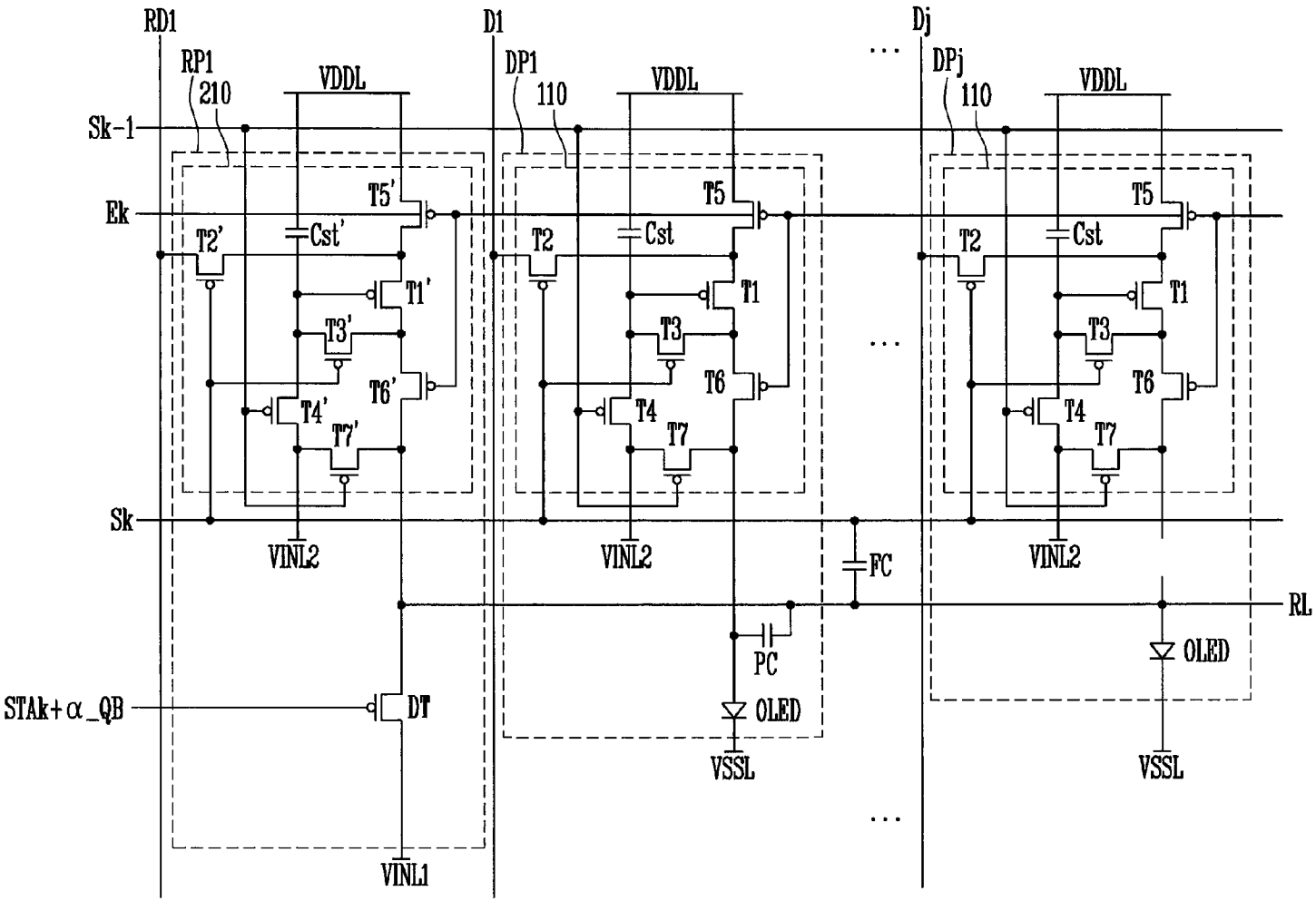
FIG. 5 is a detailed circuit diagram of display pixels and an auxiliary pixel according to an exemplary embodiment of the present invention.

FIG. 5 is a detailed circuit diagram illustrating display pixels and an auxiliary pixel according to an exemplary embodiment of the present invention. For convenience of explanation, FIG. 5 illustrates $k-1^{th}$ and $k^{th}$ scan lines Sk−1 and Sk (where k is a positive integer satisfying $2 \leq k \leq n$), the first auxiliary data line RD1, first and $j^{th}$ data lines D1 and Dj (where j is a positive integer satisfying $2 \leq j \leq m$), a $k^{th}$ light emission control line Ek, and a node control circuit pull-down control node signal STAk+α_QB associated with a $k+\alpha^{th}$ light emission control line Ek+α. In addition, for convenience of explanation, FIG. 5 illustrates a first auxiliary pixel RP1 connected to the first auxiliary data line RD1, a first display pixel DP1 connected to the first data line D1, and a $i^{th}$ display pixel DPj connected to the $j^{th}$ data line Dj. In FIG. 5, it is shown as an example that a defect does not occur in the first display pixel DP1 during the manufacturing process, and a defect occurs in the $j^{th}$ display pixel DPj during the manufacturing process and is repaired. The first auxiliary pixel RP1, the first display pixel DP1 and the $j^{th}$ display pixel DPj are described below in detail with reference to FIG. 5.

With reference to FIG. 5, the first auxiliary pixel RP1 is connected to the $j^{th}$ display pixel DPj through the auxiliary line RL. The auxiliary line RL may be connected to the first auxiliary pixel RP1 and extends from the first auxiliary pixel RP1 to the display area DA to cross the display pixels DP1 and DPj. More specifically, as illustrated in FIG. 5, the auxiliary line RL may cross anode electrodes of the organic light emitting diodes OLED of the display pixels DP1 and DPj.

The auxiliary line RL may be connected to the organic light emitting diode OLED of the $j^{th}$ display pixel DPj. In this example, the display pixel driver 110 and the organic light emitting diode OLED of the $j^{th}$ display pixel DPj may be disconnected from each other.

Each of the display pixels DP1 and DPj includes the organic light emitting diode OLED and the display pixel driver 110.

The display pixel driver 110 of each of the display pixels DP1 and DPj is connected to the organic light emitting diode OLED and supplies a driving current to the organic light emitting diode OLED. However, the display pixel driver 110 and the organic light emitting diode OLED of the $j^{th}$ display pixel DPj corresponding to the repaired pixel are disconnected from each other.

The display pixel driver 110 may be connected to a plurality of scan lines, a data line, a light emission control line, and a plurality of power lines. For example, the display pixel driver 110 may be connected to the $k-1^{th}$ and $k^{th}$ scan lines Sk−1 and Sk, the data line D1/Dj, a $k^{th}$ light emission control line Ek, and second and third power voltage lines VDDL and VINL2. A second power voltage is supplied to the second power voltage line VINL2, and a third power voltage is supplied to the third power voltage line VDDL. The second power voltage may be an initialization power voltage to initialize the display pixel driver 110, and the third power voltage may be a high potential power voltage. The second power voltage and the first power voltage are different from each other. For example, the first power voltage may be substantially the same as the fourth power voltage, or may be obtained by adding a predetermined voltage to the fourth power voltage. The second power voltage may be set to a predetermined DC of −3.5V.

The display pixel driver 110 may include a plurality of transistors. For example, the display pixel driver 110 may include first, second, third, fourth, fifth, sixth and seventh transistors T1, T2, T3, T4, T5, T6 and T7 and a storage capacitor Cst.

The first transistor T1 controls a driving current (drain-source current) Ids in response to a voltage of a control electrode thereof. The driving current Ids flowing through a channel of the first transistor T1 is in proportion to the square of a value obtained by subtracting a threshold voltage of the first transistor T1 from a difference between the control electrode and a first electrode of the first transistor T1 (gate-to-source voltage) according to the following Equation 1:

$$I_{ds}=k'\cdot(V_{gs}-V_{th})^2. \quad \text{Equation 1}$$

In Equation 1, k' is a proportional coefficient determined by the structure and physical properties of the first transistor T1, Vgs is the voltage between the control electrode and the first electrode of the first transistor T1, and Vth is the threshold voltage of the first transistor T1.

The second transistor T2 is connected to the first electrode of the first transistor T1 and the data line D1/Dj. The second transistor T2 is turned on by a scan signal of the $k^{th}$ scan line Sk to connect the first electrode of the first transistor T1 to the data line D1/Dj. As a result, a data voltage of the data line D1/Dj is supplied to the first electrode of the first transistor T1. A control electrode of the second transistor T2 is connected to the $k^{th}$ scan line Sk, a first electrode thereof is connected to the data line D1/Dj, and a second electrode thereof is connected to the first electrode of the first transistor T1. The control electrode may be a gate electrode, the first electrode may be a source electrode or a drain electrode, and the second electrode may be a different electrode from the first electrode. For example, when the first electrode is a source electrode, the second electrode may be a drain electrode.

The third transistor T3 is connected to the control electrode and the second electrode of the first transistor T1. The third transistor T3 is turned on by the scan signal of the $k^{th}$ scan line Sk to connect the control electrode and the second electrode of the first transistor T1. Since the control electrode and the second electrode of the first transistor T1 are connected, the first transistor T1 is driven as a diode. A control electrode of the third transistor T3 is connected to the $k^{th}$ scan line Sk, a first electrode thereof is connected to the second electrode of the first transistor T1, and a second electrode thereof is connected to the control electrode of the first transistor T1.

The fourth transistor T4 is connected to the control electrode of the first transistor T1 and the second power voltage line VINL2 to which the second power voltage is supplied. The fourth transistor T4 is turned on by a scan signal of a $k-1^{th}$ scan line Sk−1 to connect the control electrode of the first transistor T1 and the second power voltage line VINL2. As a result, the control electrode of the first transistor T1 may be initialized to the second power voltage. A control electrode of the fourth transistor T4 is connected to the $k-1^{th}$ scan line Sk−1, a first electrode thereof is connected to the control electrode of the first transistor T1, and a second electrode thereof is connected to the second power voltage line VINL2.

The fifth transistor T5 is connected to the third power voltage line VDDL and the first electrode of the first transistor T1. The fifth transistor T5 is turned on by a light emission control signal of the $k^{th}$ light emission control line Ek to connect the third power voltage line VDDL and the first electrode of the first transistor T1, so that the third power voltage is supplied to the first electrode of the first transistor T1. A control electrode of the fifth transistor T5 is connected to the $k^{th}$ light emission control line Ek, a first electrode thereof is connected to the third power voltage line VDDL, and a second electrode thereof is connected to the first electrode of the first transistor T1.

The sixth transistor T6 is connected to the second electrode of the first transistor T1 and the organic light emitting diode OLED. The sixth transistor T6 is turned on by the light emission control signal of the $k^{th}$ light emission control line Ek to connect the second electrode of the first transistor T1 and the organic light emitting diode OLED. A control electrode of the sixth transistor T6 is connected to the $k^{th}$ light emission control line Ek, a first electrode thereof is connected to the second electrode of the first transistor T1, and a second electrode thereof is connected to the organic light emitting diode OLED.

When the fifth and sixth transistors T5 and T6 are turned on, the driving current Ids of the display pixel driver 110 is supplied to the organic light emitting diode OLED, so that the organic light emitting diode OLED of the first display pixel DP1 emits light.

The seventh transistor T7 is connected to the anode electrode of the organic light emitting diode OLED and the second power voltage line VINL2. The seventh transistor T7 is turned on by the scan signal of the $k-1^{th}$ scan line Sk−1 to connect the anode electrode of the organic light emitting diode OLED and the second power voltage line VINL2, so that the anode electrode of the organic light emitting diode OLED is discharged to the second power voltage. A control electrode of the seventh transistor T7 is connected to the $k-1^{th}$ scan line Sk−1, a first electrode thereof is connected to the anode electrode of the organic light emitting diode OLED, and a second electrode thereof is connected to the second power voltage line VINL2.

The organic light emitting diode OLED emits light in response to the driving current Ids of the display pixel driver 110. The amount of light emitted from the organic light emitting diode OLED may be proportional to the driving current Ids. The anode electrode of the organic light emitting diode OLED is connected to the first electrode of the second transistor T2 and the second electrode of the seventh transistor T7, and a cathode electrode thereof is connected to the fourth power voltage line VSSL. The fourth power voltage is supplied to the fourth power voltage line VSSL.

The storage capacitor Cst is connected to the control electrode of the first transistor T1 and the third power voltage line VDDL and maintained at a voltage of the control electrode of the first transistor T1. One electrode of the storage capacitor Cst is connected to the control electrode of the first transistor T1, and the other electrode thereof is connected to the third power voltage line VDDL.

In FIG. 5, the description is made in reference to the example in which the first to seventh transistors T1 to T7 are composed of PMOS transistors. However, the present invention is not limited thereto. In other words, the first to seventh transistors T1 to T7 may be composed of NMOS transistors.

Each of the auxiliary pixels RP1 includes the auxiliary pixel driver 210 and the A transistor DT. Each of the auxiliary pixels RP1 does not include the organic light emitting diode OLED.

The auxiliary pixel driver 210 is connected to the auxiliary line RL. Therefore, a driving current of the auxiliary pixel driver 210 is supplied to the organic light emitting diode OLED of the $j^{th}$ display pixel DPj through the auxiliary line RL.

The auxiliary pixel driver 210 may be connected to a plurality of scan lines, an auxiliary data line, a plurality of light emission control lines, and a plurality of power lines. For example, the auxiliary pixel driver 210 may be connected to the $k-1^{th}$ and $k^{th}$ scan lines Sk−1 and Sk, the first auxiliary data line RD1, the $k^{th}$ and $k+\alpha^{th}$ light emission control lines Ek and Ek+α (where α is a positive integer satisfying $1 \leq \alpha \leq 30$), and the second and third power voltage lines VINL2 and VDDL. When α is smaller than zero, the auxiliary line RL is discharged before the voltage of the auxiliary line RL is changed due to parasitic capacitances PC and fringe capacitance FC. Thus, the effects of discharging the auxiliary line RL may not be obtained. When α is greater than thirty, a time difference occurs between when the voltage of the auxiliary line RL is changed by the parasitic capacitances PC and the fringe capacitance FC and when the auxiliary line RL is discharged. As a result, erroneous light emission of the repaired pixel RDP may be visible to a user.

The auxiliary pixel driver 210 may include a plurality of transistors. For example, the auxiliary pixel driver 210 may include first, second, third, fourth, fifth, sixth and seventh transistors T1', T2', T3', T4', T5', T6', and T7'.

The first, third, fourth and fifth transistors T1', T3', T4', and T5' and a storage capacitor Cst' of the auxiliary pixel driver 210 may be formed in substantially the same manner as the first, third, fourth and fifth transistors T1, T3, T4, and T5, and the storage capacitor Cst of the display pixel driver 110, respectively. Therefore, a detailed description of the first, third, fourth and fifth transistors T1', T3', T4', and T5', and the storage capacitor Cst' of the auxiliary pixel driver 210 is omitted.

The second transistor T2' is connected to a first electrode of the first transistor T1' and the first auxiliary data line RD1. The second transistor T2' is turned on by the scan signal of the $k^{th}$ scan line Sk to connect a first electrode of the first transistor T1' to the first auxiliary data line RD1, so that the auxiliary data voltage of the first auxiliary data line RD1 is supplied to the first electrode of the first transistor T1'. A control electrode of the second transistor T2' is connected to the $k^{th}$ scan line Sk, a first electrode thereof is connected to the first auxiliary data line RD1, and a second electrode thereof is connected to the first electrode of the first transistor T1'.

The sixth transistor T6' is connected to a second electrode of the first transistor T1' and the auxiliary line RL. The sixth transistor T6' is turned on by the light emission control signal of the $k^{th}$ light emission control line Ek to connect the second electrode of the first transistor T1' and the auxiliary line RL. A control electrode of the sixth transistor T6' is connected to the $k^{th}$ light emission control line Ek, a first electrode thereof is connected to the second electrode of the first transistor T1', and a second electrode thereof is connected to the auxiliary line RL. When the fourth and fifth transistors T4' and T5' are turned on, a driving current Ids' is supplied to the organic light emitting diode OLED of the $j^{th}$ display pixel DPj through the auxiliary line RL, so that the organic light emitting diode OLED of the $j^{th}$ display pixel DPj emits light.

The seventh transistor T7' is connected to the auxiliary line RL and the second power voltage line VINL2. The seventh transistor T7' is turned on by the scan signal of the $k-1^{th}$ scan line Sk−1 to connect the auxiliary line RL and the second power voltage line VINL2, so that the auxiliary line RL is discharged to the second power voltage. A control electrode of the seventh transistor T7' is connected to the $k-1^{th}$ scan line Sk−1, a first electrode thereof is connected to the auxiliary line RL, and a second electrode thereof is connected to the second power voltage line VINL2.

The A transistor DT is connected to the auxiliary line RL and the first power voltage line VINL1. The first power voltage is supplied to the first power voltage line VINL1. The first power voltage may be an initialization power voltage to initialize the auxiliary line RL. The first power voltage may be substantially the same as the fourth power voltage, or may be set to a voltage obtained by adding a predetermined voltage to the fourth power voltage. The first power voltage and the fourth power voltage are described below in detail with reference to FIG. 17.

More specifically, the A transistor DT is turned on by a voltage supplied to a control electrode of the A transistor DT to connect the auxiliary line RL and the first power voltage line VINL1, so that the voltage of the auxiliary line RL is discharged to the first power voltage. In other words, the A transistor DT functions to discharge the auxiliary line RL. The control electrode of the A transistor DT may be connected to a pull-down control node STAk+α_QB of a light emission stage connected to the $k+\alpha^{th}$ light emission control line, a first electrode thereof may be connected to the auxiliary line RL, and a second electrode thereof may be connected to the first power voltage line VINL1. The pull-down control node STAk+α_QB of the light emission stage connected to the $k+\alpha^{th}$ light emission control line is described below with reference to FIG. 6.

In FIG. 5, the description is made in reference to the example in which the first to seventh transistors T1' to T7' and the A transistor DT are composed of PMOS transistors. However, the present invention is not limited thereto. In other words, the first to seventh transistors T1' to T7' and the A transistor DT may be composed of NMOS transistors.

As described above, the display pixel driver 110 of each of the display pixels DP1, except the $j^{th}$ display pixel DPj corresponding to the repaired pixel, is connected to the organic light emitting diode OLED and supplies the driving current to the organic light emitting diode OLED. However, the display pixel driver 110 of the organic light emitting diode OLED of the $j^{th}$ display pixel DPj is not connected to the organic light emitting diode OLED. In other words, the display pixel driver 110 of the $j^{th}$ display pixel DPj is impaired due to a defect, the display pixel driver 110 and the organic light emitting diode OLED are disconnected from each other by a laser process, and the anode electrode of the organic light emitting diode OLED of the $j^{th}$ display pixel DPj is connected to the auxiliary line RL. Therefore, the anode electrode of the organic light emitting diode OLED of the $j^{th}$ display pixel DPj may be connected to the auxiliary pixel driver 210 of the first auxiliary pixel RP1 through the auxiliary line RL. Therefore, the organic light emitting diode OLED of the $j^{th}$ display pixel DPj receives the driving current from the auxiliary pixel driver 210 of the first auxiliary pixel RP1 and emits light. As a result, the $j^{th}$ display pixel DPj may be repaired.

FIG. 5 illustrates the first auxiliary pixel RP1 as an example of auxiliary pixels for convenience of explanation. Each of the auxiliary pixels may be formed in substantially the same manner as the first auxiliary pixel RP1. In addition, FIG. 5 illustrates the first display pixel DP1 as an example of display pixels in which a defect does not occur. Each of the display pixels in which a defect does not occur may be formed in substantially the same manner as the first display pixel DP1. In addition, FIG. 5 illustrates the $j^{th}$ display pixel DPj as an example of repaired pixels for convenience of explanation. Each of the repaired pixels may be formed in substantially the same manner as the $j^{th}$ display pixel DPj.

Since the auxiliary line RL and the anode electrodes of the organic light emitting diodes OLED of the display pixels overlap with each other, the parasitic capacitances PC may be formed between the auxiliary line RL and the anode electrodes of the organic light emitting diodes OLED of the display pixels. In addition, since the auxiliary line RL is formed next to the $k^{th}$ scan line Sk, the fringe capacitance FC may be formed between the auxiliary line RL and the $k^{th}$ scan line Sk. The voltage of the auxiliary line RL may be changed due to the parasitic capacitances PC and the fringe capacitance FC. Thus, the organic light emitting diode OLED of the $j^{th}$ display pixel DPj corresponding to the repaired pixel may emit light in error.

However, in order to prevent (or reduce) the above erroneous light emission, according to an exemplary embodiment of the present invention, the auxiliary line RL is discharged to the first power voltage by using the A transistor DT. As a result, according to an exemplary embodiment of the present invention, the voltage of the auxiliary line RL may be prevented (or protected) from being changed due to the parasitic capacitances PC and the fringe capacitance FC. Therefore, according to an exemplary embodiment of the present invention, the organic light emitting diode OLED may be prevented (or protected) from emitting light in error. This will be described below in detail with reference to FIG. 7.

Figure 6:
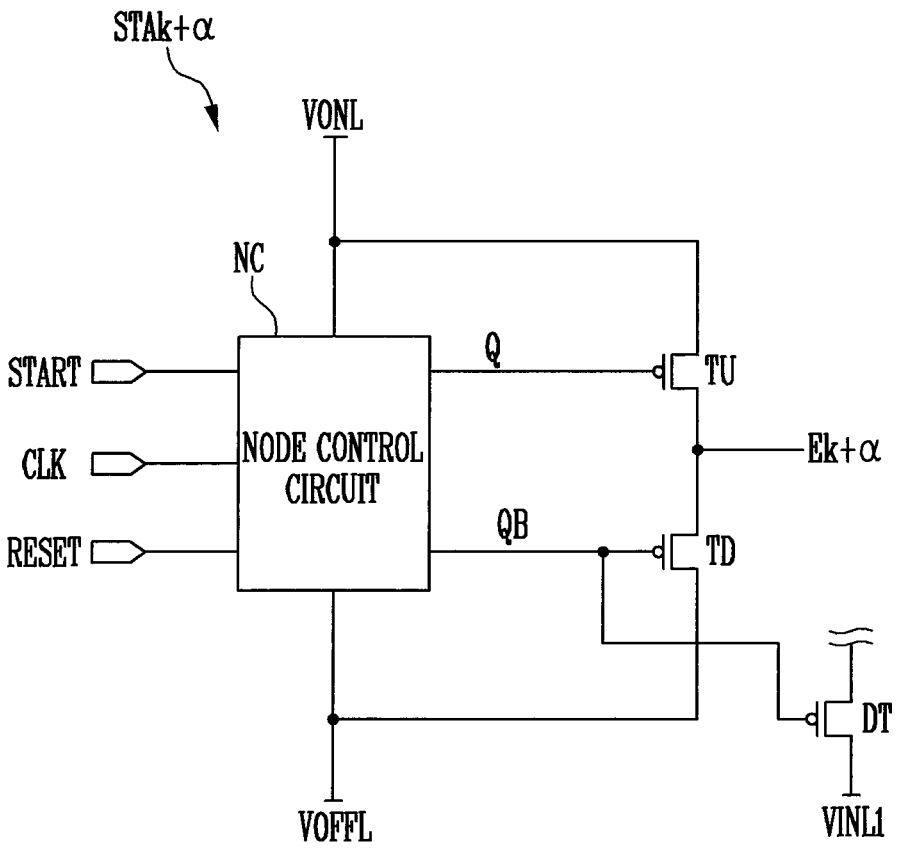
FIG. 6 is a circuit diagram illustrating an example of a $k+\alpha^{th}$ light emission stage of a scan driver outputting a $k+\alpha^{th}$ light emission control signal of FIG. 5.

FIG. 6 is a circuit diagram illustrating an example of a $k+\alpha^{th}$ light emission stage of a scan driver outputting a $k+\alpha^{th}$ light emission control signal as shown in FIG. 5. Referring to FIG. 6, a $k+\alpha^{th}$ light emission stage STAk+α which outputs a $k+\alpha^{th}$ light emission control signal to a $k+\alpha^{th}$ light emission control line Ek+α includes a pull-up control node Q, a pull-down control node QB, a pull-up transistor TU, a pull-down transistor TD, and a node control circuit NC.

The pull-up transistor TU controls connection between a gate-on voltage line VONL and the $k+\alpha^{th}$ light emission control line Ek+α in response to a voltage of the pull-up control node Q. A control electrode of the pull-up transistor TU is connected to the pull-up control node Q, a first electrode thereof is connected to the $k+\alpha^{th}$ light emission control line Ek+α, and a second electrode thereof is connected to the gate-on voltage line VONL.

The pull-down transistor TD controls connection between a gate-off voltage line VOFFL and the $k+\alpha^{th}$ light emission control line Ek+α in response to a voltage of the pull-down control node QB. A control electrode of the pull-down transistor TD is connected to the pull-down control node QB, a first electrode thereof is connected to the gate-off voltage line VOFFL, and a second electrode thereof is connected to the $k+\alpha^{th}$ light emission control line Ek+α.

The node control circuit NC controls the voltage of the pull-up control node Q and the voltage of the pull-down control node QB. The node control circuit NC includes a plurality of signal input terminals. For example, the node control circuit NC may include a start terminal START to which a start signal is input, a clock terminal CLK to which a clock signal is input, and a reset terminal RESET to which a reset signal is input. In addition, the node control circuit NC may be connected to the gate-on voltage line VONL and the gate-off voltage line VOFFL. The start signal may be a gate start signal or a carry signal of a front light emission stage. The clock signal may be one of a plurality of clock signals. The reset signal may be a carry signal of a rear light emission stage. The gate-on voltage line may supply the gate-on voltage, and the gate-off voltage line may supply the gate-off voltage. The gate-on voltage may refer to a voltage for turning on transistors included in light emission stages, display pixels and auxiliary pixels. The gate-off voltage may refer to a voltage for turning off the transistors included in the light emission stages, the display pixels and the auxiliary pixels.

The node control circuit NC supplies the gate-on voltage to the pull-up control node Q in response to the start signal input to the start terminal START and supplies the gate-off voltage to the pull-down control node QB. Therefore, the pull-up transistor TU is turned on by the gate-on voltage of the pull-up control node Q, and the pull-down transistor TD is turned off by the gate-off voltage of the pull-down control node QB. As a result, the gate-on voltage of the gate-on voltage line VONL is output to the $k+\alpha^{th}$ light emission control line Ek+α.

The node control circuit NC supplies the gate-off voltage to the pull-up control node Q and the gate-on voltage to the pull-down control node QB in response to the reset signal input to the reset terminal RESET. Therefore, the pull-up transistor TU is turned off by the gate-off voltage of the pull-up control node Q, and the pull-down transistor TD is turned on by the gate-on voltage of the pull-down control node QB. As a result, the gate-off voltage of the gate-on voltage line VONL is output to the $k+\alpha^{th}$ light emission control line Ek+α.

The pull-down control node QB of the $k+\alpha^{th}$ light emission stage STAk+α is connected to the A transistor DT of the auxiliary pixel driver 210 as shown in FIG. 5.

FIG. 6 illustrates the example in which the node control circuit NC includes the start terminal START, the clock terminal CLK and the reset terminal RESET. However, the present invention is not limited thereto. In addition, for convenience of explanation, FIG. 6 only illustrates the $k+\alpha^{th}$ light emission stage STAk+α. Each of the light emission stages connected to the light emission control lines E1 to En may be formed in substantially the same manner as the $k+\alpha^{th}$ light emission stage STAk+α. In addition, each of the scan stages connected to the scan lines S1 to Sn+1 may be formed in a substantially similar manner to the $k+\alpha^{th}$ light emission stage STAk+α.

Figure 7:
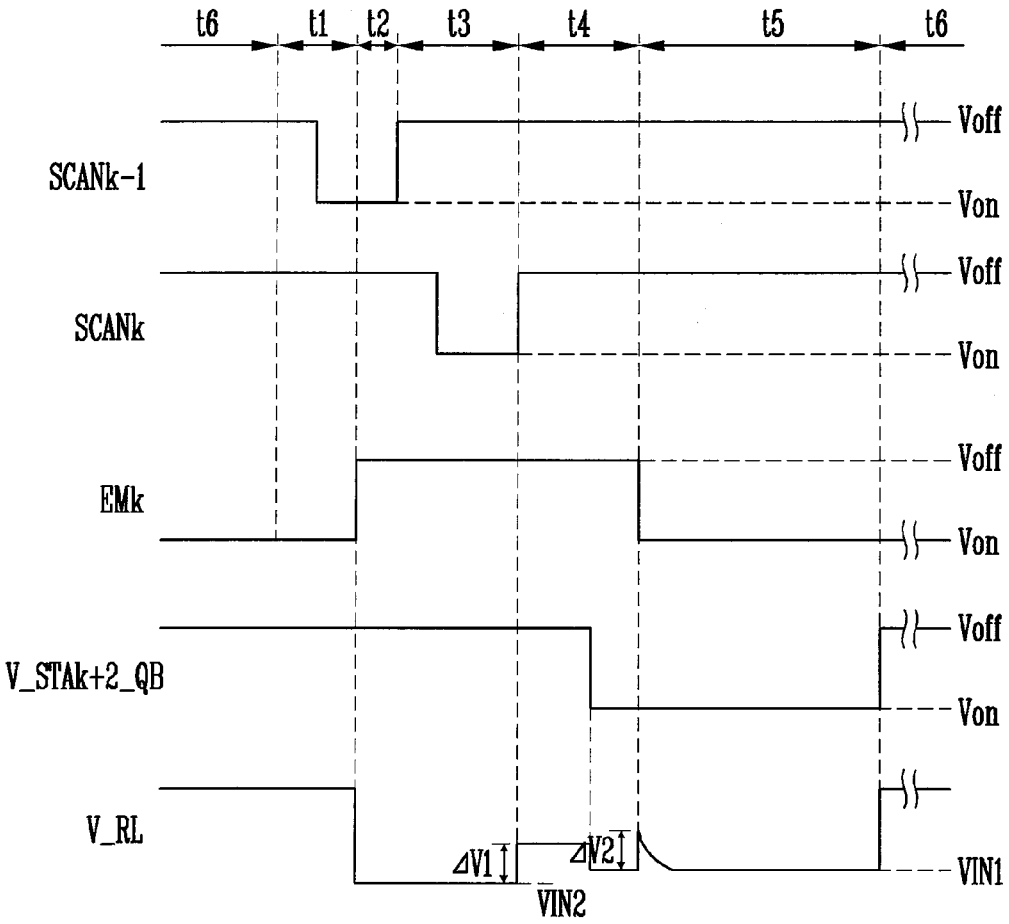
FIG. 7 is a waveform diagram of signals provided to display pixels and an auxiliary pixel shown in FIG. 5, a voltage of a control electrode of an A transistor (or auxiliary transistor), and a voltage of an auxiliary line.

FIG. 7 is a waveform diagram of signals supplied to the display pixels and the auxiliary pixel of FIG. 5, a voltage of the control electrode of the discharge transistor, and a voltage of the auxiliary line. FIG. 7 illustrates a $k-1^{th}$ scan signal SCANk−1 supplied to the $k-1^{th}$ scan line Sk−1, a $k^{th}$ scan signal SCANk supplied to the $k^{th}$ scan line Sk, a $k^{th}$ light emission control signal EMk supplied to the $k^{th}$ light emission control line Ek, a voltage (V_STAk+2_QB) of a pull-down control node STAk+2_QB of a $k+2^{th}$ light emission stage connected to a $k+2^{th}$ light emission control line, and a voltage (V_RL) of the auxiliary line RL. FIG. 7 illustrates the pull-down control node STAk+2_QB of the $k+2^{th}$ light emission stage as an example of the pull-down control node STAk+α_QB of the $k+\alpha^{th}$ light emission stage shown in FIG. 5. However, the present invention is not limited thereto.

Referring to FIG. 7, one frame period may be divided into first to sixth periods t1 to t6. The $k-1^{th}$ scan signal SCANk−1 may be generated as the gate-on voltage Von for the first and second periods t1 and t2. The $k^{th}$ scan signal SCANk may be generated as the gate-on voltage Von for the third period t3. The scan signals may be sequentially generated as the gate-on voltage Von. The $k^{th}$ light emission control signal EMk may be generated as the gate-off voltage Voff for the second to fourth periods t2 to t4. The voltage (V_STAk+2_QB) of the pull-down control node STAk+2_QB of the k+2$^{th}$ light emission stage may be generated as the gate-on voltage Von for the fourth and fifth periods t4 and t5. The gate-off voltage Voff may refer to a voltage for turning off the transistors of the display pixels and the auxiliary pixels, and the gate-on voltage Von may refer to a voltage for turning on the transistors of the display pixels and the auxiliary pixels.

A driving method of the first auxiliary pixel RP1 and the j$^{th}$ display pixel DPj and a driving method of the first display pixel DP1 are described below in detail with reference to FIGS. 5 and 7.

First, the driving method of the first display pixel DP1 is described in detail.

First, an on bias is applied to the first transistor T1 for the first period t1.

In the first period t1, the k−1$^{th}$ scan signal SCANk−1 having a level of the gate-on voltage Von for part of the first period t1 is supplied to the k−1$^{th}$ scan line Sk−1, and the k$^{th}$ light emission control signal EMk having a level of the gate-on voltage Von for all of the first period t1 is supplied to the k$^{th}$ light emission control line Ek. Therefore, the fourth, fifth, sixth and seventh transistors T4, T5, T6, and T7 are turned on for part or all of the first period t1.

Since the fourth transistor T4 is turned on, the control electrode of the first transistor T1 is initialized to the second power voltage VIN2 of the second power voltage line VINL2. Since the fifth, sixth and seventh transistors T5, T6, and T7 are turned on, a current path is formed so that current may flow from the third power voltage line VDDL to the second power voltage line VINL2 through the fifth transistor T5, the first transistor T1, the sixth transistor T6, and the seventh transistor T7. More specifically, since the first transistor T1 is a P type transistor, the first transistor T1 is turned on when a voltage difference (Vgs) between the control electrode and the first electrode of the first transistor T1 is less than a threshold voltage Vth of the first transistor T1 (Vgs<Vth). Since the second power voltage VIN2 is set to be sufficiently lower than the third power voltage VDD, a voltage difference (Vgs=VIN2−VDD) between the control electrode and the first electrode of the first transistor T1 is less than the threshold voltage Vth of the first transistor T1 for the first period t1. Thus, current flows through the current path.

Therefore, since the control electrode of the first transistor T1 is discharged to the second power voltage for the first period t1, the on bias may be applied to the first transistor T1. As a result, according to an exemplary embodiment of the present invention, the on bias may be applied to the first transistor T1 before the data voltage is supplied to the control electrode of the first transistor T1. Therefore, image quality degradation caused by hysteresis characteristics of the first transistor T1 may be prevented (or reduced).

Second, the control electrode of the first transistor T1 and the anode electrode of the organic light emitting diode OLED are initialized for the second period t2.

For the second period t2, the k−1$^{th}$ scan signal SCANk−1 having a level of the gate-on voltage Von is supplied to the k−1$^{th}$ scan line Sk−1, and the k$^{th}$ light emission control signal EMk having a level of the gate-off voltage Voff is supplied to the k$^{th}$ light emission control line Ek. Therefore, the fourth and seventh transistors T4 and T7 are turned on for the second period t2.

Since the fourth transistor T4 is turned on, the control electrode of the first transistor T1 is initialized to the second power voltage of the second power voltage line VINL2. Since the seventh transistor T7 is turned on, the anode electrode of the organic light emitting diode OLED is initialized to the second power voltage of the second power voltage line VINL2.

Third, a data voltage and a threshold voltage of the control electrode of the first transistor T1 are sampled for the third period t3.

The k$^{th}$ scan signal SCANk having a level of the gate-on voltage Von for part of the third period t3 is supplied to the k$^{th}$ scan line Sk, so that the second and third transistors T2 and T3 are turned on for part of the third period t3.

Since the second transistor T2 is turned on, a data voltage Vdata of the first data line D1 is supplied to the first electrode of the first transistor T1. Since the third transistor T3 is turned on, the control electrode and the second electrode of the first transistor T1 are connected, so that the first transistor T1 is driven as a diode.

Since a voltage difference (Vgs=VIN2−Vdata) between the control electrode and the first electrode of the first transistor T1 is less than the threshold voltage Vth, current flows through the first transistor T1 until the voltage difference (Vgs) between the control electrode and the first electrode of the first transistor T1 reaches the threshold voltage Vth of the first transistor T1. Therefore, the voltage of the control electrode of the first transistor T1 is increased to "Vdata+Vth" for the third period t3.

Fourth, the sampling of the data voltage and the threshold voltage of the control electrode of the first transistor T1 is completed for the fourth period t4.

The k$^{th}$ scan signal SCANk having a level of the gate-off voltage Voff is supplied to the k$^{th}$ scan line Sk for the fourth period t4. As a result, all the transistors of the display pixel driver 110 are turned off for the fourth period t4.

For the fourth period t4, "Vdata+Vth" corresponding to the voltage of the control electrode of the first transistor T1 is stored in the storage capacitor Cst.

Fifth, the organic light emitting diode OLED emits light for the fifth and sixth periods t5 and t6.

The k$^{th}$ light emission control signal EMk having a level of the gate-on voltage Von is supplied to the k$^{th}$ light emission control line Ek for the fifth and sixth periods t5 and t6, so that the fifth and sixth transistors T5 and T6 are turned on for the fifth and sixth periods t5 and t6.

Since the fifth and sixth transistors T5 and T6 are turned on, the driving current Ids flows through the first transistor T1 in response to the voltage of the control electrode. Here, the control electrode of the first transistor T1 maintains "Vdata+Vth" by the storage capacitor Cst. The driving current Ids flowing through the first transistor T1 may be expressed by the following equation:

$$I_{ds}=k'\cdot(V_{gs}-V_{th})^2=k'\cdot((V\text{data}+Vth)-VDD-Vth)^2 \quad \text{Equation 2}$$

In Equation 2, k' is a proportional coefficient determined by the structure and physical properties of the first transistor T1, Vgs is a gate-to-source voltage of the first transistor T1, Vth is the threshold voltage of the first transistor T1, VDD is the third power voltage, and Vdata is the data voltage. The voltage of the control electrode of the first transistor T1 is "Vdata+Vth", and a voltage Vs of the first electrode is VDD. Equation 3 is derived from Equation 2.

$$I_{ds}=k'\cdot(V\text{data}-VDD)^2 \quad \text{Equation 3}$$

As shown in Equation 3, the driving current Ids does not depend on the threshold voltage Vth of the first transistor T1. In other words, the threshold voltage Vth of the first transistor T1 is compensated. The driving current Ids of the display pixel driver 110 is supplied to the organic light emitting diode OLED, so that the organic light emitting diode OLED emits light.

Hereinafter, the driving method of the first auxiliary pixel RP1 and the $j^{th}$ display pixel DPj is described in detail.

First, an on bias is applied to the first transistor T1' for the first period t1.

In the first period t1, the $k-1^{th}$ scan signal SCANk−1 having a level of the gate-on voltage Von for part of the first period t1 is applied to the $k-1^{th}$ scan line Sk−1, and the $k^{th}$ light emission control signal EMk having a level of the gate-on voltage Von for all of the first period t1 is supplied to the $k^{th}$ light emission control line Ek. Therefore, the fourth, fifth, sixth and seventh transistors T4', T5', T6', and T7' are turned on for all or part of the first period t1.

Since the fourth transistor T4' is turned on, the control electrode of the first transistor T1' is initialized to the second power voltage VIN2 of the second power voltage line VINL2. Since the fifth, sixth and seventh transistors T5', T6', and T7' are turned on, a current path is formed so that current may flow from the third power voltage line VDDL to the second power voltage line VINL2 through the fifth transistor T5', the first transistor T1', the sixth transistor T6', and the seventh transistor T7'. Since the second power voltage VIN2 is set to be sufficiently lower than the third power voltage VDD, a voltage difference (Vgs=VIN2−VDD) between the control electrode and the first electrode of the first transistor T1' is less than the threshold voltage Vth of the first transistor T1' for the first period t1, so that current flows through the current path.

Thus, for the first period t1, the on bias may be applied to the first transistor T1' by discharging the control electrode of the first transistor T1' to the second power voltage. As a result, according to an exemplary embodiment of the present invention, the on bias may be applied to the first transistor T1' before the data voltage is supplied to the control electrode of the first transistor T1', so that image quality degradation caused by the hysteresis characteristics of the first transistor T1' may be prevented (or reduced).

Second, the control electrode of the first transistor T1' and the auxiliary line RL are initialized to the second power voltage VIN2 for the second period t2.

For the second period t2, the $k-1^{th}$ scan signal SCANk−1 having a level of the gate-on voltage Von is supplied to the $k-1^{th}$ scan line Sk−1, and the $k^{th}$ light emission control signal EMk having a level of the gate-off voltage Voff is supplied to the $k^{th}$ light emission control line Ek. Therefore, the fourth transistor T4' and the seventh transistor T7' are turned on for the second period t2.

Since the fourth transistor T4' is turned on, the control electrode of the first transistor T1' is initialized to the second power voltage VIN2 of the second power voltage line VINL2. Since the seventh transistor T7' is turned on, the auxiliary line RL is initialized to the second power voltage VIN2 of the second power voltage line VINL2.

Third, the data voltage and the threshold voltage of the control electrode of the first transistor T1' are sampled for the third period t3.

The $k^{th}$ scan signal SCANk having a level of the gate-on voltage Von for part of the third period t3 is supplied to the $k^{th}$ scan line Sk, so that the second and third transistors T2' and T3' are turned on for part of the third period t3.

Since the second transistor T2' is turned on, the data voltage Vdata of the first data line D1 is supplied to the first electrode of the first transistor T1'. Since the third transistor T3' is turned on, the control electrode and the second electrode of the first transistor T1' are connected, so that the first transistor T1' is driven as a diode.

Since the voltage difference (Vgs=VIN2−Vdata) between the control electrode and the first electrode of the first transistor T1' is less than the threshold voltage Vth, current flows through the first transistor T1' until a voltage difference (Vgs) between the control electrode and the first electrode reaches the threshold voltage Vth of the first transistor T1'. Therefore, the voltage of the control electrode of the first transistor T1' increases to "Vdata+Vth" for the third period t3.

Fourth, for the fourth period t4, the sampling of the data voltage and the threshold voltage of the control electrode of the first transistor T1' is completed, and the auxiliary line RL is discharged to the first power voltage.

In the fourth period t4, the $k^{th}$ scan signal SCANk having a level of the gate-off voltage Voff is supplied to the $k^{th}$ scan line Sk, and the voltage (V_STAk+2_QB) of the pull-down control node STAk+2_QB of the $k+2^{th}$ light emission stage having a level of the gate-on voltage Von for part of the fourth period t4 is supplied to the control electrode of the A transistor DT. Therefore, the A transistor DT is turned on for part of the fourth period t4.

For the fourth period t4, "Vdata+Vth" corresponding to the voltage of the control electrode of the first transistor T1' is stored in the storage capacitor Cst.

Since the $k^{th}$ scan line Sk and the auxiliary line RL are formed next to each other, the fringe capacitance FC may be formed between the $k^{th}$ scan line Sk and the auxiliary line RL as illustrated in FIG. 5. Voltage variations of the $k^{th}$ scan line Sk may be reflected in the auxiliary line RL by the fringe capacitance FC. Therefore, when the $k^{th}$ scan signal SCANk increases from the gate-on voltage Von to the gate-off voltage Voff for the fourth period t4, the changes in voltage of the $k^{th}$ scan line Sk may be reflected by the fringe capacitance FC, so that the voltage of the auxiliary line RL may be increased by ΔV1.

However, since the A transistor DT is turned on for the fourth period t4, the auxiliary line RL is connected to the first power voltage line VINL1. Thus, even when the voltage variation of the $k^{th}$ scan line Sk is reflected in the auxiliary line RL by the fringe capacitance FC, the auxiliary line RL is discharged to the first power voltage VIN1.

Fifth, the auxiliary line RL is discharged to the first power voltage for the fifth period t5.

For the fifth period t5, the $k^{th}$ light emission control signal EMk having a level of the gate-on voltage Von is supplied to the $k^{th}$ light emission control line Ek, and the voltage (V_STAk+2_QB) of the pull-down control node STAk+2_QB of the $k+2^{th}$ light emission stage having a level of the gate-on voltage Von is supplied to the control electrode of the A transistor DT. Therefore, the fifth and sixth transistors T5' and T6' and the A transistor DT are turned on for the fifth period t5.

Since the fifth and sixth transistors T5' and T6' are turned on, the driving current Ids' flows through the first transistor T1 in response to the voltage of the control electrode. The control electrode of the first transistor T1' maintains the "Vdata+Vth" by the storage capacitor Cst. The driving current Ids' flowing through the first transistor T1' may be expressed by Equation 2. In addition, Equation 3 is derived from Equation 2.

As shown in Equation 3, the driving current Ids' does not depend on the threshold voltage Vth of the first transistor T1'. In other words, the threshold voltage Vth of the first transistor T1' is compensated.

Since the A transistor DT is turned on for the fifth period t5, the driving current Ids of the auxiliary pixel driver 210 is discharged to the first power voltage line VINL1 through the A transistor DT. Therefore, the organic light emitting diode OLED of the $j^{th}$ display pixel DPj does not emit light for the fifth period t5.

Since the auxiliary line RL overlaps with the anode electrodes of the organic light emitting diodes OLEDs of the display pixels DP1, the parasitic capacitances PC may be formed between the auxiliary line RL and the anode electrodes of the organic light emitting diodes OLEDs of the display pixels DP1 as shown in FIG. 5. Voltage variations of the anode electrodes of the organic light emitting diodes OLEDs may be reflected in the auxiliary line RL by the parasitic capacitance PC. Driving currents are supplied to the anode electrodes of the organic light emitting diodes OLEDs of the display pixels DP1 by the $k^{th}$ light emission control signal EMk having a level of the gate-on voltage Von for the fifth period t5. Therefore, the voltage variations of the anode electrodes of the organic light emitting diodes OLEDs of the display pixels DP1 may be reflected in the auxiliary line RL by the parasitic capacitance PC to increase the voltage of the auxiliary line RL by ΔV2. However, since the auxiliary line RL is connected to the first power voltage line VINL1 for the fifth period t5, the auxiliary line RL is discharged to the first power voltage VIN1 even when the voltage variations of the anode electrodes of the organic light emitting diodes OLEDs of the display pixels DP1 are reflected by the parasitic capacitances PC.

Sixth, the organic light emitting diode OLED emits light for the sixth period t6.

For the sixth period t6, the $k^{th}$ light emission control signal EMk having a level of the gate-on voltage Von is supplied to the $k^{th}$ light emission control line Ek, and the voltage (V_STAk+2_QB) of the pull-down control node STAk+2_QB of the $k+2^{th}$ light emission stage having a level of the gate-off voltage Voff is supplied to the control electrode of the A transistor DT. Therefore, for the sixth period t6, the fifth and sixth transistors T5' and T6' are turned on, and the A transistor DT is turned off.

Since the A transistor DT is turned off and the fifth and sixth transistors T5' and T6' are turned on, the driving current Ids' of the auxiliary pixel driver 210 is supplied to the organic light emitting diode OLED of the $j^{th}$ display pixel DPj through the auxiliary line RL. Therefore, the organic light emitting diode OLED of the $j^{th}$ display pixel DPj emits light.

As described above, according to an exemplary embodiment of the present invention, the voltage of the auxiliary line RL may be prevented (or protected) from being changed by the parasitic capacitances PC and the fringe capacitance FC. As a result, according to an exemplary embodiment of the present invention, the organic light emitting diode OLED of the $j^{th}$ display pixel DPj may be prevented (or protected) from emitting light in error by the parasitic capacitances PC and the fringe capacitance FC.

Figure 8:
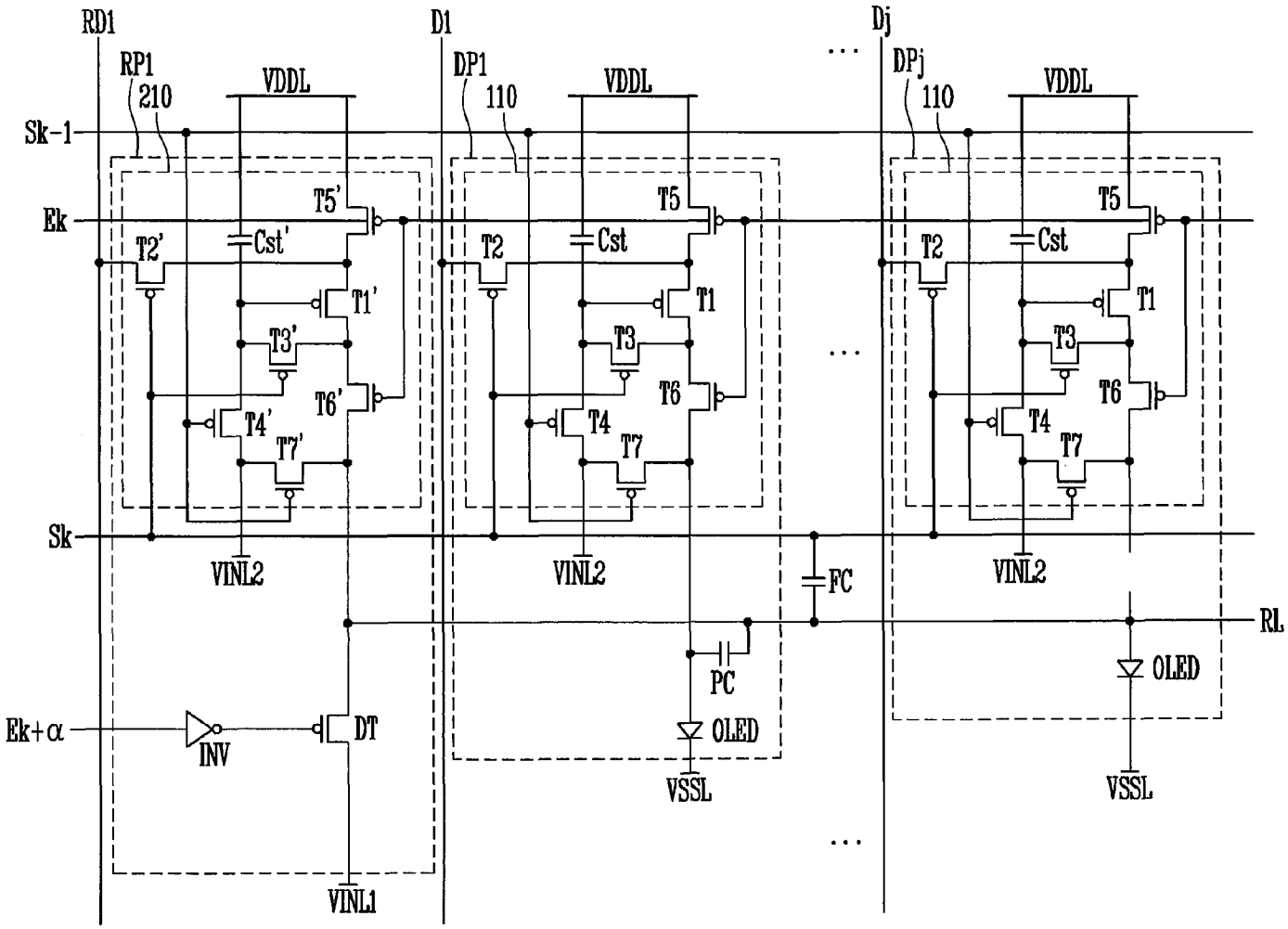
FIG. 8 is a detailed circuit diagram illustrating display pixels and an auxiliary pixel according to another exemplary embodiment of the present invention.

FIG. 8 is a detailed circuit diagram illustrating display pixels and an auxiliary pixel according to another exemplary embodiment of the present invention. For convenience of explanation, FIG. 8 illustrates only the $k-1^{th}$ and $k^{th}$ scan lines Sk−1 and Sk, the first auxiliary data line RD1, the first and $j^{th}$ data lines D1 and Dj, and the $k^{th}$ and $k+\alpha^{th}$ light emission control lines Ek and Ek+α. In addition, for convenience of explanation, FIG. 8 illustrates only the first auxiliary pixel RP1 connected to the first auxiliary data line RD1, the first display pixel DP1 connected to the first data line D1, and the $j^{th}$ display pixel DPj connected to the $j^{th}$ data line Dj. In FIG. 8, the first display pixel DP1 refers to a pixel in which a defect does not occur during the manufacturing process, and the $j^{th}$ display pixel DPj is a pixel in which a defect occurs during the manufacturing process and is repaired.

Referring to FIG. 8, the first auxiliary pixel RP1 is connected to the $j^{th}$ display pixel DPj through the auxiliary line RL. The auxiliary line RL is connected to the first auxiliary pixel RP1 and extends from the first auxiliary pixel RP1 to the display area DA to cross the display pixels DP1 and DPj. More specifically, as shown in FIG. 8, the auxiliary line RL may cross the anode electrodes of the organic light emitting diodes OLEDs of the display pixels DP1 and DPj.

The auxiliary line RL may be connected to the organic light emitting diode OLED of the $j^{th}$ display pixel DPj. In this example, the display pixel driver 110 and the organic light emitting diode OLED of the $j^{th}$ display pixel DPj may be disconnected from each other.

Each of the display pixels DP1 and DPj includes the organic light emitting diode OLED and the display pixel driver 110. The display pixels DP1 and DPj illustrated in FIG. 8 are substantially the same as the display pixels DP1 and DPj illustrated in FIG. 5, respectively. Therefore, a detailed description of the display pixels DP1 and DPj shown in FIG. 8 is omitted.

The first auxiliary pixel RP1 includes the auxiliary pixel driver 210, the A transistor DT, and an inverter INV. The first auxiliary pixel RP1 does not include the organic light emitting diode OLED. The auxiliary pixel driver 210 of the first auxiliary pixel RP1, shown in FIG. 8, is substantially the same as the auxiliary pixel driver 210 of the first auxiliary pixel RP1, shown in FIG. 5. Thus, a detailed description of the auxiliary pixel driver 210 of the first auxiliary pixel RP1 as shown in FIG. 8 is omitted.

The A transistor DT is connected to the auxiliary line RL and the first power voltage line VINL1 to which the first power voltage is supplied. The A transistor DT is turned on by the control electrode of the A transistor DT to connect the auxiliary line RL and the first power voltage line VINL1. Therefore, the voltage of the auxiliary line RL is discharged to the first power voltage. In other words, the A transistor DT functions to discharge the auxiliary line RL. The control electrode of the A transistor DT is connected to an output terminal of the inverter INV, the first electrode is connected to the auxiliary line RL, and the second electrode is connected to the first power voltage line VINL1.

The inverter INV is connected to the $k+\alpha^{th}$ light emission control line Ek+α and the control electrode of the A transistor DT. In other words, an input terminal of the inverter INV is connected to the $k+\alpha^{th}$ light emission control line Ek+α, and the output terminal thereof is connected to the control electrode of the A transistor DT. The inverter INV inverts a light emitting signal of the $k+\alpha^{th}$ light emission control line Ek+α and supplies an inverted light emitting signal to the control electrode of the A transistor DT.

Figure 9:
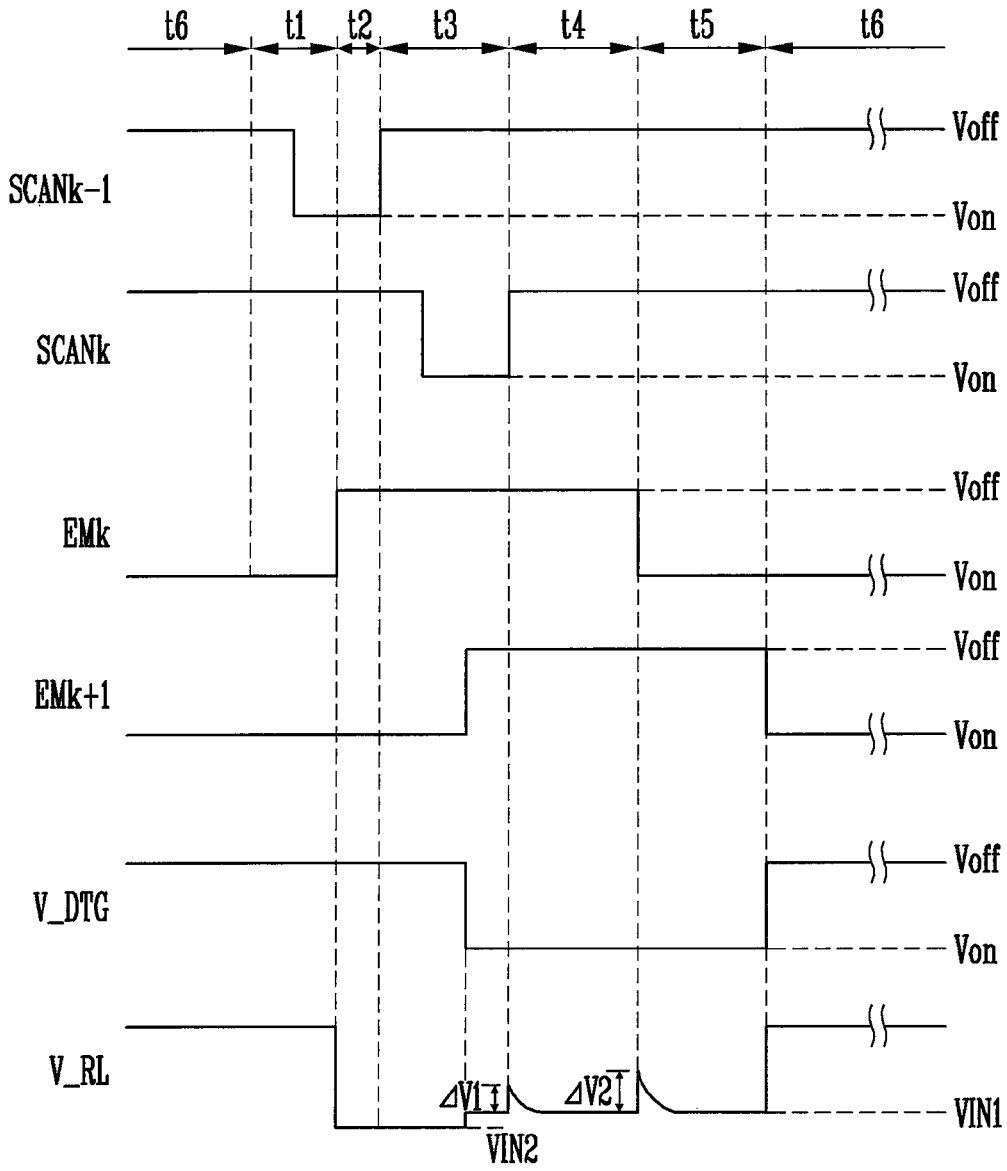
FIG. 9 is a waveform diagram of signals provided to display pixels and an auxiliary pixel shown in FIG. 8, a voltage of the control electrode of the discharge transistor, and a voltage of the auxiliary line.

FIG. 9 is a waveform view of signals supplied to the display pixels and the auxiliary pixels shown in FIG. 8, a voltage of the control electrode of the discharge transistor, and a voltage of the auxiliary line. FIG. 9 illustrates the $k-1^{th}$ scan signal SCANk−1 supplied to the $k-1^{th}$ scan line Sk−1, the $k^{th}$ scan signal SCANk supplied to the $k^{th}$ scan line Sk, the $k^{th}$ light emission control signal EMk supplied to the $k^{th}$ light emission control line Ek, a $k+1^{th}$ light emission control signal EMk+1 supplied to a $k+1^{th}$ light emission control line Ek+1, a voltage (V_DTG) of the control electrode of the A transistor DT, and the voltage (V_RL) of the auxiliary line RL. FIG. 9 illustrates the $k+1^{th}$ light emission control line Ek+1 as an example of the k+$\alpha^{th}$ light emission control line Ek+$\alpha$ shown in FIG. 9. However, the present invention is not limited thereto.

The k−1$^{th}$ scan signal SCANk−1, the k$^{th}$ scan signal SCANk, and the k$^{th}$ light emission control signal EMk as shown in FIG. 9 are substantially the same as the k−1$^{th}$ scan signal SCANk−1, the k$^{th}$ scan signal SCANk, the k$^{th}$ light emission control signal EMk as shown in FIG. 7, respectively. Therefore, a detailed description of the k−1$^{th}$ scan signal. SCANk−1, the k$^{th}$ scan signal SCANk, and the k$^{th}$ light emission control signal EMk is omitted. The k+1$^{th}$ light emission control signal EMk+1 is generated to have a level of the gate-off voltage Voff for the third to fifth periods t3 to t5.

Hereinafter, a driving method of the first auxiliary pixel RP1 and the j$^{th}$ display pixel DPj and a driving method of the first display pixel DP1 are described in detail with reference to FIGS. 8 and 9.

First, the driving method of the first display pixel DP1 described with reference to FIGS. 8 and 9 is substantially the same as the driving method of the first display pixel DP1 as illustrated in FIGS. 5 and 7. Therefore, a detailed description of the driving method of the first display pixel DP1 as illustrated in FIGS. 8 and 9 is omitted.

Subsequently, the driving method of the first auxiliary pixel RP1 and the j$^{th}$ display pixel DPj is described in detail.

First, an on bias is applied to the first transistor T1 for the first period t1.

In the first period t1, the k−1$^{th}$ scan signal SCANk−1 having a level of the gate-on voltage Von for part of the first period t1 is supplied to the k−1$^{th}$ scan line Sk−1, the k$^{th}$ light emission control signal EMk having a level of the gate-on voltage Von for all of the first period t1 is supplied to the k$^{th}$ light emission control line Ek, and the k+1$^{th}$ light emission control signal EMk+1 having a level of the gate-on voltage Von for all of the first period t1 is supplied to the k+1$^{th}$ light emission control line Ek+1. Therefore, the fourth, fifth, sixth and seventh transistors T4', T5', T6', and T7' are turned on for all or part of the first period t1. In addition, since the k+1$^{th}$ light emission control signal EMk+1 having a level of the gate-on voltage Von is inverted and supplied to the control electrode of the A transistor DT by the inverter INV for the first period t1, the A transistor DT is turned off.

Since the fourth transistor T4' is turned on, the control electrode of the first transistor T1' is initialized to the second power voltage VIN2 of the second power voltage line VINL2. Since the fifth, sixth and seventh transistors T5', T6', and T7' are turned on, a current path is formed so that current may flow from the third power voltage line VDDL to the second power voltage line VINL2 through the fifth transistor T5', the first transistor T1', the sixth transistor T6', and the seventh transistor T7'. Since the second power voltage VIN2 is set to be sufficiently lower than the third power voltage VDD, the voltage difference (Vgs=VIN2−VDD) between the control electrode and the first electrode of the first transistor T1' is smaller than the threshold voltage Vth of the first transistor T1' for the first period t1, so that current flows through the current path.

Therefore, the control electrode of the first transistor T1' is discharged to the second power voltage, so that the on bias may be applied to the first transistor T1' for the first period t1. As a result, according to an exemplary embodiment of the present invention, the on bias may be applied to the first transistor T1' before the data voltage is supplied to the control electrode of the first transistor T1'. Therefore, image quality degradation caused by hysteresis characteristics of the first transistor T1' may be prevented (or reduced).

Second, the control electrode of the first transistor T1' and the auxiliary line RL are initialized to the second power voltage VIN2 for the second period t2.

For the second period t2, the k−1$^{th}$ scan signal SCANk−1 having a level of the gate-on voltage Von is supplied to the k−1$^{th}$ scan line Sk−1, the k$^{th}$ light emission control signal EMk having a level of the gate-off voltage Voff is supplied to the k$^{th}$ light emission control line Ek, and the k+1$^{th}$ light emission control signal EMk+1 having a level of the gate-on voltage Von is supplied to the k+1$^{th}$ light emission control line Ek+1. Thus, the fourth transistor T4' and the seventh transistor T7' are turned on for the second period t2. In addition, since the k+1$^{th}$ light emission control signal EMk+1 having a level of the gate-on voltage Von is inverted and supplied to the control electrode of the A transistor DT by the inverter INV for the second period t2, the A transistor DT is turned off.

Since the fourth transistor T4' is turned on, the control electrode of the first transistor T1' is initialized to the second power voltage VIN2 of the second power voltage line VINL2. Since the seventh transistor T7' is turned on, the auxiliary line RL is initialized to the second power voltage VIN2 of the second power voltage line VINL2.

A data voltage and a threshold voltage of the control electrode of the first transistor T1' are sampled for the third period t3.

In the third period t3, the k$^{th}$ scan signal SCANk having a level of the gate-on voltage Von for part of the third period t3 is supplied to the k$^{th}$ scan line Sk, and the k+1$^{th}$ light emission control signal EMk+1 having a level of the gate-off voltage Voff for part of the third period t3 is supplied to the k+1$^{th}$ light emission control line Ek+1, so that the second and third transistors T2' and T3' are turned on for part of the third period t3. In addition, since the k+1$^{th}$ light emission control signal EMk+1 having a level of the gate-off voltage Voff is inverted and supplied to the control electrode of the A transistor DT by the inverter INV for the third period t3, the A transistor DT is turned on for all of the third period t3.

Since the second transistor T2' is turned on, the data voltage Vdata of the first data line D1 is supplied to the first electrode of the first transistor T1'. Since the third transistor T3' is turned on, the control electrode and the second electrode of the first transistor T1' are connected. Therefore, the first transistor T1' is driven as a diode.

Since the voltage difference (Vgs=VIN2−Vdata) between the control electrode and the first electrode of the first transistor T1' is less than the threshold voltage Vth, current flows through the first transistor T1' until the voltage difference (Vgs) between the control electrode and the first electrode reaches the threshold voltage Vth of the first transistor T1'. Therefore, the voltage of the control electrode of the first transistor T1' reaches "Vdata+Vth" for the third period t3.

Since the A transistor DT is turned on, the auxiliary line RL is connected to the first power voltage line VINL1. Therefore, the auxiliary line RL is discharged to the first power voltage VIN1.

Fourth, for the fourth period t4, the sampling of the data voltage and the threshold voltage of the control electrode of the first transistor T1' is completed, and the auxiliary line RL is discharged to the first power voltage.

For the fourth period t4, the k$^{th}$ scan signal SCANk having a level of the gate-off voltage Voff is supplied to the k$^{th}$ scan line Sk, and the k+1$^{th}$ light emission control signal EMk+1 having a level of the gate-off voltage Voff is supplied to the k+1$^{th}$ light emission control line Ek+1. The k+1$^{th}$ light emission control signal EMk+1 having a level of the gate-off voltage Voff is inverted and supplied to the control electrode of the A transistor DT by the inverter INV for the fourth period t4, so that the A transistor DT is turned on.

For the fourth period t4, "Vdata+Vth" corresponding to the voltage of the control electrode of the first transistor T1' is stored in the storage capacitor Cst.

Since the $k^{th}$ scan line Sk and the auxiliary line RL are formed next to each other, the fringe capacitance FC may be formed between the $k^{th}$ scan line Sk and the auxiliary line RL as shown in FIG. 9. Voltage variations of the $k^{th}$ scan line Sk may be reflected in the auxiliary line RL by the fringe capacitance FC. Therefore, when the $k^{th}$ scan signal SCANk increases from the gate-on voltage Von to the gate-off voltage Voff for the fourth period t4, the voltage variations of the $k^{th}$ scan line Sk may be reflected in the auxiliary line RL by the fringe capacitance FC, so that the voltage of the auxiliary line RL may be increased by ΔV1.

However, since the A transistor DT is turned on for the fourth period t4, the auxiliary line RL is connected to the first power voltage line VINL1. Therefore, even when the voltage variations of the $k^{th}$ scan line Sk are reflected in the auxiliary line RL by the fringe capacitance FC, the auxiliary line RL is discharged to the first power voltage VIN1.

Fifth, the auxiliary line RL is discharged to the first power voltage for the fifth period t5.

For the fifth period t5, the $k^{th}$ light emission control signal EMk having a level of the gate-on voltage Von is supplied to the $k^{th}$ light emission control line Ek, and the $k+1^{th}$ light emission control signal EMk+1 having a level of the gate-off voltage Voff is supplied to the $k+1^{th}$ light emission control line Ek+1, so that the fifth and sixth transistors T5' and T6' and the A transistor DT are turned on for the fifth period t5. In addition, the $k+1^{th}$ light emission control signal EMk+1 having a level of the gate-off voltage Voff is inverted and supplied to the control electrode of the A transistor DT by the inverter INV for the fifth period t5, so that the A transistor DT is turned on.

Since the fifth and sixth transistors T5' and T6' are turned on, the driving current Ids' flows through the first transistor T1' in response to the control electrode. The control electrode of the first transistor T1' maintains "Vdata+Vth" by the storage capacitor Cst. The driving current Ids' flowing through the first transistor T1' may be expressed according to Equation 2. In addition, Equation 3 is derived from Equation 2.

As shown in Equation 3, the driving current Ids' does not depend on the threshold voltage Vth of the first transistor T1'. In other words, the threshold voltage Vth of the first transistor T1' is compensated.

Since the A transistor DT is turned on for the fifth period t5, the driving current Ids of the auxiliary pixel driver 210 is discharged to the first power voltage line VINL1 through the A transistor DT. Therefore, the organic light emitting diode OLED of the $j^{th}$ display pixel DPj does not emit light for the fifth period t5.

Since the auxiliary line RL overlaps with the anode electrodes of the organic light emitting diodes OLEDs of the display pixels DP1, the parasitic capacitances PC may be formed between the auxiliary line RL and the anode electrodes of the organic light emitting diodes OLEDs of the display pixels DP1 as shown in FIG. 9. Voltage variations of the anode electrodes of the organic light emitting diodes OLEDs may be reflected in the auxiliary line RL by the parasitic capacitance PC. Since driving currents are supplied to the anode electrodes of the organic light emitting diodes OLEDs of the display pixels DP1 by the $k^{th}$ light emission control signal EMk having a level of the gate-on voltage Von for the fifth period t5, the voltage variations of the anode electrodes of the organic light emitting diodes OLEDs of the display pixels DP1 may be reflected in the auxiliary line RL by the parasitic capacitance PC, so that the voltage of the auxiliary line RL may be increased by ΔV2. However, since the auxiliary line RL is connected to the first power voltage line VINL1 for the fifth period t5, the auxiliary line RL is discharged to the first power voltage VIN1 even when the voltage variations of the anode electrodes of the organic light emitting diodes OLEDs of the display pixels DP1 are reflected by the parasitic capacitance PC.

Sixth, the organic light emitting diode OLED emits light for the sixth period t6.

For the sixth period t6, the $k^{th}$ light emission control signal EMk having a level of the gate-on voltage Von is supplied to the $k^{th}$ light emission control line Ek, and the $k+1^{th}$ light emission control signal EMk+1 having a level of the gate-on voltage Von is supplied to the $k+1^{th}$ light emission control line Ek+1, so that the fifth and sixth transistors T5' and T6' are turned on for the sixth period t6. In addition, the $k+1^{th}$ light emission control signal EMk+1 having a level of the gate-on voltage Von is inverted and supplied to the control electrode of the A transistor DT by the inverter INV, so that the A transistor DT is turned off.

Since the A transistor DT is turned off and the fifth and sixth transistors T5' and T6' are turned on, the driving current Ids' of the auxiliary pixel driver 210 is supplied to the organic light emitting diode OLED of the $j^{th}$ display pixel DPj through the auxiliary line RL. Therefore, the organic light emitting diode OLED of the $j^{th}$ display pixel DPj emits light.

As described above, according to an exemplary embodiment of the present invention, the voltage of the auxiliary line RL may be prevented (or protected) from being changed by the parasitic capacitances PC and the fringe capacitance FC. As a result, according to an exemplary embodiment of the present invention, the organic light emitting diode OLED of the $j^{th}$ display pixel DPj may be prevented (or protected) from emitting light by the parasitic capacitances PC and the fringe capacitance FC.

Figure 10:
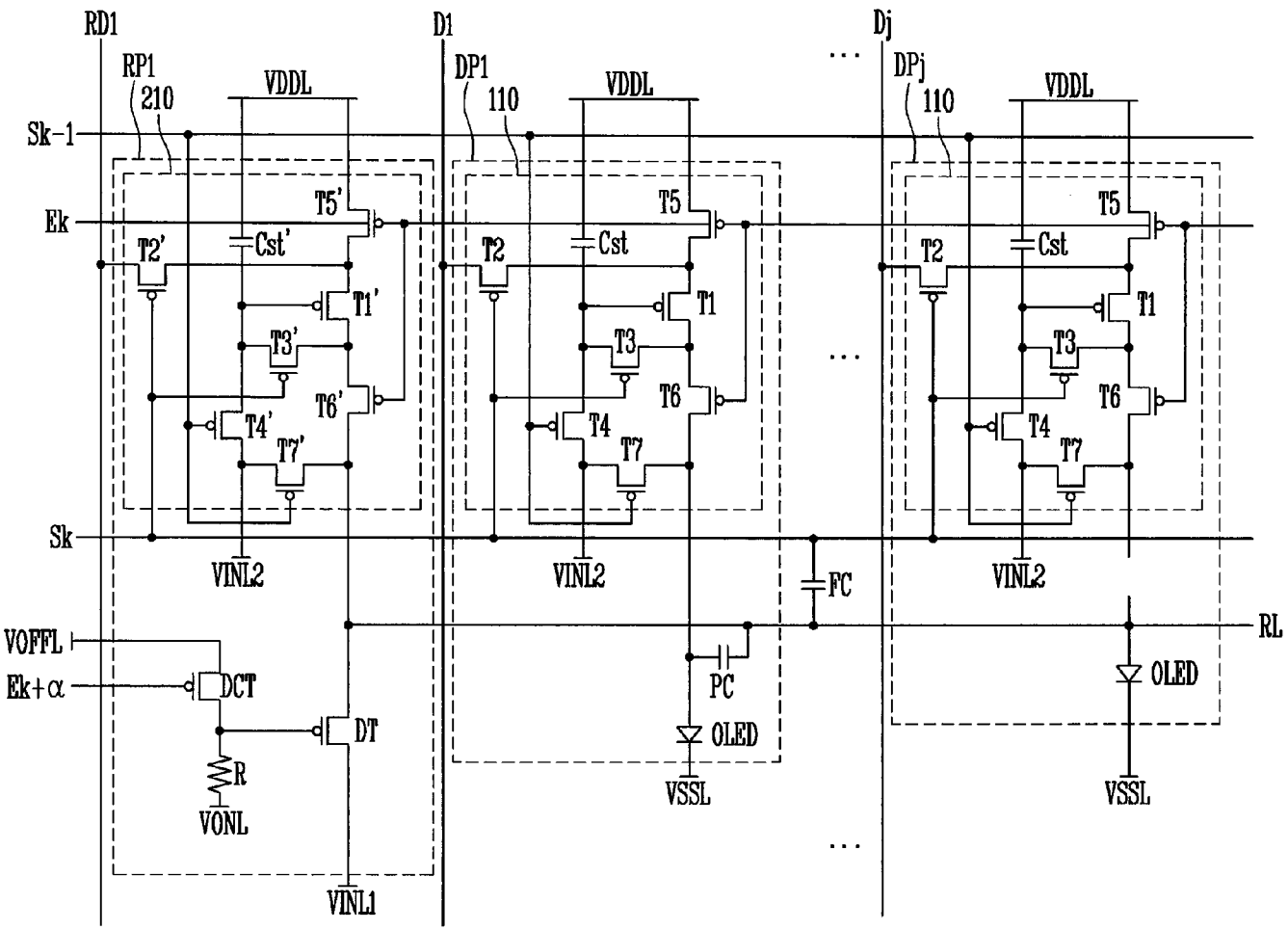
FIG. 10 is a detailed circuit diagram illustrating display pixels and an auxiliary pixel according to another exemplary embodiment of the present invention.

FIG. 10 is a detailed circuit diagram illustrating display pixels and an auxiliary pixel according to another exemplary embodiment of the present invention. For convenience of explanation, FIG. 10 illustrates only the $k-1^{th}$ and $k^{th}$ scan lines Sk−1 and Sk, the first auxiliary data line RD1, the first and $j^{th}$ data lines D1 and Dj, and the $k^{th}$ and $k+\alpha^{th}$ light emission control lines Ek and Ek+α. In addition, for convenience of explanation, FIG. 10 illustrates the first auxiliary pixel RP1 connected to the first auxiliary data line RD1, the first display pixel DP1 connected to the first data line D1, and the $j^{th}$ display pixel DPj connected to the $j^{th}$ data line Dj. In FIG. 10, it is shown as an example that a defect does not occur in the first display pixel DP1 during the manufacturing process, and a defect occurs in the $j^{th}$ display pixel DPj during the manufacturing process and is repaired.

With reference to FIG. 10, the first auxiliary pixel RP1 is connected to the $j^{th}$ display pixel DPj through the auxiliary line RL. The auxiliary line RL is connected to the first auxiliary pixel RP1 and extends from the first auxiliary pixel RP1 to the display area DA to cross the display pixels DP1 and DPj. More specifically, the auxiliary line RL may cross the anode electrodes of the organic light emitting diodes OLEDs of the display pixels DP1 and DPj as shown in FIG. 10.

The auxiliary line RL may be connected to the organic light emitting diode OLED of the $j^{th}$ display pixel DPj. In this example, the display pixel driver 110 and the organic light emitting diode OLED of the $j^{th}$ display pixel DPj may be disconnected.

Each of the display pixels DP1 and DPj includes the organic light emitting diode OLED and the display pixel driver 110. The display pixels DP1 and DPj as shown in FIG. 10 are substantially the same as the display pixels DP1 and DPj shown in FIG. 5. Thus, a detailed description of the display pixels DP1 and DPj shown in FIG. 10 is omitted.

The first auxiliary pixel RP1 includes the auxiliary pixel driver 210, the A transistor DT, the B transistor (or auxiliary control transistor) DCT, and the resistor R. The first auxiliary pixel RP1 does not include the organic light emitting diode OLED. The auxiliary pixel driver 210 of the first auxiliary pixel RP1 as shown in FIG. 10 is substantially the same as the auxiliary pixel driver 210 of the first auxiliary pixel RP1 as shown in FIG. 5. Thus, a detailed description of the auxiliary pixel driver 210 of the first auxiliary pixel RP1 shown in FIG. 10 is omitted.

The A transistor DT is connected to the first power voltage line VINL1 supplied to the auxiliary line RL and the first power voltage. The A transistor DT is turned on by the voltage supplied to the control electrode of the A transistor DT to connect the auxiliary line RL and the first power voltage line VINL1. Therefore, the voltage of the auxiliary line RL is discharged to the first power voltage. In other words, the A transistor DT functions to discharge the auxiliary line RL. The control electrode of the A transistor DT may be connected to the B transistor DCT and the resistor R, the first electrode thereof may be connected to the auxiliary line RL, and the second electrode thereof may be coupled to the first power voltage line VINL1.

The B transistor DCT is connected to the control electrode of the A transistor DT and the gate-off voltage line VOFFL to which the gate-off voltage is supplied. The B transistor DCT is turned on by the $k+\alpha^{th}$ a light emission control signal of the $k+\alpha^{th}$ light emission control line Ek+α to connect the control electrode of the A transistor DT and the gate-off voltage line VOFFL. The control electrode of the B transistor DCT is connected to the $k+\alpha^{th}$ light emission control line Ek+α, the first electrode is connected to the control electrode of the A transistor DT, and the second electrode thereof is connected to the gate-off voltage line VOFFL.

The resistor R may be formed between the control electrode of the A transistor DT and the gate-on voltage line VONL to which the gate-on voltage is supplied.

The signals supplied to the display pixels DP1 and DPj and the first auxiliary pixel RP1 as shown in FIG. 10 are substantially the same as those shown in FIG. 9. Hereinafter, a driving method of the first auxiliary pixel RP1 and the $j^{th}$ display pixel DPj and a driving method of the first display pixel DP1 are described in detail with reference to FIGS. 9 and 10.

First, the driving method of the first display pixel DP1 shown in FIGS. 9 and 10 is substantially the same as the driving method of the first display pixel DP1 shown in FIGS. 5 and 7. Thus, a detailed description of the driving method of the first display pixel DP1 shown in FIGS. 9 and 10 is omitted.

Subsequently, the driving method of the first auxiliary pixel RP1 and the $j^{th}$ display pixel DPj is described in detail.

In the first period t1, the $k-1^{th}$ scan signal SCANk−1 having a level of the gate-on voltage Von for part of the first period t1 is supplied to the $k-1^{th}$ scan line Sk−1, the $k^{th}$ light emission control signal EMk having a level of the gate-on voltage Von for all of the first period t1 is supplied to the $k^{th}$ light emission control line Ek, and the $k+1^{th}$ light emission control signal EMk+1 having a level of the gate-on voltage Von for all of the first period t1 is supplied to the $k+1^{th}$ light emission control line Ek+1, so that the fourth, fifth, sixth and seventh transistors T4', T5', T6', and T7' are turned on for all or part of the first period t1. In addition, since the B transistor DCT is turned on for the first period t1, the gate-off voltage is supplied to the control electrode of the A transistor DT, so that the A transistor DT is turned off.

Since the fourth transistor T4' is turned on, the control electrode of the first transistor T1' is initialized to the second power voltage VIN2 of the second power voltage line VINL2. Since the fifth to seventh transistors T5', T6', and T7' are turned on, a current path is formed so that current may flow from the third power voltage line VDDL to the second power voltage line VINL2 through the fifth transistor T5', the first transistor T1', the sixth transistor T6', and the seventh transistor T7'. Since the second power voltage VIN2 is set to be sufficiently lower than the third power voltage VDD, the voltage difference (Vgs=VIN2−VDD) between the control electrode and the first electrode of the first transistor T1' is less than the threshold voltage Vth of the first transistor T1' for the first period t1, so that current flows through the current path.

Thus, the on bias may be applied to the first transistor T1' by discharging the control electrode of the first transistor T1' to the second power voltage for the first period t1. As a result, according to an exemplary embodiment of the present invention, the on bias may be applied to the first transistor T1' before the data voltage is supplied to the control electrode of the first transistor T1', so that image quality degradation caused by the hysteresis characteristics of the first transistor T1' may be prevented (or reduced).

Second, the control electrode of the first transistor T1' and the auxiliary line RL are initialized to the second power voltage VIN2 for the second period t2.

For the second period t2, the $k-1^{th}$ scan signal SCANk−1 having a level of the gate-on voltage Von is supplied to the $k-1^{th}$ scan line Sk−1, the $k^{th}$ light emission control signal EMk having a level of the gate-off voltage Voff is supplied to the $k^{th}$ light emission control line Ek, and the $k+1^{th}$ light emission control signal EMk+1 having a level of the gate-on voltage Von is supplied to the $k+1^{th}$ light emission control line Ek+1. Therefore, the fourth transistor T4' and the seventh transistor T7' are turned on for the second period t2. In addition, since the B transistor DCT is turned on for the second period t2, the gate-off voltage is applied to the control electrode of the A transistor DT. Therefore, the A transistor DT is turned off.

Since the fourth transistor T4' is turned on, the control electrode of the first transistor T1' is initialized to the second power voltage VIN2 of the second power voltage line VINL2. Since the seventh transistor T7' is turned on, the auxiliary line RL is initialized to the second power voltage VIN2 of the second power voltage line VINL2.

Third, a data voltage and a threshold voltage of the control electrode of the first transistor T1' are sampled for the third period t3.

In the third period t3, the $k^{th}$ scan signal SCANk having a level of the gate-on voltage Von for part of the third period t3 is supplied to the $k^{th}$ scan line Sk, and the $k+1^{th}$ light emission control signal EMk+1 having a level of the gate-off voltage Voff for part of the third period t3 is supplied to the $k+1^{th}$ light emission control line Ek+1. Thus, the second and third transistors T2' and T3' are turned on for part of the third period t3. In addition, since the B transistor DCT is turned off for the third period t3, the gate-on voltage is supplied to the control electrode of the A transistor DT, so that the A transistor DT is turned on.

Since the second transistor T2' is turned on, the auxiliary data voltage Vdata of the auxiliary data line RD1 is supplied to the first electrode of the first transistor T1'. Since the third transistor T3' is turned on to connect the control electrode and the second electrode of the first transistor T1', the first transistor T1' is driven as a diode.

Since the voltage difference (Vgs=VIN2−Vdata) between the control electrode and the first electrode of the first transistor T1' is less than the threshold voltage Vth, current flows through the first transistor T1' until the voltage difference (Vgs) between the control electrode and the first electrode reaches the threshold voltage Vth of the first transistor T1'. Therefore, the voltage of the control electrode of the first transistor T1' increases to "Vdata+Vth" for the third period t3.

Since the A transistor DT is turned on, the auxiliary line RL is connected to the first power voltage line VINL1. Therefore, the auxiliary line RL is discharged to the first power voltage VIN1.

Fourth, for the fourth period t4, the sampling of the data voltage and the threshold voltage of the control electrode of the first transistor T1' is completed, and the auxiliary line RL is discharged to the first power voltage.

For the fourth period t4, the $k^{th}$ scan signal SCANk having a level of the gate-off voltage Voff is supplied to the $k^{th}$ scan line Sk, and the $k+1^{th}$ light emission control signal EMk+1 having a level of the gate-off voltage Voff is supplied to the k+1 th light emission control line Ek+1. Since the B transistor DCT is turned off for the fourth period t4, the gate-on voltage is supplied to the control electrode of the A transistor DT, so that the A transistor DT is turned on.

For the fourth period t4, "Vdata+Vth" corresponding to the voltage of the control electrode of the first transistor T1' is stored in the storage capacitor Cst.

Since the $k^{th}$ scan line Sk and the auxiliary line RL are formed next to each other, the fringe capacitance FC may be formed between the $k^{th}$ scan line Sk and the auxiliary line RL as shown in FIG. 10. Voltage variations of the $k^{th}$ scan line Sk may be reflected in the auxiliary line RL by the fringe capacitance FC. Therefore, when the $k^{th}$ scan signal SCANk increases from the gate-on voltage Von to the gate-off voltage Voff for the fourth period t4, the voltage variations of the $k^{th}$ scan line Sk may be reflected in the auxiliary line RL by the fringe capacitance FC, so that the voltage of the auxiliary line RL may be increased by ΔV1.

However, since the A transistor DT is turned on for the fourth period t4, the auxiliary line RL is connected to the first power voltage line VINL1. Therefore, even when the voltage variations of the $k^{th}$ scan line Sk are reflected in the auxiliary line RL by the fringe capacitance FC, the auxiliary line RL is discharged to the first power voltage VIN1.

Fifth, the auxiliary line RL is discharged to the first power voltage for the fifth period t5.

For the fifth period t5, the $k^{th}$ light emission control signal EMk having a level of the gate-on voltage Von is supplied to the $k^{th}$ light emission control line Ek, and the $k+1^{th}$ light emission control signal EMk+1 having a level of the gate-off voltage Voff is supplied to the $k+1^{th}$ light emission control line Ek+1, so that the fifth and sixth transistors T5' and T6' and the A transistor DT are turned on for the fifth period t5. In addition, since the B transistor DCT is turned off for the fifth period t5, the gate-on voltage is supplied to the control electrode of the A transistor DT. Therefore, the A transistor DT is turned on.

Since the fifth and sixth transistors T5' and T6' are turned on, the driving current Ids' flows through the first transistor T1 in response to the voltage of the control electrode thereof. The control electrode of the first transistor T1' maintains "Vdata+Vth" by the storage capacitor Cst. The driving current Ids' flowing through the first transistor T1' may be expressed by Equation 2. In addition, Equation 3 is derived from Equation 2.

As shown in Equation 3, the driving current Ids' does not depend on the threshold voltage Vth of the first transistor T1'. In other words, the threshold voltage Vth of the first transistor T1' is compensated.

Since the A transistor DT is turned on for the fifth period t5, the driving current Ids of the auxiliary pixel driver 210 is discharged to the first power voltage line VINL1 through the A transistor DT. Therefore, the organic light emitting diode OLED of the $j^{th}$ display pixel DPj does not emit light for the fifth period t5.

Since the auxiliary line RL overlaps with the anode electrodes of the organic light emitting diodes OLEDs of the display pixels DP1, the parasitic capacitance PC may be formed between the auxiliary line RL and the anode electrodes of the organic light emitting diodes OLEDs of the display pixels DP1 as shown in FIG. 10. Voltage variations of the anode electrodes of the organic light emitting diodes OLEDs may be reflected in the auxiliary line RL by the parasitic capacitance PC. Driving currents are supplied to the anode electrodes of the organic light emitting diodes OLEDs of the display pixels DP1 by the $k^{th}$ light emission control signal EMk having a level of the gate-on voltage Von for the fifth period t5. Therefore, the voltage variations of the anode electrodes of the organic light emitting diodes OLEDs of the display pixels DP1 may be reflected in the auxiliary line RL by the parasitic capacitance PC to increase the voltage of the auxiliary line RL by ΔV2. However, since the auxiliary line RL is connected to the first power voltage line VINL1 for the fifth period t5, the auxiliary line RL is discharged to the first power voltage VIN1 even when the voltage variations of the anode electrodes of the organic light emitting diodes OLEDs of the display pixels DP1 are reflected by the parasitic capacitances PC.

Sixth, the organic light emitting diode OLED emits light for the sixth period t6.

For the sixth period t6, the $k^{th}$ light emission control signal EMk having a level of the gate-on voltage Von is supplied to the $k^{th}$ light emission control line Ek, and the k+1 light emission control signal EMk+1 having a level of the gate-on voltage Von is supplied to the $k+1^{th}$ light emission control line Ek+1, so that the fifth and sixth transistors T5' and T6' are turned on for the sixth period t6. In addition, since the B transistor DCT is turned on for the sixth period t6, the gate-off voltage is supplied to the control electrode of the A transistor DT, so that the A transistor DT is turned off.

Since the A transistor DT is turned off and the fifth and sixth transistors T5' and T6' are turned on, the driving current Ids' of the auxiliary pixel driver 210 flows through the organic light emitting diode OLED of the $j^{th}$ display pixel DPj through the auxiliary line RL. Therefore, the organic light emitting diode OLED of the $j^{th}$ display pixel DPj emits light.

As described above, according to an exemplary embodiment of the present invention, the voltage of the auxiliary line RL may be prevented (or protected) from being changed by the parasitic capacitances PC and the fringe capacitance FC. As a result, according to an exemplary embodiment of the present invention, the organic light emitting diode OLED of the $j^{th}$ display pixel DPj may be prevented (or protected)

from emitting light in error by the parasitic capacitances PC and the fringe capacitance FC.

Figure 11:
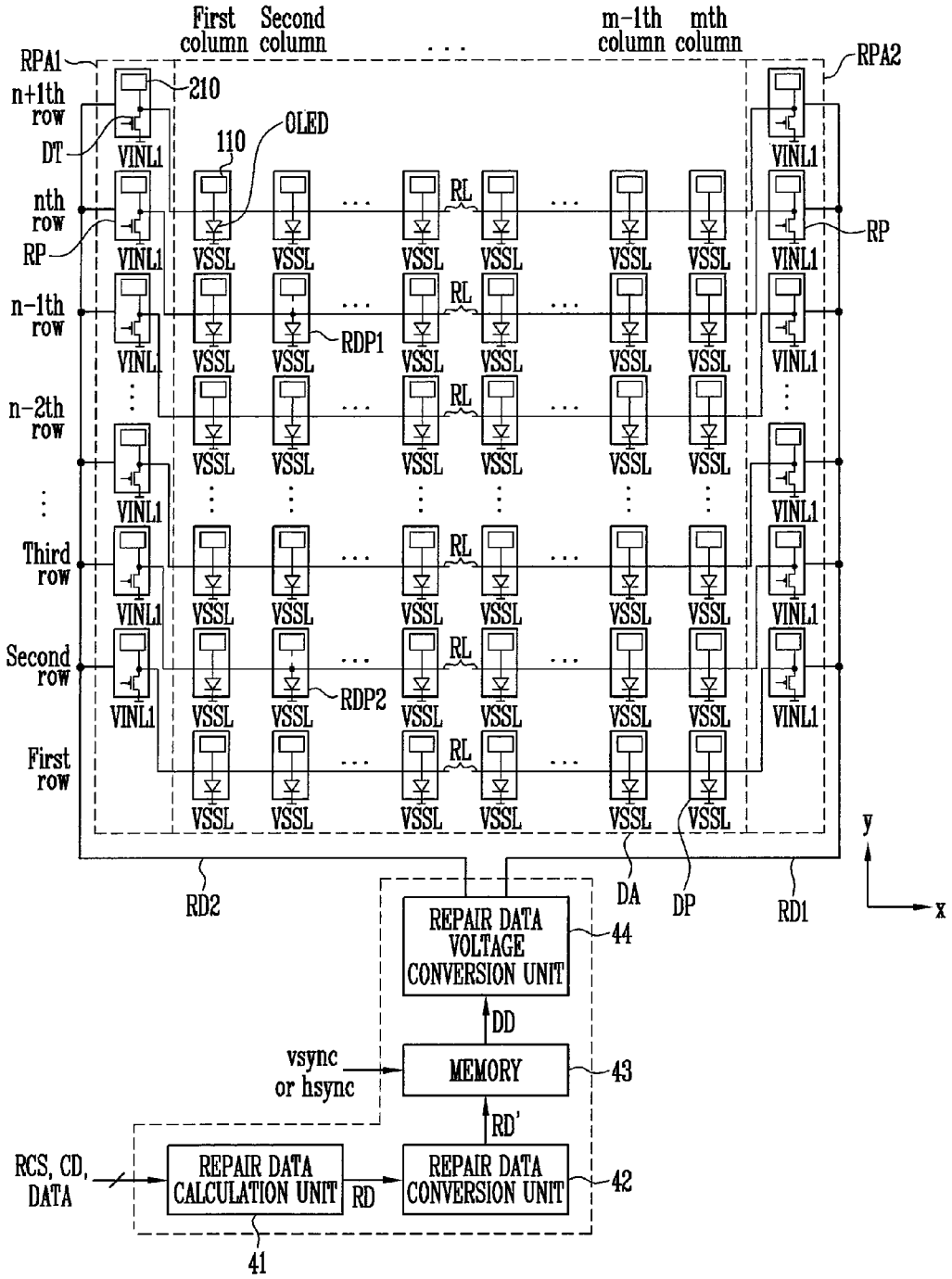
FIG. 11 is a detailed block diagram illustrating display pixels, auxiliary pixels, auxiliary lines, auxiliary data lines and a second data driver according to another exemplary embodiment of the present invention.

FIG. 11 is a detailed block diagram illustrating display pixels, auxiliary pixels, auxiliary lines, auxiliary data lines, and a second data driver according to another exemplary embodiment of the present invention. For convenience of explaining display panel 10, FIG. 11 illustrates only the display pixels DP, the auxiliary pixels RP, the auxiliary lines RL, the auxiliary data lines RD1 and RD2, and the second data driver 40.

The display pixels DP, the auxiliary pixels RP, and the auxiliary data lines RD1 and RD2 shown in FIG. 11 are substantially the same as the display pixels DP, the auxiliary pixels RP, and the auxiliary data lines RD1 and RD2 shown in FIG. 2, respectively. Therefore, a detailed description of the display pixels DP, the auxiliary pixels RP, and the auxiliary data lines RD1 and RD2 shown in FIG. 11 is omitted.

The auxiliary line RL is connected to the auxiliary pixel RP and extends from the auxiliary pixel RP to the display area DA to cross the display pixels DP. For example, the auxiliary line RL is connected to the auxiliary pixel RP in a $p+\beta^{th}$ row (where β is a positive integer) and crosses the display pixels DP in a $p^{th}$ row. FIG. 11 illustrates a $p+1^{th}$ row as the $p+\beta^{th}$ row. The auxiliary line RL may cross the anode electrodes of the organic light emitting diodes OLEDs of the display pixels DP.

The auxiliary line RL may be connected to one of the display pixels DP of the display area DA. The display pixel DP connected to the auxiliary line RL corresponds to a defective pixel to be repaired. In FIG. 11, the display pixel DP connected to the auxiliary line RL is defined as the repaired pixel RDP1/RDP2. More specifically, the auxiliary line RL may be connected to the anode electrode of the organic light emitting diode OLED of the repaired pixel RDP1/RDP2. The display pixel driver 110 and the organic light emitting diode OLED of the repaired pixel RDP1/RDP2 are disconnected from each other.

The second data driver 40 includes the auxiliary data output unit 41, the auxiliary data conversion unit 42, the memory 43 and the auxiliary data voltage conversion unit 44. The auxiliary data output unit 41, the auxiliary data conversion unit 42, the memory 43 and the auxiliary data voltage conversion unit 44 as shown in FIG. 11 are substantially the same as the auxiliary data output unit 41, the auxiliary data conversion unit 42, the memory 43 and the auxiliary data voltage conversion unit 44 of the second data driver 40 described above in connection with FIGS. 2 and 3, respectively. Therefore, a detailed description of the auxiliary data output unit 41, the auxiliary data conversion unit 42, the memory 43 and the auxiliary data voltage conversion unit 44, shown in FIG. 11, is omitted.

However, since the auxiliary line RL is connected to the auxiliary pixel RP in a $p+\beta^{th}$ is row (where β is a positive integer) and crosses the display pixels DP in a $p^{th}$ row, the auxiliary data voltage conversion unit 44 delays auxiliary data voltages by a β horizontal period and supplies the delayed auxiliary data voltages to the auxiliary data lines RD1 and RD2. In other words, the auxiliary data voltage supplied to the auxiliary pixel RP in the $p+\beta^{th}$ row is supplied in synchronization with the data voltages supplied to the display pixels DP in the $p^{th}$ row.

Figure 12A:
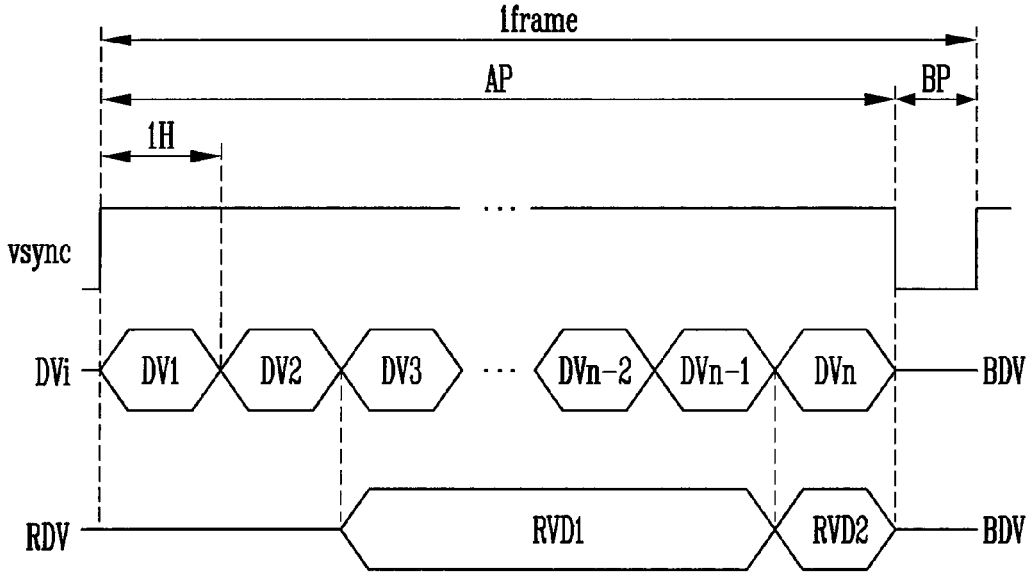
FIGS. 12A and 12B are exemplary views illustrating data voltages output from a first data driver of FIG. 11 and auxiliary data voltages output from an auxiliary data voltage conversion unit of a second data driver shown in FIG. 11.

FIG. 12A is an exemplary view of data voltages output from the first data driver shown in FIG. 11 and auxiliary data voltages output from the auxiliary data voltage conversion unit of the second data driver shown in FIG. 11.

FIG. 12A illustrates the vertical synchronization signal vsync, the data voltages DVi output to an $i^{th}$ data line Di (where i is a positive integer satisfying $1 \le i \le m$), and the auxiliary data voltages RDV output from the auxiliary data voltage conversion unit 44.

Referring to FIG. 12A, one frame period (1 frame) includes the active period AP for which the data voltages are supplied and the blank period BP which is a pause period. The vertical synchronization signal vsync generates a pulse at each one frame period (1 frame). The data voltages DVi output to the $i^{th}$ data line Di may include the first to $n^{th}$ data voltages DV1 to DVn. As illustrated in FIG. 11, the auxiliary data voltage supplied to the auxiliary pixel RP in the $p+\beta^{th}$ row may be supplied in synchronization with the data voltages supplied to the display pixels DP in the $p^{th}$ row.

As shown in FIG. 11, the first repaired pixel RDP1 may be located in the second row, and the second repaired pixel RDP2 may be located in the $n-1^{th}$ row. In this example, as shown in FIG. 12A, according to data in the memory 43, the first auxiliary data voltage RDV1 may be supplied to the auxiliary data line RD1/RD2 in synchronization with a period for which the data voltage DV3 is supplied to the $i^{th}$ data line Di in the display pixel in the third row. In addition, as shown in FIG. 12A, according to data in the memory 43, the first auxiliary data voltage RDV1 may be supplied to the auxiliary data line RD1/RD2 in synchronization with a period for which the data voltage DVn is supplied to the $i^{th}$ data line Di in the display pixel in the $n^{th}$ row.

When the signal indicating the predetermined period is the vertical synchronization signal vsync, the memory 43 is updated with the initialization data BD at each one frame period. Therefore, as illustrated in FIG. 12A, the auxiliary data voltage conversion unit 44 may receive first auxiliary data RD1 from the memory 43 for a period from when the data voltage DV3 is supplied to the display pixel in the third row to when the data voltage DVn−1 is supplied to the display pixel in the $n-1^{th}$ row. Subsequently, the auxiliary data voltage conversion unit 44 may convert the input first auxiliary data RD1 into the first auxiliary data voltage RDV1 and output the first auxiliary data voltage RDV1 to the auxiliary data line RD1/RD2.

In addition, as shown in FIG. 12A, the auxiliary data voltage conversion unit 44 may receive the second auxiliary data RD2 from the memory 43 for a period in which the data voltage DVn is supplied to the display pixel in the $n^{th}$ row, convert the second auxiliary data RD2 into the second auxiliary data voltage RDV2, and output the second auxiliary data voltage RDV2 to the auxiliary data line RD1/RD2. Further, as shown in FIG. 12A, the auxiliary data voltage conversion unit 44 may receive the initialization data BD from the memory 43 for a period in which the data voltages DV1 and DV2 are supplied to the display pixels in the first and second rows, convert the input initialization data BD into the initialization data voltage BDV, and output the initialization data voltage BDV to the auxiliary data line RD1/RD2.

As a result, as described above with reference to FIG. 12A, the auxiliary data voltages supplied to the auxiliary data lines RD1 and RD2 may be supplied in synchronization with the data voltages supplied to the data lines D1 to Dm.

Figure 12B:
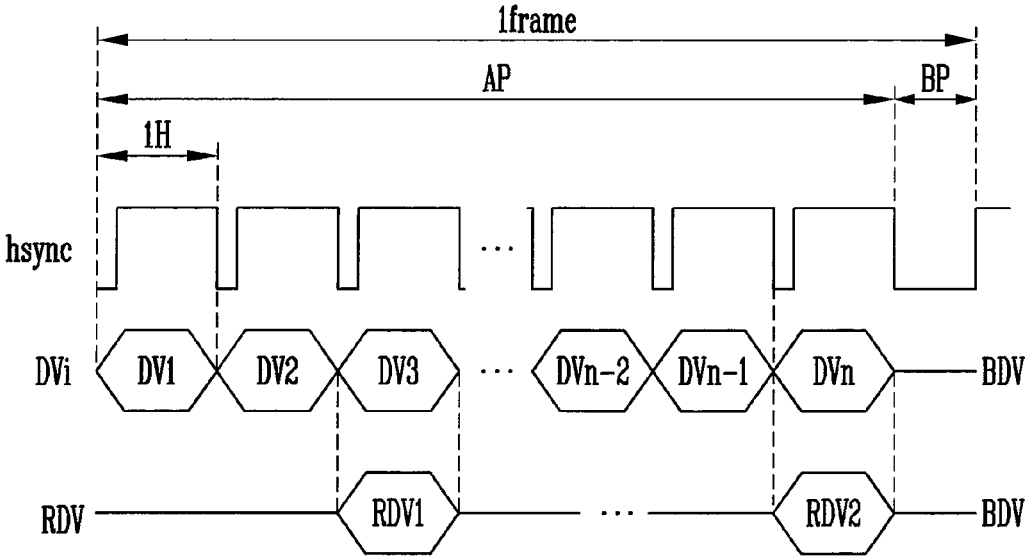

FIG. 12B is an exemplary view of data voltages output from the first data driver shown in FIG. 11 and auxiliary data voltages output from the auxiliary data voltage conversion unit of the second data driver shown in FIG. 11. FIG. 12B illustrates the horizontal synchronization signal hsync, the data voltages DVi output to the $i^{th}$ data line Di and the auxiliary data voltages RDV output from the auxiliary data voltage conversion unit 44.

Referring to FIG. 12B, one frame period (1 frame) includes the active period AP for which the data voltages are supplied and the blank period BP which is a pause period. The vertical synchronization signal vsync generates a pulse at each one frame period (1 frame). The data voltages DVi output to the $i^{th}$ data line Di may include the first to $n^{th}$ data voltages DV1 to DVn. As illustrated in FIG. 11, the auxiliary data voltage supplied to the auxiliary pixel RP in the $p+\beta^{th}$ row may be supplied in synchronization with the data voltages supplied to the display pixels DP in the $p^{th}$ row.

As shown in FIG. 11, the first repaired pixel RDP1 may be located in the second row, and the second repaired pixel RDP2 may be located in the $n-1^{th}$ row. In this example, as shown in FIG. 12B, according to data in the memory 43, the first auxiliary data voltage RDV1 may be supplied to the auxiliary data line RD1/RD2 in synchronization with a period for which the data voltage DV3 is supplied to the $i^{th}$ data line Di in the display pixel in the third row. In addition, as shown in FIG. 12B, according to data in the memory 43, the second auxiliary data voltage RDV2 may be supplied to the auxiliary data line RD1/RD2 in synchronization with a period for which the data voltage DVn is supplied to the $i^{th}$ data line Di in the display pixel in the $n^{th}$ row.

When the signal indicating the predetermined period is the vertical synchronization signal vsync, the memory 43 is updated with the initialization data BD at each one horizontal period 1H. Therefore, as shown in FIG. 12B, the auxiliary data voltage conversion unit 44 may receive the first auxiliary data RD1 from the memory 43 for the period in which the data voltage DV3 is supplied to the display pixel in the third row, convert the input first auxiliary data RD1 into the first auxiliary data voltage RDV1, and output the first auxiliary data voltage RDV1 to the auxiliary data line RD1/RD2.

In addition, as shown in FIG. 12B, the auxiliary data voltage conversion unit 44 may receive the second auxiliary data RD2 from the memory 43 for a period in which the data voltage DVn is supplied to the display pixel in the $n^{th}$ row, convert the second auxiliary data RD2 into the second auxiliary data voltage RDV2, and output the second auxiliary data voltage RDV2 to the auxiliary data line RD1/RD2. Further, as shown in FIG. 12B, the auxiliary data voltage conversion unit 44 may receive the initialization data BD from the memory 43, convert the input initialization data BD into the initialization data voltage BDV and output the initialization data voltage BDV to the auxiliary data line RD1/RD2 for periods except the period for which the data voltage DV3 is supplied to the display pixel in the third row and the period for which the data voltage DVn is supplied to the display pixel in the $n^{th}$ row.

As a result, as described above in connection with FIG. 12B, each of the auxiliary data voltages supplied to the auxiliary data lines RD1 and RD2 may be supplied in synchronization with the data voltages supplied to the data lines D1 to Dm.

In addition, as described above with reference to FIG. 12B, the initialization data voltage BDV may be supplied to auxiliary pixels which are not connected to the repaired pixels RDP1 and RDP2. As a result, according to an exemplary embodiment of the present invention, the display pixels DP in the display area may be prevented (or protected) from being affected by voltage variations in auxiliary lines connected to the auxiliary pixels which are not connected to the repaired pixels RDP1 and RDP2. In other words, the voltage of the auxiliary line RL may be prevented (or protected) from being changed by the driving current which may be supplied to the auxiliary line RL when the auxiliary data voltage is supplied to the auxiliary pixel RP.

Figure 13:
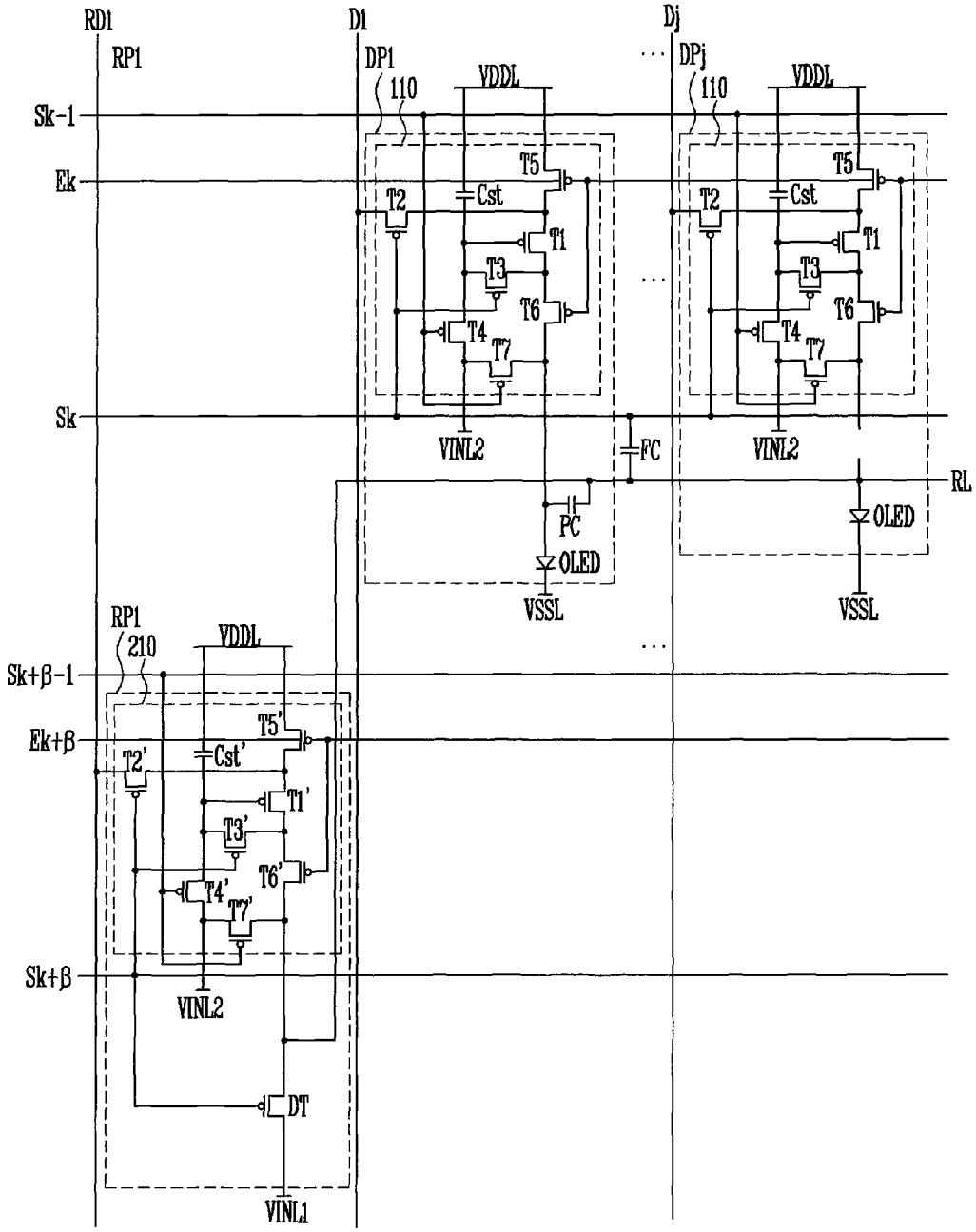
FIG. 13 is a detailed circuit diagram of display pixels and an auxiliary pixel according to another exemplary embodiment of the present invention.

FIG. 13 is a detailed circuit diagram illustrating display pixels and an auxiliary pixel according to another exemplary embodiment of the present invention. For convenience of explanation, FIG. 13 illustrates only $k-1^{th}$, $k^{th}$, $k+\beta-1^{th}$ and $k+\beta^{th}$ scan lines Sk−1, Sk, Sk+β−1 and Sk+β, the first auxiliary data line RD1, first and $j^{th}$ data lines D1 and Dj, and $k^{th}$ and $k+\beta^{th}$ light emission control lines Ek and Ek+β. In addition, as shown in FIG. 11, the auxiliary line RL is connected to an auxiliary pixel in the $p+\beta^{th}$ row and crosses display pixels DP in the $p^{th}$ row. Thus, for convenience of explanation, FIG. 13 illustrates the first auxiliary pixel RP1 located in the $p+\beta^{th}$ row and the first display pixel DP1 and the $j^{th}$ display pixel DPj located in the $p^{th}$ row. The first auxiliary pixel RP1 is connected to the $k+\beta-1^{th}$ and $k+\beta^{th}$ scan lines Sk+β−1 and Sk+β, the $k+\beta^{th}$ light emission control line Ek+β, and the first auxiliary data line RD1. The first display pixel DP1 is connected to the $k-1^{th}$ and $k^{th}$ scan lines Sk−1 and Sk, the $k^{th}$ light emission control line Ek, and the first data line D1. The $j^{th}$ display pixel DPj is connected to the $k-1^{th}$ and $k^{th}$ scan lines Sk−1 and Sk, the $k^{th}$ light emission control line Ek, and the $j^{th}$ data line Dj. In FIG. 13, it is shown as an example that a defect does not occur in the first display pixel DP1 during the manufacturing process, and a defect occurs in the $j^{th}$ display pixel DPj during the manufacturing process and is repaired.

Referring to FIG. 13, the first auxiliary pixel RP1 is connected to the $j^{th}$ display pixel DPj through the auxiliary line RL. The auxiliary line RL may be connected to the first auxiliary pixel RP1 and extends from the first auxiliary pixel RP1 to the display area DA to cross the display pixels DP1 and DPj. More specifically, as shown in FIG. 13, the auxiliary line RL may cross the anode electrodes of the organic light emitting diodes OLEDs of the display pixels DP1 and DPj.

The auxiliary line RL may be connected to the organic light emitting diode OLED of the $j^{th}$ display pixel DPj. In this example, the display pixel driver 110 and the organic light emitting diode OLED of the $j^{th}$ display pixel DPj may be disconnected from each other.

Each of the display pixels DP1 and DPj includes the organic light emitting diode OLED and the display pixel driver 110. The display pixels DP1 and DPj shown in FIG. 13 are substantially the same as the display pixels DP1 and DPj illustrated in FIG. 5, respectively. Thus, a detailed description of the display pixels DP1 and DPj illustrated in FIG. 13 is omitted.

The first auxiliary pixel RP1 includes the auxiliary pixel driver 210 and the A transistor DT. The first auxiliary pixel RP1 does not include the organic light emitting diode OLED. The auxiliary pixel driver 210 of the first auxiliary pixel RP1 shown in FIG. 13 is substantially the same as the auxiliary pixel driver 210 of the first auxiliary pixel RP1 shown in FIG. 5, except that the auxiliary pixel driver 210 of the first auxiliary pixel RP1 shown in FIG. 13 is connected to the $k+\beta-1^{th}$ and $k+\beta^{th}$ scan lines Sk+β−1 and Sk+β and the $k+\beta^{th}$ light emission control line Ek+β, instead of the $k-1^{th}$ and $k^{th}$ scan lines Sk−1 and Sk and the $k^{th}$ light emission control line Ek. Thus, a detailed description of the auxiliary pixel driver 210 of the first auxiliary pixel RP1 is omitted.

The A transistor DT is connected to the auxiliary line RL and the first power voltage line VINL1 to which the first power voltage is supplied. The A transistor DT is turned on by the voltage supplied to the control electrode of the A transistor DT to connect the auxiliary line RL and the first power voltage line VINL1, so that the voltage of the auxiliary line RL is discharged to the first power voltage. In other words, the A transistor DT functions to discharge the auxiliary line RL. The control electrode of the A transistor DT may be connected to the k+$\beta^{th}$ scan line Sk+β, the first electrode thereof may be connected to the auxiliary line RL, and the second electrode thereof may be connected to the first power voltage line VINL1.

Figure 14:
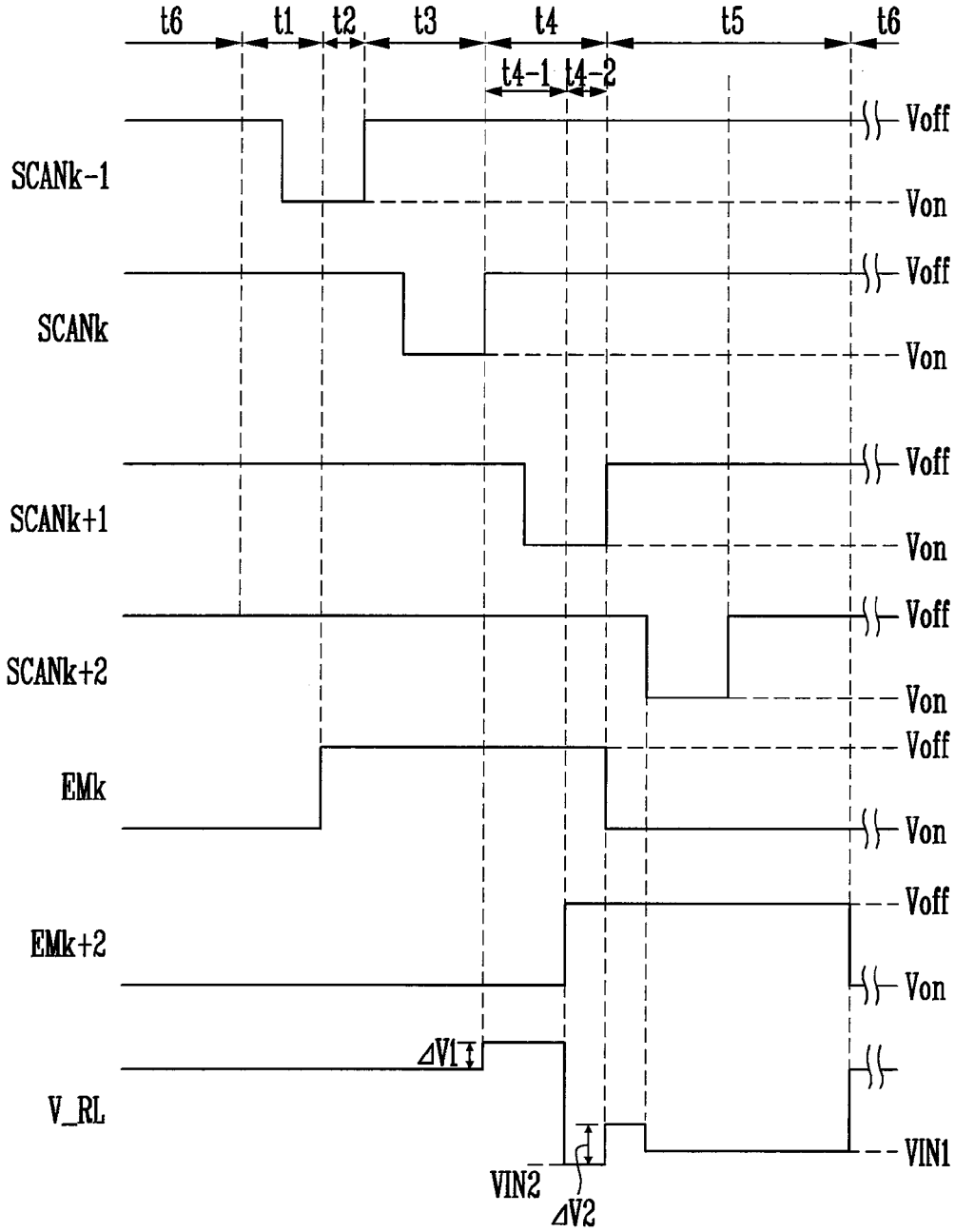
FIG. 14 is a waveform diagram of signals supplied to display pixels and an auxiliary pixel shown in FIG. 13, a voltage of the control electrode of a discharge transistor, and a voltage of an auxiliary line.

FIG. 14 is a waveform view of signals supplied to the display pixels and the auxiliary pixels as shown in FIG. 13, a voltage of the control electrode of the discharge transistor, and a voltage of the auxiliary line. FIG. 14 illustrates the k−1$^{th}$ scan signal SCANk−1 supplied to the k−1$^{th}$ scan line Sk−1, the k$^{th}$ scan signal SCANk supplied to the k$^{th}$ scan line Sk, the k+1$^{th}$ scan signal SCANk+1 supplied to the k+1$^{th}$ scan line Sk+1, the k+2$^{th}$ scan signal SCANk+2 supplied to the k+2$^{th}$ scan line Sk+2, the k$^{th}$ light emission control signal EMk supplied to the k$^{th}$ light emission control line Ek, the k+2$^{th}$ light emission control signal EMk+2 supplied to the k+2$^{th}$ light emission control line Ek+2, the voltage (V_DTG, or SCANk+2) of the control electrode of the A transistor DT, and the voltage (V_RL) of the auxiliary line RL. FIG. 14 illustrates the k+1$^{th}$ scan line Sk+1, the k+2$^{th}$ scan line Sk+2, and the k+2$^{th}$ light emission control line Ek+2 as examples of the k+β−1$^{th}$ scan line Sk+β−1, the k+β$^{th}$ scan line Sk+β, and the k+β$^{th}$ light emission control line Ek+β, shown in FIG. 13, respectively. However, the present invention is not limited thereto.

The k−1$^{th}$ scan signal SCANk−1, the k$^{th}$ scan signal SCANk, and the k$^{th}$ light emission control signal EMk as shown in FIG. 14 are substantially the same as the k−1$^{th}$ scan signal SCANk−1, the k$^{th}$ scan signal SCANk, and the k$^{th}$ light emission control signal EMk shown in FIG. 7, respectively. Therefore, a detailed description of the k−1$^{th}$ scan signal SCANk−1, the k$^{th}$ scan signal SCANk, and the k$^{th}$ light emission control signal EMk shown in FIG. 14 is omitted.

The k+1$^{th}$ scan signal SCANk+1 is generated to have a level of the gate-on voltage Von for part of the fourth period t4, and the k+2$^{th}$ scan signal SCANk+2 is generated to have a level of the gate-on voltage Von for part of the fifth period t5. The k+2$^{th}$ light emission control signal EMk+2 is generated to have a level of the gate-off voltage Voff for 4-2$^{nd}$ and fifth periods t4-2 and t5.

Hereinafter, a driving method of the first auxiliary pixel RP1 and the j$^{th}$ display pixel DPj and a driving method of the first display pixel DP1 are described in detail with reference to FIGS. 13 and 14.

First, the driving method of the first display pixel DP1 as shown in FIGS. 13 and 14 is substantially the same as the driving method of the first display pixel DP1 as shown in FIGS. 5 and 7. Therefore, the driving method of the first display pixel DP1 is omitted.

Subsequently, the driving method of the first auxiliary pixel RP1 and the j$^{th}$ display pixel DPj is described in detail.

First, the organic light emitting diode OLED emits light for the first to third periods t1 to t3.

For the first to third periods t1 to t3, the k+1$^{th}$ scan signal SCANk+1 having a level of the gate-off voltage Voff is supplied to the k+1$^{th}$ scan line Sk+1, the k+2$^{th}$ scan signal SCANk+2 having a level of the gate-off voltage Voff is supplied to the k+2$^{th}$ scan line Sk+2, and the k+2$^{th}$ light emission control signal EMk+2 having a level of the gate-on voltage Von is supplied to the k+2$^{th}$ light emission control line Ek+2. Therefore, the fifth and sixth transistors T5' and T6' are turned on for the first to third periods t1 to t3.

Since the fifth and sixth transistors T5' and T6' are turned on, the driving current Ids' of the auxiliary pixel driver 210 is supplied to the organic light emitting diode OLED of the j$^{th}$ display pixel DPj through the auxiliary line RL. Therefore, the organic light emitting diode OLED of the j$^{th}$ display pixel DPj emits light.

Second, an on bias is applied to the first transistor T1 for a 4-1$^{st}$ period t4-1. The fourth period t4 includes the 4-1$^{st}$ period t4-1 and the 4-2$^{nd}$ period t4-2.

The k+1$^{th}$ scan signal SCANk+1 having a level of the gate-on voltage Von for part of the 4-1$^{st}$ period t4-1 is supplied to the k+1$^{th}$ scan line Sk+1, and the k+2$^{th}$ light emission control signal EMk+2 having a level of the gate-on voltage Von for all of the 4-1$^{st}$ period t4-1 is supplied to the k+2$^{th}$ light emission control line Ek+2, so that the fourth, fifth, sixth and seventh transistors T4', T5', T6', and T7' are turned on for part or all of the 4-1$^{st}$ period t4-1.

Since the fourth transistor T4' is turned on, the control electrode of the first transistor T1' is initialized to the second power voltage VIN2 of the second power voltage line VINL2. Since the fifth, sixth and seventh transistors T5', T6', and T7' are turned on, a current path is formed so that current may flow from the third power voltage line VDDL to the second power voltage line VINL2 through the fifth transistor T5', the first transistor T1', the sixth transistor T6', and the seventh transistor T7'. Since the second power voltage VIN2 is set to be sufficiently lower than the third power voltage VDD, a voltage difference (Vgs=VIN2−VDD) between the control electrode and the first electrode of the first transistor T1' is less than the threshold voltage Vth of the first transistor T1' for the 4-1$^{st}$ period t4-1, so that current flows through the current path.

Therefore, the control electrode of the first transistor T1' may be discharged to the second power voltage for the 4-1$^{st}$ period t4-1, so that the on bias may be applied to the first transistor T1'. As a result, according to an exemplary embodiment of the present invention, the on bias may be applied to the first transistor T1' before the data voltage is supplied to the control electrode of the first transistor T1'. Therefore, image quality degradation caused by hysteresis characteristics of the first transistor T1' may be prevented (or reduced).

Since the k$^{th}$ scan line Sk and the auxiliary line RL are formed next to each other, the fringe capacitance FC may be formed between the k$^{th}$ scan line Sk and the auxiliary line RL as illustrated in FIG. 13. Voltage variations of the k$^{th}$ scan line Sk may be reflected in the auxiliary line RL by the fringe capacitance FC. Therefore, when the k$^{th}$ scan signal SCANk increases from the gate-on voltage Von to the gate-off voltage Voff for the 4-1$^{st}$ period t4-1, the changes in voltage of the k$^{th}$ scan line Sk may be reflected by the fringe capacitance FC, so that the voltage of the auxiliary line RL may be increased by ΔV1.

Third, the control electrode of the first transistor T1' and the auxiliary line RL are initialized to the second power voltage VIN2 for the 4-2$^{nd}$ period t4-2.

For the 4-2$^{nd}$ period t4-2, the k+1$^{th}$ scan signal SCANk+1 having a level of the gate-on voltage Von is supplied to the k+1$^{th}$ scan line Sk+1, and the k+2$^{th}$ light emission control signal EMk+2 having a level of the gate-off voltage Voff is supplied to the k+2$^{th}$ light emission control line Ek+2, so that the fourth transistor T4' and the seventh transistor T7' are turned on for the 4-2$^{nd}$ period t4-2.

Since the fourth transistor T4' is turned on, the control electrode of the first transistor T1' is initialized to the second power voltage VIN2 of the second power voltage line VINL2. Since the seventh transistor T7' is turned on, the auxiliary line RL is initialized to the second power voltage VIN2 of the second power voltage line VINL2.

Fourth, for the fifth period t5, a data voltage and a threshold voltage of the control electrode of the first transistor T1' are sampled, and the auxiliary line RL is discharged to the first power voltage VIN1.

In the fifth period t5, the $k+2^{th}$ scan signal SCANk+2 having a level of the gate-on voltage Von for part of the fifth period t5 is supplied to the $k+2^{th}$ scan line Sk+2, and the $k+2^{th}$ light emission control signal EMk+2 having a level of the gate-off voltage Voff for all of the fifth period t5 is supplied to the $k+2^{th}$ light emission control line Ek+2, so that the second and third transistors T2' and T3' and the A transistor DT are turned on for all or part of the fifth period t5.

Since the second transistor T2' is turned on, the data voltage Vdata of the first data line D1 is supplied to the first electrode of the first transistor T1'. Since the third transistor T3' is turned on, the control electrode and the second electrode of the first transistor T1' are connected. Therefore, the first transistor T1' is driven as a diode.

Since the voltage difference (Vgs=VIN2−Vdata) between the control electrode and the first electrode of the first transistor T1' is less than the threshold voltage Vth, current flows through the first transistor T1' until the voltage difference (Vgs) between the control electrode and the first electrode reaches the threshold voltage Vth of the first transistor T1'. Therefore, the voltage of the control electrode of the first transistor T1' increases to "Vdata+Vth" for the third period t3.

Since the A transistor DT is turned on, the auxiliary line RL is connected to the first power voltage line VINL1. Therefore, the auxiliary line RL is discharged to the first power voltage VIN1.

Since the auxiliary line RL overlaps with the anode electrodes of the organic light emitting diodes OLEDs of the display pixels DP1, the parasitic capacitance PC may be formed between the auxiliary line RL and the anode electrodes of the organic light emitting diodes OLEDs of the display pixels DP1 as shown in FIG. 13. Voltage variations of the anode electrodes of the organic light emitting diodes OLEDs may be reflected in the auxiliary line RL by the parasitic capacitance PC. Driving currents are supplied to the anode electrodes of the organic light emitting diodes OLEDs of the display pixels DP1 by the $k^{th}$ light emission control signal EMk having a level of the gate-on voltage Von for the fifth period t5. Therefore, the voltage variations of the anode electrodes of the organic light emitting diodes OLEDs of the display pixels DP1 may be reflected in the auxiliary line RL by the parasitic capacitance PC, so that the voltage of the auxiliary line RL may be increased by ΔV2. However, since the auxiliary line RL is connected to the first power voltage line VINL1 for the fifth period t5, the auxiliary line RL is discharged to the first power voltage VIN1 even when the voltage variations of the anode electrodes of the organic light emitting diodes OLEDs of the display pixels DP1 are reflected by the parasitic capacitance PC.

Sixth, the organic light emitting diode OLED emits light for the sixth period t6.

For the sixth period t6, the $k+2^{th}$ scan signal SCANk+2 having a level of the gate-off voltage Voff is supplied to the $k+2^{th}$ scan line Sk+2, and the $k+2^{th}$ light emission control signal EMk+2 having a level of the gate-on voltage Von is supplied to the $k+2^{th}$ light emission control line Ek+2, so that the fifth and sixth transistors T5' and T6' are turned on and the A transistor DT is turned off for the sixth period t6.

Since the A transistor DT is turned off and the fifth and sixth transistors T5' and T6' are turned on, the driving current Ids' of the auxiliary pixel driver 210 is supplied to the organic light emitting diode OLED of the $j^{th}$ display pixel DPj through the auxiliary line RL. Therefore, the organic light emitting diode OLED of the $j^{th}$ display pixel DPj emits light.

The control electrode of the first transistor T1' maintains "Vdata+Vth" by the storage capacitor Cst. The driving current Ids' flowing through the first transistor T1' may be expressed by Equation 2. In addition, Equation 3 is derived from Equation 2.

As shown in Equation 3, the driving current Ids' does not depend on the threshold voltage Vth of the first transistor T1'. In other words, the threshold voltage Vth of the first transistor T1' is compensated.

As described above, according to an exemplary embodiment of the present invention, the voltage of the auxiliary line RL may be prevented (or protected) from being changed due to the parasitic capacitances PC and the fringe capacitance FC. Therefore, according to an exemplary embodiment of the present invention, the organic light emitting diode OLED may be prevented (or protected) from emitting light in error.

Figure 15:
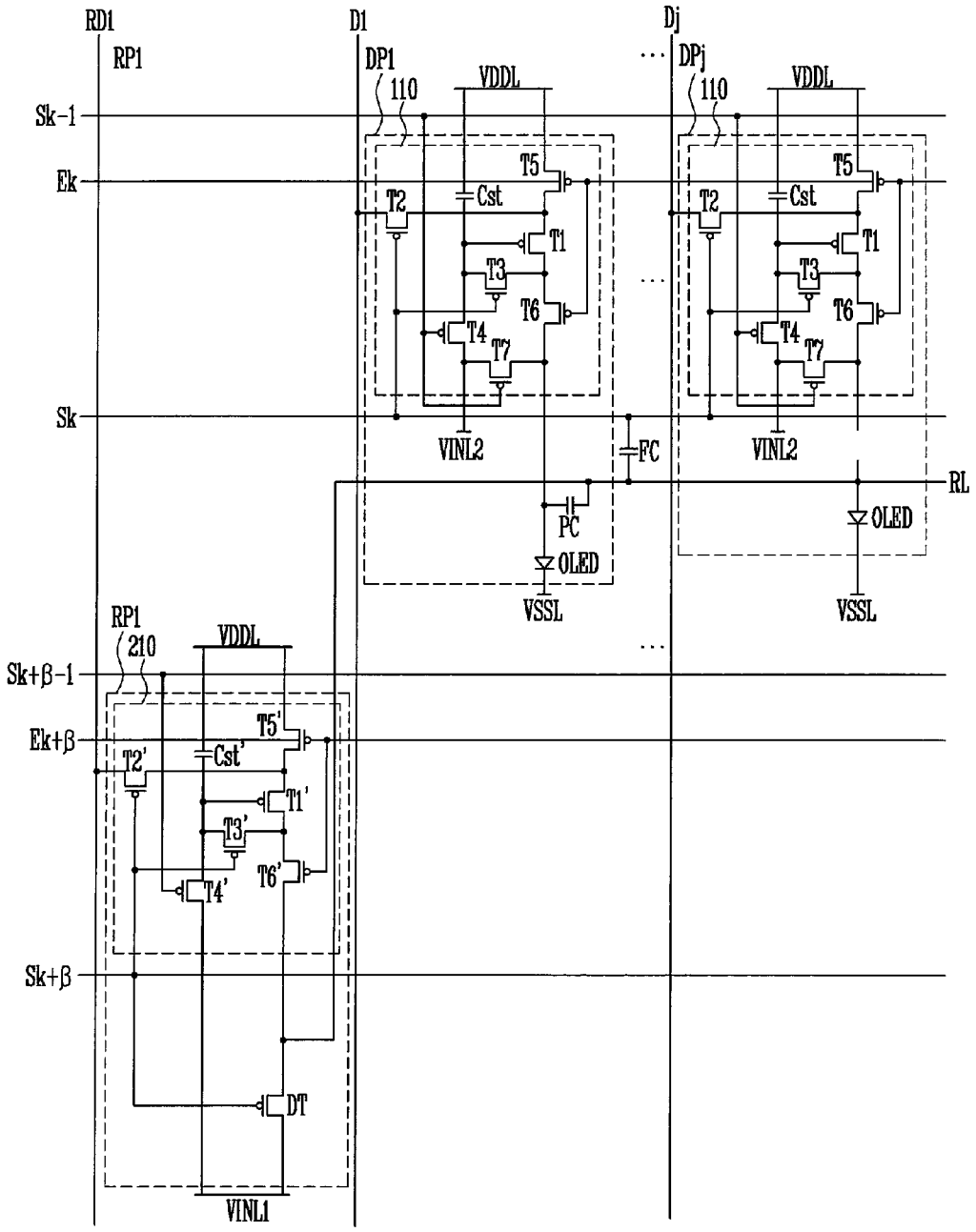
FIG. 15 is a detailed circuit diagram of display pixels and an auxiliary pixel according to another exemplary embodiment of the present invention.

FIG. 15 is a detailed circuit diagram of display pixels and an auxiliary pixel according to another exemplary embodiment of the present invention. For convenience of explanation, FIG. 15 illustrates only the $k-1^{th}$, $k^{th}$, $k+\beta-1^{th}$ and $k+\beta^{th}+p$ scan lines Sk−1, Sk, Sk+β−1, and Sk+β, the first auxiliary data line RD1, the first and $j^{th}$ data lines D1 and Dj, and $k^{th}$ and $k+\beta^{th}$ light emission control lines Ek and Ek+β. In addition, as shown in FIG. 11, the auxiliary line RL is connected to the auxiliary pixel in the $p+\beta^{th}$ row and crosses the display pixels DP in the $p^{th}$ row. Therefore, for convenience of explanation, FIG. 15 illustrates the first auxiliary pixel RP1 located in the $p+\beta^{th}$ row and the first display pixel DP1 and the $j^{th}$ display pixel DPj located in the $p^{th}$ row. The first auxiliary pixel RP1 is connected to the $k+\beta-1^{th}$ and $k+\beta^{th}$ scan lines Sk+β−1 and Sk+β, the $k+\beta^{th}$ light emission control line Ek+β, and the first auxiliary data line RD1. The first display pixel DP1 is connected to the $k-1^{th}$ and $k^{th}$ scan lines Sk−1 and Sk, the $k^{th}$ light emission control line Ek, and the first data line D1. The $j^{th}$ display pixel DPj is connected to the $k-1^{th}$ and $k^{th}$ scan lines Sk−1 and Sk, the $k^{th}$ light emission control line Ek, and the $j^{th}$ data line Dj. In FIG. 15, it is shown as an example that a defect does not occur in the first display pixel DP1 during the manufacturing process, and a defect occurs in the $j^{th}$ display pixel DPj during the manufacturing process and is repaired.

Referring to FIG. 15, the first auxiliary pixel RP1 is connected to the $j^{th}$ display pixel DPj through the auxiliary line RL. The auxiliary line RL is connected to the first auxiliary pixel RP1 and extends from the first auxiliary pixel RP1 to the display area DA to cross the display pixels DP1 and DPj. More specifically, as shown in FIG. 15, the auxiliary line RL may cross the anode electrodes of the organic light emitting diodes OLEDs of the display pixels DP1 and DPj.

The auxiliary line RL may be connected to the organic light emitting diode OLED of the $j^{th}$ display pixel DPj. In this example, the display pixel driver 110 and the organic light emitting diode OLED of the $j^{th}$ display pixel DPj may be disconnected from each other.

Each of the display pixels DP1 and DPj includes the organic light emitting diode OLED and the display pixel driver 110. The display pixels DP1 and DPj shown in FIG. 15 are substantially the same as the display pixels DP1 and DPj shown in FIG. 5, respectively. Therefore, a detailed description of the display pixels DP1 and DPj shown in FIG. 15 is omitted.

The first auxiliary pixel RP1 includes the auxiliary pixel driver 210 and the A transistor DT. The first auxiliary pixel RP1 does not include the organic light emitting diode OLED. The auxiliary pixel driver 210 of the first auxiliary pixel RP1 shown in FIG. 15 is substantially the same as the auxiliary pixel driver 210 of the first auxiliary pixel RP1 shown in FIG. 5, except that the first auxiliary pixel RP1 is connected to the $k+\beta-1^{th}$ and $k+\beta^{th}$ scan lines Sk+β−1 and Sk+β and the $k+\beta^{th}$ light emission control line Ek+β instead of the $k-1^{th}$ and $k^{th}$ scan lines Sk−1 and Sk and the $k^{th}$ light emission control line Ek, the fourth transistor T4' is connected to the first power voltage line VINL1 instead of the second power voltage line VINL2, and the seventh transistor T7' is removed. Therefore, a detailed description of the auxiliary pixel driver 210 of the first auxiliary pixel RP1 shown in FIG. 15 is omitted.

The A transistor DT is connected to the auxiliary line RL and the first power voltage line VINL1 to which the first power voltage is supplied. The A transistor DT is turned on by the voltage supplied to the control electrode of the A transistor DT to connect the auxiliary line RL and the first power voltage line VINL1. As a result, the voltage of the auxiliary line RL is discharged to the first power voltage. In other words, the A transistor DT functions to discharge the auxiliary line RL. The control electrode of the A transistor DT may be connected to the $k+\beta^{th}$ scan line Sk+β, the first electrode thereof may be coupled to the auxiliary line RL, and the second electrode thereof may be connected to the first power voltage line VINL1.

Figure 16:
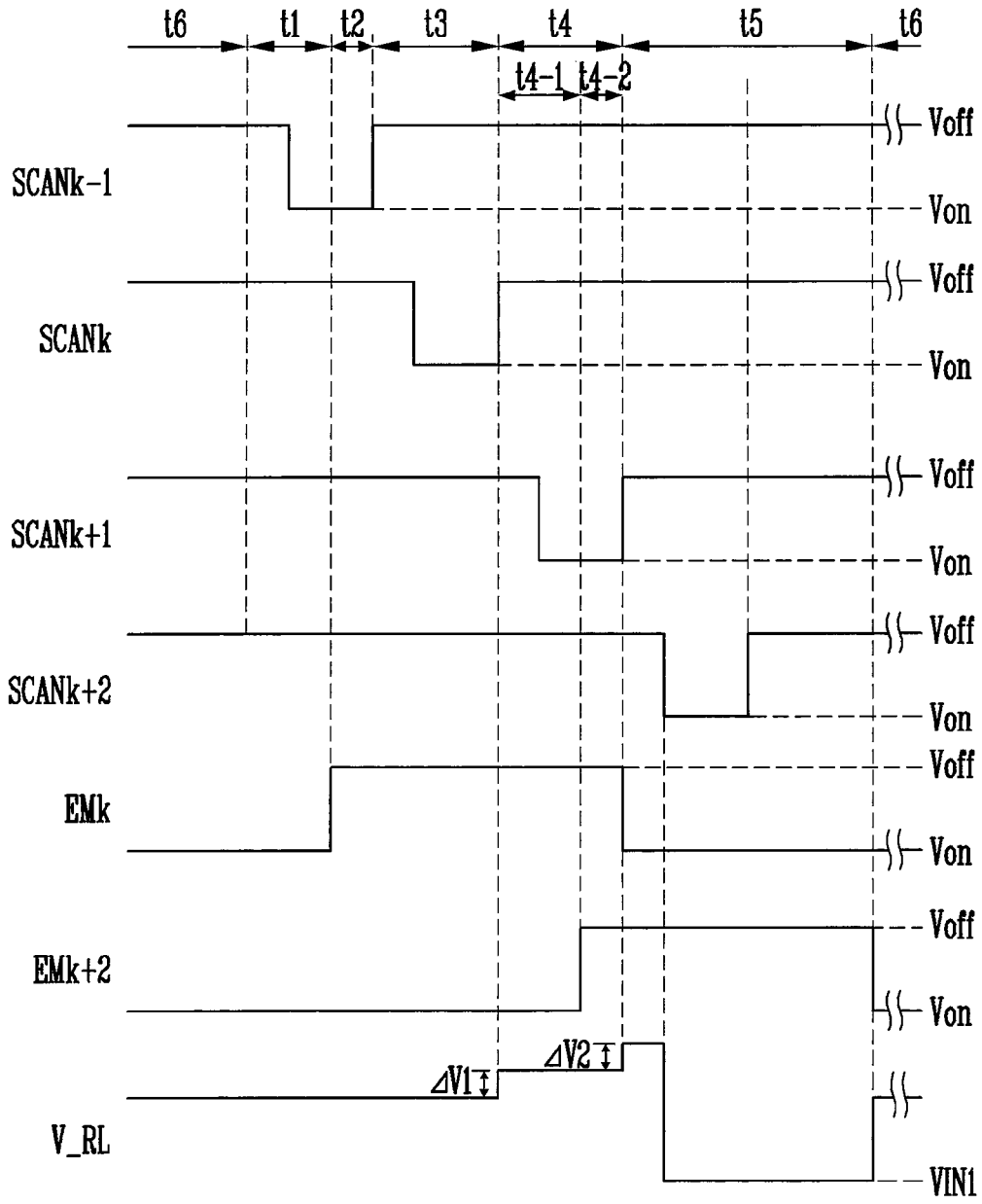
FIG. 16 is a waveform diagram of signals supplied to display pixels and an auxiliary pixel of FIG. 15, a voltage of the control electrode of the discharge transistor, and a voltage of the auxiliary line.

FIG. 16 is a waveform view of signals supplied to the display pixels and the auxiliary pixels shown in FIG. 15, a voltage of the control electrode of the discharge transistor, and a voltage of the auxiliary line. FIG. 16 illustrates the $k-1^{th}$ scan signal SCANk−1 supplied to the $k-1^{th}$ scan line Sk−1, the $k^{th}$ scan signal SCANk supplied to the $k^{th}$ scan line Sk, the $k+1^{th}$ scan signal SCANk+1 supplied to the $k+1^{th}$ scan line Sk+1, the $k+2^{th}$ scan signal SCANk+2 supplied to the $k+2^{th}$ scan line Sk+2, the $k^{th}$ light emission control signal EMk supplied to the $k^{th}$ light emission control line Ek, the $k+2^{th}$ light emission control signal EMk+2 supplied to the $k+2^{th}$ light emission control line Ek+2, a voltage (V_DTG, or SCANk+2) of the control electrode of the A transistor DT, and a voltage (V_RL) of the voltage of the auxiliary line RL. FIG. 16 illustrates the $k+1^{th}$ scan line Sk+1, the $k+2^{th}$ scan line Sk+2, and the $k+2^{th}$ light emission control line Ek+2 as examples of the $k+\beta-1^{th}$ scan line Sk+β−1, the $k+\beta^{th}$ scan line Sk+β, and the $k+\beta^{th}$ light emission control line Ek+β shown in FIG. 15, respectively. However, the present invention is not limited thereto.

The $k-1^{th}$ scan signal SCANk−1, the $k^{th}$ scan signal SCANk, and the $k^{th}$ light emission control signal EMk shown in FIG. 16 are substantially the same as the $k-1^{th}$ scan signal SCANk−1, the $k^{th}$ scan signal SCANk, and the $k^{th}$ light emission control signal EMk shown in FIG. 7, respectively. Therefore, a detailed description of the $k-1^{th}$ scan signal SCANk−1, the $k^{th}$ scan signal SCANk, and the $k^{th}$ light emission control signal EMk shown in FIG. 16 is omitted.

The $k+1^{th}$ scan signal SCANk+1 is generated to have a level of the gate-on voltage Von for part of the fourth period t4, and the $k+2^{th}$ scan signal SCANk+2 is generated to have a level of the gate-on voltage Von for part of the fifth period t5. The $k+2^{th}$ light emission control signal EMk+2 is generated to have the gate-off voltage Voff for all of the $4\text{-}2^{nd}$ and fifth periods t4-2 and t5.

Hereinafter, a driving method of the first auxiliary pixel RP1 and the $j^{th}$ display pixel DPj and a driving method of the first display pixel DP1 are described in connection with FIGS. 15 and 16.

First, the driving method of the first display pixel DP1 according to FIGS. 15 and 16 is substantially the same as the driving method of the first display pixel DP1. Therefore, a detailed description of the driving method of the first display pixel DP1 according to FIGS. 15 and 16 is omitted.

Subsequently, the driving method of the first auxiliary pixel RP1 and the $j^{th}$ display pixel DPj is described in detail.

First, the organic light emitting diode OLED emits light for the first to third periods t1 to t3.

For the first to third periods t1 to t3, the $k+1^{th}$ scan signal SCANk+1 having a level of the gate-off voltage Voff is supplied to the $k+1^{th}$ scan line Sk+1, the $k+2^{th}$ scan signal SCANk+2 having a level of the gate-off voltage Voff is supplied to the $k+2^{th}$ scan line Sk+2, and the $k+2^{th}$ light emission control signal EMk+2 having a level of the gate-on voltage Von is supplied to the $k+2^{th}$ light emission control line Ek+2. Therefore, the fifth and sixth transistors T5' and T6' are turned on for the first to third periods t1 to t3.

Since the fifth and sixth transistors T5' and T6' are turned on, the driving current Ids' of the auxiliary pixel driver 210 is supplied to the organic light emitting diode OLED of the $j^{th}$ display pixel DPj through the auxiliary line RL. Therefore, the organic light emitting diode OLED of the $j^{th}$ display pixel DPj emits light.

Second, an on bias is applied to the first transistor T1 for the $4\text{-}1^{st}$ period t4-1. The fourth period t4 includes the $4\text{-}1^{st}$ period t4-1 and the $4\text{-}2^{nd}$ period t4-2.

For part of the $4\text{-}1^{st}$ period t4-1, the $k+1^{th}$ scan signal SCANk+1 having a level of the gate-on voltage Von is supplied to the $k+1^{th}$ scan line Sk+1, and for all of the $4\text{-}1^{st}$ period t4-1, the $k+2^{th}$ light emission control signal EMk+2 having a level of the gate-on voltage Von is supplied to the $k+2^{th}$ light emission control line Ek+2. Therefore, the fourth, fifth and sixth transistors T4', T5' and T6' are turned on for all or part of the $4\text{-}1^{st}$ period t4-1.

Since the fourth transistor T4' is turned on, the control electrode of the first transistor T1' is initialized to the second power voltage VIN2 of the second power voltage line VINL2. Since the fifth and sixth transistors T5' and T6' are turned on, a current path is formed so that current may flow from the third power voltage line VDDL to the auxiliary line RL through the fifth transistor T5', the first transistor T1', and the sixth transistor T6'. Since the second power voltage VIN2 is set to be sufficiently lower than the third power voltage VDD, the voltage difference (Vgs=VIN2−VDD) between the control electrode and the first electrode of the first transistor T1' is less than the threshold voltage Vth of the first transistor T1' for the $4\text{-}1^{st}$ period t4-1, so that current flows through the current path.

Therefore, the control electrode of the first transistor T1' is discharged to the second power voltage for the $4\text{-}1^{st}$ period t4-1, so that the on bias may be applied to the first transistor T1'. As a result, according to an exemplary embodiment of the present invention, the on bias may be applied to the first transistor T1' before the data voltage is supplied to the control electrode of the first transistor T1'. Therefore, image quality degradation caused by hysteresis characteristics of the first transistor T1' may be prevented (or reduced).

Since the $k^{th}$ scan line Sk and the auxiliary line RL are formed next to each other, the fringe capacitance FC may be formed between the $k^{th}$ scan line Sk and the auxiliary line RL as illustrated in FIG. 15. Voltage variations of the $k^{th}$ scan line Sk may be reflected in the auxiliary line RL by the fringe capacitance FC. Therefore, when the $k^{th}$ scan signal SCANk increases from the gate-on voltage Von to the gate-off voltage Voff for the 4-$1^{st}$ period t4-1, the changes in voltage of the $k^{th}$ scan line Sk may be reflected by the fringe capacitance FC, so that the voltage of the auxiliary line RL may be increased by ΔV1.

Third, the control electrode of the first transistor T1' is initialized to the second power voltage VIN2 for the 4-$2^{nd}$ period t4-2.

For the 4-$2^{nd}$ period t4-2, the k+$1^{th}$ scan signal SCANk+1 having a level of the gate-on voltage Von is supplied to the k+$1^{th}$ scan line Sk+1, and the k+$2^{th}$ light emission control signal EMk+2 having a level of the gate-off voltage Voff is supplied to the k+$2^{th}$ light emission control line Ek+2, so that the fourth transistor T4' is turned on for the 4-$2^{nd}$ period t4-2.

Since the fourth transistor T4' is turned on, the control electrode of the first transistor T1' is initialized to the second power voltage VIN2 of the second power voltage line VINL2.

Fourth, for the fifth period t5, a data voltage and a threshold voltage of the control electrode of the first transistor T1' are sampled, and the auxiliary line RL is discharged to the first power voltage VIN1.

In the fifth period t5, the k+$2^{th}$ scan signal SCANk+2 having a level of the gate-on voltage Von for part of the fifth period t5 is supplied to the k+$2^{th}$ scan line Sk+2, and the k+$2^{th}$ light emission control signal EMk+2 having a level of the gate-off voltage Voff for all of the fifth period t5 is supplied to the k+$2^{th}$ light emission control line Ek+2, so that the second and third transistors T2' and T3' and the A transistor DT are turned on for all or part of the fifth period t5.

Since the second transistor T2' is turned on, the data voltage Vdata of the first data line D1 is supplied to the first electrode of the first transistor T1'. Since the third transistor T3' is turned on, the control electrode and the second electrode of the first transistor T1' are connected. Therefore, the first transistor T1' is driven as a diode.

Since the voltage difference (Vgs=VIN2−Vdata) between the control electrode and the first electrode of the first transistor T1' is less than the threshold voltage Vth, current flows through the first transistor T1' until the voltage difference (Vgs) between the control electrode and the first electrode reaches the threshold voltage Vth of the first transistor T1'. Therefore, the voltage of the control electrode of the first transistor T1' increases to "Vdata+Vth" for the third period t3.

Since the A transistor DT is turned on, the auxiliary line RL is connected to the first power voltage line VINL1. Therefore, the auxiliary line RL is discharged to the first power voltage VIN1.

Since the auxiliary line RL overlaps with the anode electrodes of the organic light emitting diodes OLEDs of the display pixels DP1, the parasitic capacitances PC may be formed between the auxiliary line RL and the anode electrodes of the organic light emitting diodes OLEDs of the display pixels DP1 as shown in FIG. 15. Voltage variations of the anode electrodes of the organic light emitting diodes OLEDs may be reflected in the auxiliary line RL by the parasitic capacitance PC. Driving currents are supplied to the anode electrodes of the organic light emitting diodes OLEDs of the display pixels DP1 by the $k^{th}$ light emission control signal EMk having a level of the gate-on voltage Von for the fifth period t5. Therefore, the voltage variations of the anode electrodes of the organic light emitting diodes OLEDs of the display pixels DP1 may be reflected in the auxiliary line RL by the parasitic capacitance PC, so that the voltage of the auxiliary line RL may be increased by ΔV2. However, since the auxiliary line RL is connected to the first power voltage line VINL1 for the fifth period t5, the auxiliary line RL is discharged to the first power voltage VIN1 even when the voltage variations of the anode electrodes of the organic light emitting diodes OLEDs of the display pixels DP1 are reflected by the parasitic capacitance PC.

Fifth, the organic light emitting diode OLED emits light for the sixth period t6.

For the sixth period t6, the k+$2^{th}$ scan signal SCANk+2 is supplied to the k+$2^{th}$ scan line Sk+2 having a level of the gate-off voltage Voff, and the k+$2^{th}$ light emission control signal EMk+2 having a level of the gate-on voltage Von is supplied to the k+$2^{th}$ light emission control line Ek+2. As a result, for the sixth period t6, the fifth and sixth transistors T5' and T6' are turned on, and the A transistor DT is turned off.

Since the A transistor DT is turned off and the fifth and sixth transistors T5' and T6' are turned on, the driving current Ids' of the auxiliary pixel driver 210 is supplied to the organic light emitting diode OLED of the $j^{th}$ display pixel DPj through the auxiliary line RL. Therefore, the organic light emitting diode OLED of the $j^{th}$ display pixel DPj emits light.

The control electrode of the first transistor T1' maintains "Vdata+Vth" by the storage capacitor Cst. The driving current Ids' flowing through the first transistor T1' may be expressed by Equation 2. In addition, Equation 3 is derived from Equation 2.

As shown in Equation 3, the driving current Ids' does not depend on the threshold voltage Vth of the first transistor T1'. In other words, the threshold voltage Vth of the first transistor T1' is compensated.

As described above, according to an exemplary embodiment of the present invention, the voltage of the auxiliary line RL may be prevented (or protected) from being changed by the parasitic capacitances PC and the fringe capacitance FC. As a result, according to an exemplary embodiment of the present invention, the organic light emitting diode OLED of the $j^{th}$ display pixel DPj may be prevented (or protected) from emitting light in error due to the parasitic capacitances PC and the fringe capacitance FC.

Figure 17:
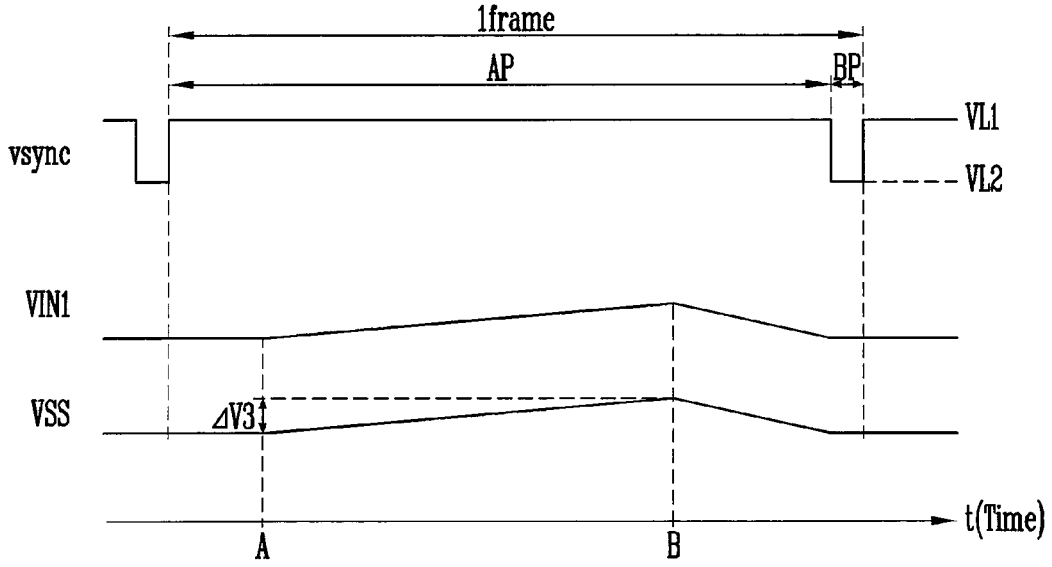
FIG. 17 is a waveform diagram of a first power voltage supplied to a first power voltage line, a fourth power voltage supplied to a fourth power voltage line, and a vertical synchronization signal.

FIG. 17 is a waveform view of a first power voltage supplied to a first power voltage line, a fourth power voltage supplied to a fourth power voltage line, and a vertical synchronization signal. Referring to FIG. 17, the vertical synchronization signal vsync is generated at each one frame period. A period for which the vertical synchronization signal vsync is generated to have a first level voltage VL1 corresponds to the active period AP, and a period for which the vertical synchronization signal vsync is generated to have a second level voltage VL2 corresponds to the blank period BP.

The fourth power voltage VSS may be changed for the one frame period by a voltage drop (IR drop) as shown in FIG. 17. Since the fourth power voltage line VSSL for supplying the fourth power voltage VSS is connected to cathode electrodes of organic light emitting diodes of display pixels, the fourth power voltage VSS drops as current is supplied to the organic light emitting diodes. Therefore, there is a difference ΔV3 between the fourth power voltage VSS at a time point A when a minimal voltage drop occurs and the fourth power voltage VSS at a time point B when a maximum voltage drop occurs.

However, when the first power voltage VIN1 is supplied without being changed, the difference at the time point A between the first power voltage VIN1 and the fourth power voltage VSS may be greater than the difference at the time point B between the first power voltage VIN1 and the fourth power voltage VSS. As a result, the repaired pixel emitting light at the time point B is initialized to the first power voltage VIN1 which is lower than that of the repaired pixel emitting light at time point A. Thus, the repaired pixel emitting light at the time point B may display a lower gray scale than a repaired pixel emitting light at the time point A. The repaired pixel emitting light at the time point B is more likely to display a lower gray scale than the repaired pixel emitting light at the time point A when the repaired pixel displays a low gray scale.

In order to prevent the repaired pixel emitting light at the time point B from displaying a lower gray scale than the auxiliary pixel emitting light at the time point A (or reduce the extent to which this occurs), according to an exemplary embodiment of the present invention, the first power voltage VIN1 may be changed to substantially coincide with voltage variations of the fourth power voltage VSS. The power supply may supply the first power voltage VIN1 so that the first power voltage VIN1 may gradually increase from the time point A to the time point B and gradually decrease from the time point B. In other words, according to an exemplary embodiment of the present invention, when the voltage variations of the fourth power voltage VSS are in the form of a triangle, the first power voltage VIN1 with a triangle wave may be supplied. As a result, according to an exemplary embodiment of the present invention, the difference at the time point A between the first power voltage VIN1 and the fourth power voltage VSS may substantially coincide with the difference VSS at the time point B between the first power voltage VIN1 and the fourth power voltage. As a result, according to an exemplary embodiment of the present invention, the repaired pixel emitting light at the time point B may be prevented (or protected) from displaying a lower gray scale than the repaired pixel emitting light at the time point A as shown in FIG. 17.

In a substantially similar manner as the first power voltage VIN1, the second power voltage VIN2 with a triangle wave may be supplied to the second power voltage line VINL2. The first power voltage VIN1 and the second power voltage VIN2 may be set to substantially the same voltage. Alternatively, the second power voltage VIN2 may be set to a voltage obtained by adding or subtracting a predetermined voltage to or from the first power voltage VIN1.

Figure 18:
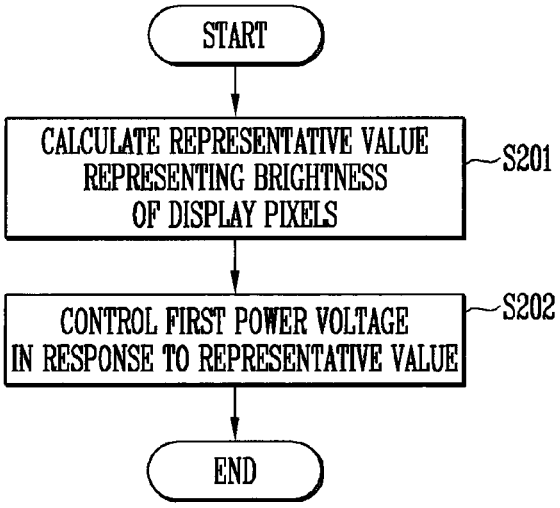
FIG. 18 is a flowchart illustrating a method of supplying a first power voltage according to an exemplary embodiment of the present invention.

FIG. 18 is a flowchart illustrating a method of supplying a first power voltage according to an exemplary embodiment of the present invention. Hereinafter, the method of supplying the first power voltage according to an exemplary embodiment of the present invention is described with reference to FIGS. 1, 17 and 18.

First, the timing controller 50 may analyze the digital video data DATA for one frame period and calculate a representative value of brightness of the display pixels. For example, the timing controller 50 may calculate a sum of the digital video data DATA for one frame period as the representative value. Alternatively, the timing controller 50 may calculate the representative value by dividing the sum of the digital video data DATA for one frame period by a predetermined value. The timing controller 50 outputs the calculated representative value to the power supply 60. (Step S201 in FIG. 18)

Figure 19:
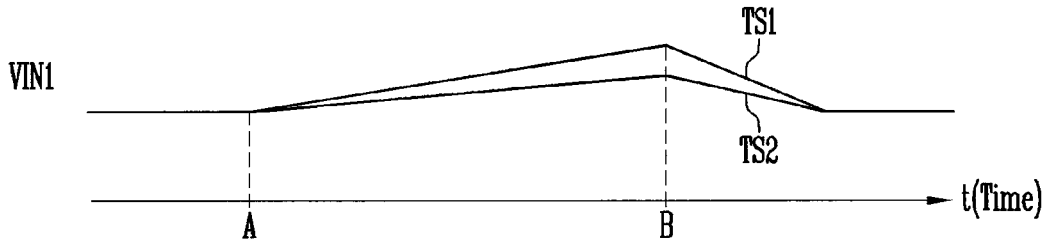
FIG. 19 is an exemplary view illustrating a first power voltage of first and second triangle waves.

Second, the power supply 60 receives the representative value from the timing controller 50. The power supply 60 controls the first power voltage VIN1 according to the representative value. As the representative value is greater, the power supply 60 may control the first power voltage VIN1 so that the first power voltage VIN1 may be increased at the time point B as shown in FIG. 17. For example, when a first representative value is input, the power supply 60 may supply the first power voltage VIN1 with a first triangle wave TS1 in the form of a first obtuse triangle as shown in FIG. 19. When a second representative value smaller than the first representative value is input, the power supply 60 may supply the first power voltage VIN1 with a second triangle wave TS2 in the form of a second obtuse triangle having a greater obtuse angle than the first obtuse triangle. The power supply 60 may control the first power voltage VIN1 according to the representative value by using a look-up table which stores a voltage value of the first power voltage VIN1 in response to the representative value. (Step S202 in FIG. 18)

As described above, according to an exemplary embodiment of the present invention, since the voltage variations of the fourth power voltage VSS may vary depending on the brightness of the display pixels, the first power voltage VIN1 may be changed according to the representative value of the brightness of the display pixels. As a result, according to an exemplary embodiment of the present invention, the repaired pixel emitting light at the time point B may be prevented (or protected) from displaying a lower gray scale than the auxiliary pixel emitting light at the time point A as shown in FIG. 17.

In addition, according to an exemplary embodiment of the present invention, auxiliary data to be supplied to an auxiliary pixel displaying a low gray scale is converted by using the auxiliary data conversion unit 42 of the second data driver 40, shown in FIGS. 2 and 11, on the basis of the representative value, so that the repaired pixel emitting light at the time point B may be prevented (or protected) from displaying a lower gray scale than the auxiliary pixel emitting light at the time point A as shown in FIG. 17. More specifically, when the auxiliary data RD is to be supplied to the repaired pixel emitting light at the time point B as shown in FIG. 17, the auxiliary data conversion unit 42 of the second data driver 40 may determine that the auxiliary pixel will display a low gray scale if the auxiliary data RD is smaller than a first threshold value. In this example, the auxiliary data conversion unit 42 may add predetermined data to the auxiliary data RD. As a result, according to an exemplary embodiment of the present invention, the auxiliary data voltage supplied to the auxiliary pixel displaying a low gray scale at the time point as shown in FIG. 17 may be greater than the auxiliary data voltage to be originally supplied, so that the repaired pixel emitting light at the time point B may be prevented (or protected) from displaying a lower gray scale than the auxiliary pixel emitting light at the time point A as shown in FIG. 17.

According to an exemplary embodiment of the present invention, an auxiliary line is discharged to a first power voltage by using an A transistor. As a result, according to an exemplary embodiment of the present invention, a voltage of the auxiliary line may be prevented (or protected) from being changed by parasitic capacitances between the auxiliary line and organic light emitting diodes of display pixels and a fringe capacitance between the auxiliary line and a neighboring scan line. Therefore, according to an exemplary embodiment of the present invention, an organic light emitting diode may be prevented (or protected) from emitting light in error.

According to an exemplary embodiment of the present invention, digital video data corresponding to a coordinate value of a repaired pixel is calculated as auxiliary data. As a result, according to an exemplary embodiment of the present invention, the same auxiliary data voltage as a data voltage to be supplied to the repaired pixel may be supplied to an auxiliary pixel connected to the repaired voltage.

In addition, according to an exemplary embodiment of the present invention, initialization data is supplied to auxiliary pixels not connected to the repaired pixel. As a result, according to an exemplary embodiment of the present invention, display pixels in a display area may be prevented (or protected) from being affected by voltage variations of auxiliary lines connected to the auxiliary pixels not connected to the repaired pixel.

Further, according to an exemplary embodiment of the present invention, the first power voltage is supplied as a voltage with a triangle wave. As a result, according to an exemplary embodiment of the present invention, a repaired pixel emitting light at a time point may be prevented (or protected) from displaying a lower gray scale than an auxiliary pixel emitting light at another time point due to a voltage drop of another power voltage.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims and equivalents thereof.

What is claimed is:

1. An organic light emitting display device comprising:

data lines and auxiliary data lines;

scan lines and light emission control lines crossing the data lines and the auxiliary data lines;

a display area comprising display pixels at crossing regions of the data lines, the scan lines, and the light emission control lines;

a non-display area comprising auxiliary pixels at crossing regions of the auxiliary data lines, the scan lines, and the light emission control lines; and auxiliary lines connected to the auxiliary pixels, wherein each of the auxiliary pixels comprises:

an auxiliary pixel driver configured to supply a driving current to a corresponding one of the auxiliary lines; and an auxiliary transistor connected to the corresponding one of the auxiliary lines, and to a first power voltage line, the auxiliary transistor being configured to transmit a first power voltage from the first power voltage line, in response to a control signal.

2. The organic light emitting display device of claim 1, wherein the corresponding one of the auxiliary lines is connected to an auxiliary pixel in a $p^{th}$ row from among the auxiliary pixels and crosses display pixels in the $p^{th}$ row from among the display pixels, where p is a positive integer.

3. The organic light emitting display device of claim 2, wherein the corresponding one of the auxiliary lines is connected to one of the display pixels in the $p^{th}$ row.

4. The organic light emitting display device of claim 2, wherein the auxiliary pixel in the $p^{th}$ row and the display pixels in the $p^{th}$ row are connected to a $k-1^{th}$ scan line and a $k^{th}$ scan line from among the scan lines, and a $k^{th}$ light emission control line from among the light emission control lines, where k is a positive integer of 2 or more.

5. The organic light emitting display device of claim 4, wherein the auxiliary pixel driver of an auxiliary pixel from among the auxiliary pixels comprises:

a first transistor configured to control the driving current of the auxiliary pixel driver in response to a voltage of a control electrode thereof;

a second transistor connected to one of the auxiliary data lines and a first electrode of the first transistor;

a third transistor connected to the control electrode of the first transistor and a second electrode of the first transistor;

a fourth transistor connected to the control electrode of the first transistor and to a second power voltage line connected to a second power voltage supply;

a fifth transistor connected to the first electrode of the first transistor and to a third power voltage line connected to a third power voltage supply;

a sixth transistor connected to the second electrode of the first transistor and to the corresponding one of the auxiliary lines;

a seventh transistor connected to the corresponding one of the auxiliary lines and to the second power voltage line; and a storage capacitor connected to the control electrode of the first transistor and to the third power voltage line, wherein control electrodes of the second and third transistors are connected to the $k^{th}$ scan line, control electrodes of the fourth and seventh transistors are connected to the $k-1^{th}$ scan line, and control electrodes of the fifth and sixth transistors are connected to the $k^{th}$ light emission control line.

6. The organic light emitting display device of claim 2, wherein a control electrode of the auxiliary transistor is connected to a pull-down control node of a light emission stage connected to a $k+\alpha^{th}$ light emission control line from among the light emission control lines, where a is a positive integer.

7. The organic light emitting display device of claim 2, wherein the auxiliary pixel in the $p^{th}$ row further comprises an inverter connected to a $k+\alpha^{th}$ light emission control line from among the light emission control lines and a control electrode of the auxiliary transistor, the inverter being configured:

to invert a light emission control signal supplied to the $k+\alpha^{th}$ light emission control line, and to supply an inverted light emission control signal to the control electrode of the auxiliary transistor.

8. The organic light emitting display device of claim 2, wherein the auxiliary pixel in the $p^{th}$ row comprises:

an auxiliary control transistor connected to a control electrode of the auxiliary transistor and a gate-off voltage line connected to a gate-off voltage supply; and a resistor connected to the control electrode of the auxiliary transistor and a gate-on voltage line connected to a gate-on voltage supply, and wherein a control electrode of the auxiliary control transistor is connected to a $k+\alpha^{th}$ light emission control line from among the light emission control lines.

9. The organic light emitting display device of claim 2, further comprising:

a scan driver configured to supply scan signals to the scan lines;

a light emission driver configured to supply light emission control signals to the light emission control lines;

a first data driver configured to supply data voltages to the data lines; and a second data driver configured to supply auxiliary data voltages to the auxiliary data lines, wherein the second data driver is configured to supply one of the auxiliary data voltages to the auxiliary pixel in the $p^{th}$ row in synchronization with data voltages supplied to the display pixels in the $p^{th}$ row.

10. The organic light emitting display device of claim 9, wherein the second data driver comprises:

an auxiliary data calculation unit configured to calculate digital video data corresponding to a coordinate value of a repaired pixel, from among the display pixels, as auxiliary data;

a memory configured to store the auxiliary data and configured to update the stored auxiliary data with initialization data at each predetermined period; and an auxiliary data voltage conversion unit configured to:

receive the auxiliary data or the initialization data from the memory, convert the auxiliary data or the initialization data into auxiliary data voltages, and output the auxiliary data voltages.

11. The organic light emitting display device of claim 1, wherein the corresponding one of the auxiliary lines is connected to an auxiliary pixel in a $p+\beta^{th}$ row from among the auxiliary pixels and crosses display pixels in a $p^{th}$ row from among the display pixels, wherein p and β are positive integers.

12. The organic light emitting display device of claim 11, wherein the corresponding one of the auxiliary lines is connected to a display pixel from among the display pixels in the $p^{th}$ row.

13. The organic light emitting display device of claim 11, wherein the display pixels in the $p^{th}$ row are connected to a $k-1^{th}$ scan line from among the scan lines, a $k^{th}$ scan line from among the scan lines, and a $k^{th}$ light emission control line from among the light emission control lines, where k is a positive integer of 2 or more, and the auxiliary pixel in the $p+\beta^{th}$ row is connected to a $k+\beta-1^{th}$ scan line from among the scan lines, a $k+\beta^{th}$ scan line from among the scan lines, and a $k+\beta^{th}$ light emission control line from among the light emission control lines.

14. The organic light emitting display device of claim 13, wherein the auxiliary pixel driver of the auxiliary pixel in the $p+\beta^{th}$ row comprises:

a first transistor configured to control the driving current of the auxiliary pixel driver in response to a voltage of a control electrode thereof;

a second transistor connected to one of the auxiliary data lines and to a first electrode of the first transistor;

a third transistor connected to the control electrode of the first transistor and to a second electrode of the first transistor;

a fourth transistor connected to the control electrode of the first transistor and to a second power voltage line connected to a second power voltage supply;

a fifth transistor connected to the first electrode of the first transistor and to a third power voltage line connected to a third power voltage supply;

a sixth transistor connected to the second electrode of the first transistor and to the corresponding one of the auxiliary lines;

a seventh transistor connected to the corresponding one of the auxiliary lines and to the second power voltage line; and a storage capacitor connected to the control electrode of the first transistor and to the third power voltage line, wherein control electrodes of the second and third transistors are connected to the $k+\beta^{th}$ scan line from among the scan lines, control electrodes of the fourth and seventh transistors are connected to the $k+\beta-1^{th}$ scan line from among the scan lines, and control electrodes of the fifth and sixth transistors are connected to the $k+\beta^{th}$ light emission control line from among the light emission control lines.

15. The organic light emitting display device of claim 13, wherein the auxiliary pixel driver comprises:

a first transistor configured to control the driving current of the auxiliary pixel driver in response to a voltage of a control electrode thereof;

a second transistor connected to one of the auxiliary data lines and to a first electrode of the first transistor;

a third transistor connected to the control electrode of the first transistor and to a second electrode of the first transistor;

a fourth transistor connected to the control electrode of the first transistor and to the first power voltage line;

a fifth transistor connected to the first electrode of the first transistor and to a third power voltage line connected to a third power voltage supply;

a sixth transistor connected to the second electrode of the first transistor and to the corresponding one of the auxiliary lines; and a storage capacitor connected to the control electrode of the first transistor and to the third power voltage line, wherein control electrodes of the second and third transistors are connected to the $k+\beta^{th}$ scan line from among the scan lines, a control electrode of the fourth transistor is connected to the $k+\beta-1^{th}$ scan line from among the scan lines, and respective control electrodes of the fifth and sixth transistors are connected to the $k+\beta^{th}$ light emission control line from among the light emission control lines.

16. The organic light emitting display device of claim 11, wherein a control electrode of the auxiliary transistor is connected to a $k+\beta^{th}$ scan line from among the scan lines.

17. The organic light emitting display device of claim 11, further comprising:

a scan driver configured to supply scan signals to the scan lines;

a light emission driver configured to supply light emission control signals to the light emission control lines;

a first data driver configured to supply data voltages to the data lines; and a second data driver configured to supply auxiliary data voltages to the auxiliary data lines, wherein the second data driver is configured to supply the auxiliary data voltages to an auxiliary pixel in a $k+\beta^{th}$ row from among the auxiliary pixels in synchronization with the data voltages supplied to display pixels in a $k^{th}$ row from among the display pixels.

18. The organic light emitting display device of claim 17, wherein the second data driver comprises:

an auxiliary data calculation unit configured to calculate digital video data corresponding to a coordinate value of a repaired pixel, from among the display pixels, as auxiliary data;

a memory configured to store the auxiliary data and configured to update the stored auxiliary data with initialization data at each predetermined period; and an auxiliary data voltage conversion unit configured to:

receive the auxiliary data or the initialization data from the memory, convert the auxiliary data or the initialization data into an auxiliary data voltage, and output the auxiliary data voltage by delaying the auxiliary data voltage by β times a horizontal period.

19. The organic light emitting display device of claim 1, wherein each of the display pixels comprises:

an organic light emitting diode; and a display pixel driver comprising a plurality of transistors and configured to supply a display pixel driving current to the organic light emitting diode, wherein the display pixel driver comprises:

a first transistor configured to control the display pixel driving current in response to a voltage of a control electrode thereof;

a second transistor connected to one of the data lines and to a first electrode of the first transistor;

a third transistor connected to the control electrode of the first transistor and to a second electrode of the first transistor;

a fourth transistor connected to the control electrode of the first transistor and to a second power voltage line connected to a second power voltage supply;

a fifth transistor connected to the first electrode of the first transistor and to a third power voltage line connected to a third power voltage supply;

a sixth transistor connected to the second electrode of the first transistor and to an anode electrode of the organic light emitting diode;

a seventh transistor connected to the anode electrode of the organic light emitting diode and to the second power voltage line; and a storage capacitor connected to the control electrode of the first transistor and to the third power voltage line.

20. The organic light emitting display device of claim 1, wherein the display device is configured to supply the first power voltage as a voltage with a triangle wave for one frame period.

* * * * *